US010017892B2

(12) United States Patent
Kim et al.

(10) Patent No.: US 10,017,892 B2
(45) Date of Patent: Jul. 10, 2018

(54) WASHING APPARATUS AND CONTROLLING METHOD THEREOF

(71) Applicant: SAMSUNG ELECTRONICS CO., LTD., Suwon-si, Gyeonggi-do (KR)

(72) Inventors: Sung Jong Kim, Suwon-si (KR); Yee Lee Wong, Suwon-si (KR); Jeong Hoon Kang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 441 days.

(21) Appl. No.: 14/628,499

(22) Filed: Feb. 23, 2015

(65) Prior Publication Data

US 2015/0240404 A1 Aug. 27, 2015

(30) Foreign Application Priority Data

Feb. 21, 2014 (KR) ..... 10-2014-0020122
Oct. 23, 2014 (KR) ..... 10-2014-0144021

(51) Int. Cl.
*D06F 33/02* (2006.01)
*D06F 39/08* (2006.01)
(Continued)

(52) U.S. Cl.
CPC ..... *D06F 33/02* (2013.01); *D06F 37/245* (2013.01); *D06F 37/304* (2013.01); *D06F 37/40* (2013.01); *D06F 39/087* (2013.01); *D06F 35/007* (2013.01); *D06F 37/30* (2013.01); *D06F 39/083* (2013.01); *D06F 2202/065* (2013.01); *D06F 2202/085* (2013.01); *D06F 2202/10* (2013.01);
(Continued)

(58) Field of Classification Search
CPC ..... D06F 33/02; D06F 35/006; D06F 39/087; D06F 2202/085; D06F 39/083
USPC .. 68/12.05, 12.02, 12.04, 12.21, 207, 12.19, 68/12.12, 12.14, 12.16, 12.24, 208, 23.6, 68/12.27; 8/159, 158, 137
See application file for complete search history.

(56) References Cited

U.S. PATENT DOCUMENTS 3,248,909 A * 5/1966 Knerr ..... D06F 33/00 200/83 WM
3,269,153 A * 8/1966 Waldrop ..... D06F 23/00 68/12.05
(Continued)

FOREIGN PATENT DOCUMENTS

| | | |
|---|---|---|
| CN | 1174904 | 3/1998 |
| CN | 1508322 | 6/2004 |
| KR | 2001-0002547 | 1/2001 |

OTHER PUBLICATIONS

Chinese Office Action dated Jan. 25, 2018 in Chinese Patent Application No. 201510087335.6.

*Primary Examiner* — David G Cormier
*Assistant Examiner* — Thomas Bucci
(74) *Attorney, Agent, or Firm* — Staas & Halsey LLP

(57) ABSTRACT

A washing apparatus including an AC motor configured to generate a rotating force, a clutch unit configured to selectively transmit the rotating force to a rotating tub and a pulsator, a speed detector configured to detect a rotating speed of at least one of the AC motor and the clutch unit, and a controller configured to repeat power supply and power cut-off to the AC motor according to the rotating speed. The washing apparatus can control the power supply and power cut-off to the AC motor based on the rotating speed.

6 Claims, 39 Drawing Sheets

(51) Int. Cl.

| | |
|---|---|
| ***D06F 37/30*** | (2006.01) |
| ***D06F 37/40*** | (2006.01) |
| ***D06F 37/24*** | (2006.01) |
| *D06F 35/00* | (2006.01) |

(52) U.S. Cl.
CPC .. *D06F 2204/065* (2013.01); *D06F 2204/084* (2013.01); *D06F 2204/10* (2013.01); *D06F 2232/08* (2013.01)

(56) References Cited

U.S. PATENT DOCUMENTS 3,287,752 A * 11/1966 Waldrop ..... D06F 35/007 210/781
4,054,412 A * 10/1977 Brummett ..... D06F 23/04 68/23.3
4,862,710 A * 9/1989 Torita ..... D06F 39/003 68/12.01
5,469,719 A * 11/1995 Imai ..... D06F 35/006 68/12.02
5,551,261 A * 9/1996 Lyu ..... D06F 37/40 68/23.6
6,116,061 A * 9/2000 Oh ..... D06F 39/083 68/148
6,247,339 B1 * 6/2001 Kenjo ..... D06F 35/007 68/12.04
6,609,264 B2 * 8/2003 Ruhl ..... D06F 39/085 68/12.02
8,875,333 B2 * 11/2014 Im ..... D06F 35/006 8/159
2004/0045097 A1 * 3/2004 Kim ..... D06F 33/02 8/159
2006/0107468 A1 * 5/2006 Urbanet ..... D06F 39/003 8/158
2006/0168740 A1 * 8/2006 Ha ..... D06F 33/02 8/158
2007/0169522 A1 * 7/2007 Seo ..... D06F 35/007 68/12.01
2010/0154132 A1 * 6/2010 Im ..... D06F 35/006 8/159
2011/0099724 A1 * 5/2011 Plata Amarillas ..... D06F 33/02 8/137

* cited by examiner

FIG. 17- Prior Art
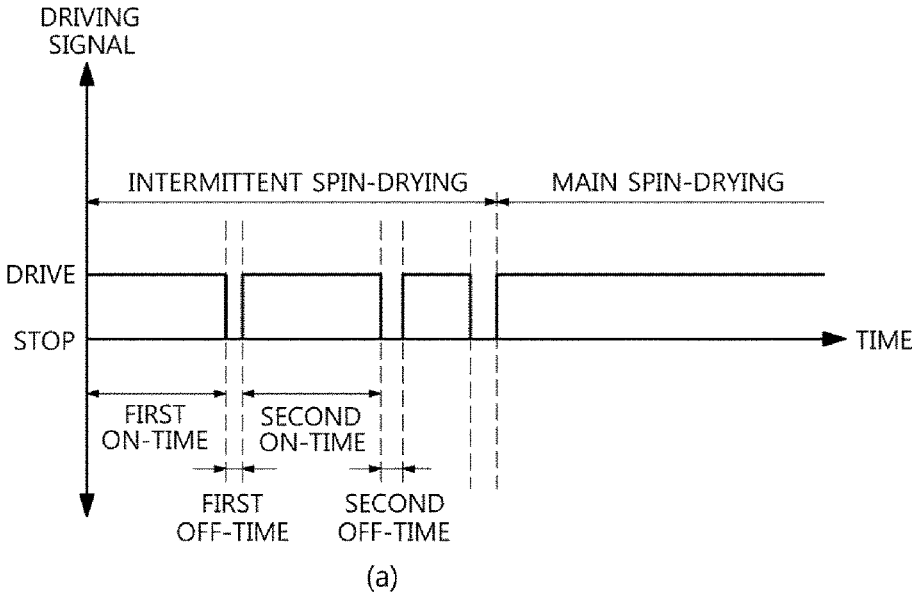
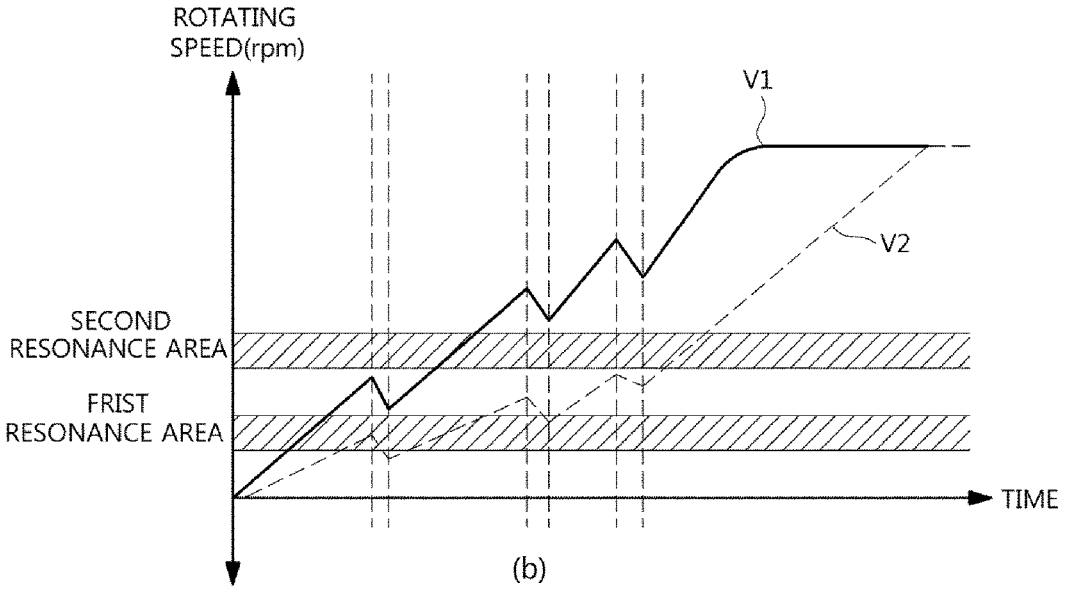

WASHING APPARATUS AND CONTROLLING METHOD THEREOF

CROSS-REFERENCE TO RELATED APPLICATIONS

This application claims the benefit of Korean Patent Application Nos. 10-2014-0020122 and 10-2014-0144021, filed on Feb. 21, 2014 and Oct. 23, 2014, respectively, in the Korean Intellectual Property Office, the disclosures of which are incorporated herein by reference.

BACKGROUND

1. Field

Embodiments of the present disclosure relate to a washing apparatus and a controlling method thereof, and more particularly, to a washing apparatus having an uncontrolled driving motor, and a controlling method thereof.

2. Description of the Related Art

In general, a washing apparatus is an apparatus which washes laundry using a frictional force between the laundry and water, and may be classified into a front load type washing apparatus and a top load type washing apparatus.

In the front load type washing apparatus, a washing operation is performed using a dropping of the laundry while a rotating tub accommodating the laundry is rotated. In the top load type washing apparatus, a pulsator which generates a water stream at a bottom of the rotating tub together with the rotating tub accommodating the laundry is provided, and a washing operation is performed using the water stream generated by the pulsator.

Also, in both of the front load type washing apparatus and the top load type washing apparatus, the laundry is spin-dried using a centrifugal force generated by rotation of the rotating tub.

As described above, the washing apparatus is operated using the rotation of the rotating tub or the pulsator. The washing apparatus widely uses a motor as a device providing a rotating force to the rotating tub or the pulsator.

The motor which is widely used in the washing apparatus may be classified into a controlled motor (a so-called servo-motor) which precisely controls a rotating speed of the motor, and an uncontrolled motor which does not control the rotating speed of the motor.

The controlled motor includes a speed sensor which detects the rotating speed of the motor, and a current sensor which detects a driving current of the motor, and precisely controls the driving current according to the detected rotating speed of the motor. Such a controlled motor may precisely control the rotating speed of the motor regardless of a load.

However, the uncontrolled motor controls the rotation of the motor through an on-time when power is supplied to the motor and an off-time when the power supply to the motor is cut. Such an uncontrolled motor has a relatively low price.

When the washing apparatus includes the uncontrolled motor, it is difficult to precisely control the rotating speed of the motor, and thus a resonance phenomenon may occur continuously during a spin-drying process. Here, the resonance phenomenon means a phenomenon in which a vibration frequency of the rotating tub coincides with a rotation frequency formed by the motor during the spin-drying process and thus the rotating tub is vibrated violently.

In the case of the washing apparatus using a conventional uncontrolled motor, since the rotation of the rotating tub is controlled through only the on-time and off-time of the motor, it is difficult to avoid the resonance phenomenon of the rotating tub.

SUMMARY

Therefore, it is an aspect of the present disclosure to provide a washing apparatus which minimizes a resonance phenomenon during a spin-drying process in the washing apparatus including an uncontrolled motor.

Additional aspects of the disclosure will be set forth in part in the description which follows and, in part, will be apparent from the description, or may be learned by practice of the disclosure.

In accordance with one aspect of the present disclosure, a washing apparatus includes an AC motor configured to generate a rotating force, a clutch unit configured to selectively transmit the rotating force to a rotating tub and a pulsator, a speed detector configured to detect a rotating speed of at least one of the AC motor and the clutch unit, and a controller configured to perform an intermittent spin-drying operation which repeats power supply and power cut-off to the AC motor according to the rotating speed in a spin-drying process.

The controller may cut off the power supply to the AC motor when the rotating speed is equal to or more than a maximum speed, and may supply power to the AC motor when the rotating speed is equal to or less than a minimum speed.

The maximum speed and the minimum speed may be faster than a resonance area within a rotating speed range of the rotating tub.

The maximum speed and the minimum speed may be between a first resonance area within a rotating speed range of the rotating tub and a second resonance area within the rotating speed range of the rotating tub.

In the spin-drying process, the controller may further perform a main spin-drying operation in which the power is continuously supplied to the AC motor for a predetermined spin-drying time.

In a washing process, the controller may cut off the power supply to the AC motor when the rotating speed is equal to or more a reference washing speed, and may supply power to the AC motor so that the AC motor is rotated in an opposite direction when a reference standby time passes.

In a washing process, the controller may cut off the power supply to the AC motor when the rotating speed is equal to or more a reference washing speed, and may supply power to the AC motor so that the AC motor is rotated in an opposite direction when the rotating speed is "0".

The washing apparatus may further include a pulley unit including a driving pulley coupled with a rotating shaft of the AC motor, a driven pulley coupled with a rotating shaft of the clutch unit, and a pulley belt configured to transmit a rotating force of the driving pulley to the driven pulley.

The speed detector may include a position indicating member rotated with the driven pulley, and a speed detecting sensor fixed to the clutch unit to detect the position indicating member.

The speed detector may include a position indicating member rotated with the driven pulley, and a speed detecting sensor fixed to a driving unit to detect the position indicating member.

In accordance with another aspect of the present disclosure, a controlling method of a washing apparatus, which includes an AC motor configured to generate a rotating force, and a clutch unit configured to selectively transmit the rotating force to a rotating tub and a pulsator, includes detecting a rotating speed of at least one of the AC motor and the clutch unit, and repeating power supply and power cut-off to the AC motor according to the rotating speed in a spin-drying process.

The repeating of the power supply and power cut-off to the AC motor may include cutting off the power supply to the AC motor when the rotating speed is equal to or more than a maximum speed, and supplying power to the AC motor when the rotating speed is equal to or less than a minimum speed.

The maximum speed and the minimum speed may be faster than a resonance area within a rotating speed range of the rotating tub.

The maximum speed and the minimum speed may be between a first resonance area within a rotating speed range of the rotating tub and a second resonance area within the rotating speed range of the rotating tub.

The repeating of the power supply and power cut-off to the AC motor may further include continuously supplying power to the AC motor for a predetermined spin-drying time.

The controlling method further include cutting off the power supply to the AC motor when the rotating speed is equal to or more a reference washing speed, and supplying power to the AC motor when a reference standby time passes, in a washing process.

In accordance with still another aspect of the present disclosure, a washing apparatus includes an AC motor configured to generate a rotating force, a clutch unit operated in a washing mode in which the rotating force is transmitted to a pulsator and a spin-drying mode in which the rotating force is transmitted to a rotating tub and the pulsator, a drain valve configured to open and close a drain pipe which discharges water accommodated in a water tub, and a controller configured to open the drain valve, close the drain valve when a water level of the water tub arrives at a reference water level, switch an operation mode of the clutch unit to the spin-drying mode, and operate the AC motor, wherein the reference water level is between a bottom surface of the rotating tub and a bottom surface of the water tub.

The washing apparatus further include a drain motor configured to drive the drain valve, and a mode switching motor configured to switch the operation mode of the clutch unit.

The washing apparatus further include a speed detector configured to detect a rotating speed of at least one of the AC motor and the clutch unit, and the controller may open the drain valve again when the rotating speed arrives at a water discharging speed.

The water discharging speed may be changed according to an amount of laundry accommodated in the rotating tub.

The water discharging speed may be the same as that of a resonance area within a rotating speed range of the rotating tub.

The water discharging speed may be the same as the maximum speed.

The water discharging speed may be less than that of a resonance area within a rotating speed range of the rotating tub.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 17 is a view illustrating a driving signal and a rotating speed by an intermittent spin-drying operation according to the prior art;

DETAILED DESCRIPTION

The description proposed herein is just a preferable example for the purpose of illustrations only, not intended to limit the scope of the disclosure, so it should be understood that other equivalents and modifications could be made thereto without departing from the spirit and scope of the disclosure.

Hereinafter, one embodiment of the present disclosure will be described in detail with reference to the accompanying drawings.

Figure 1:
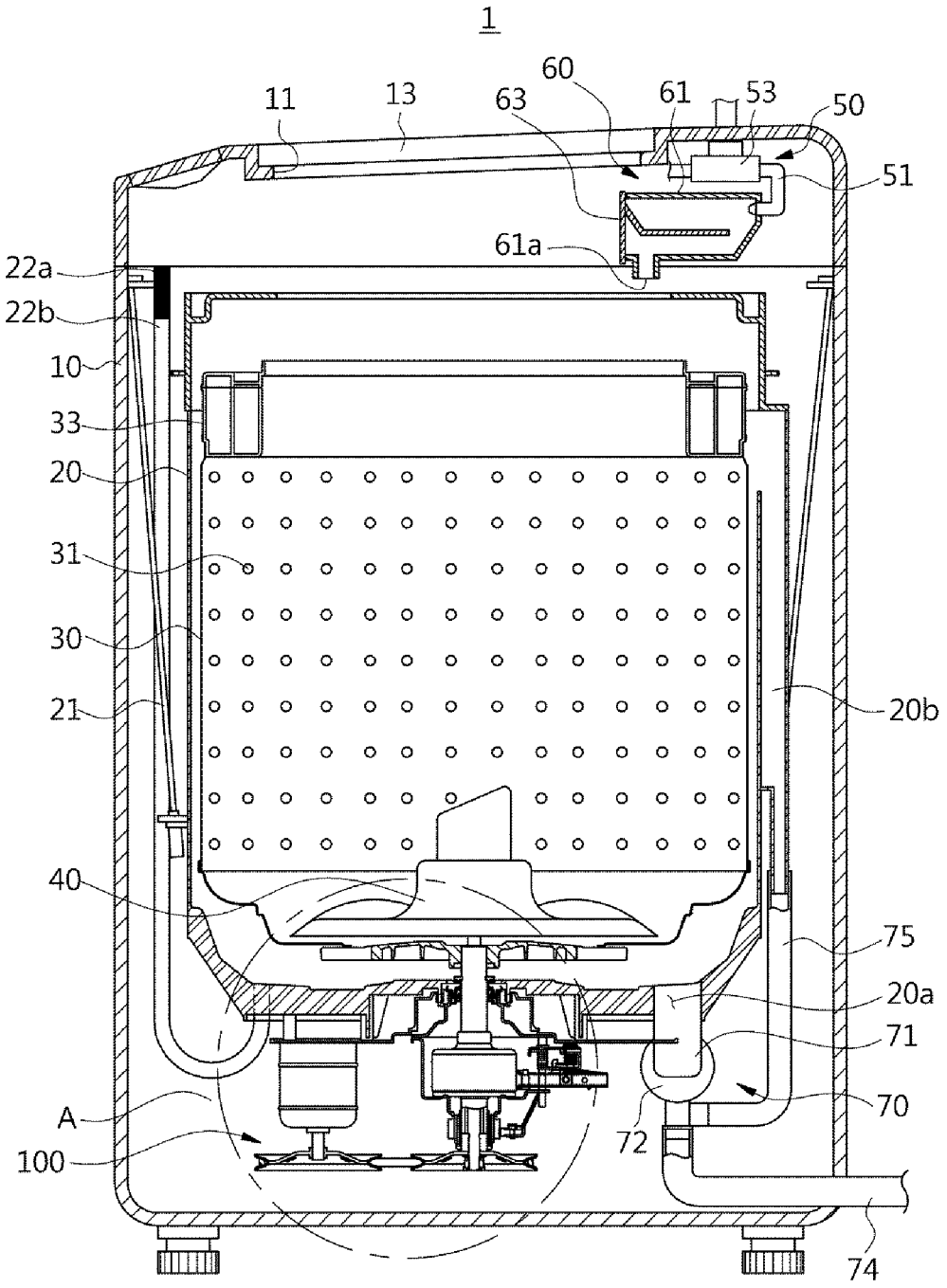
FIG. 1 is a side cross-sectional view of a washing apparatus according to one embodiment of the present disclosure.
Figure 2:
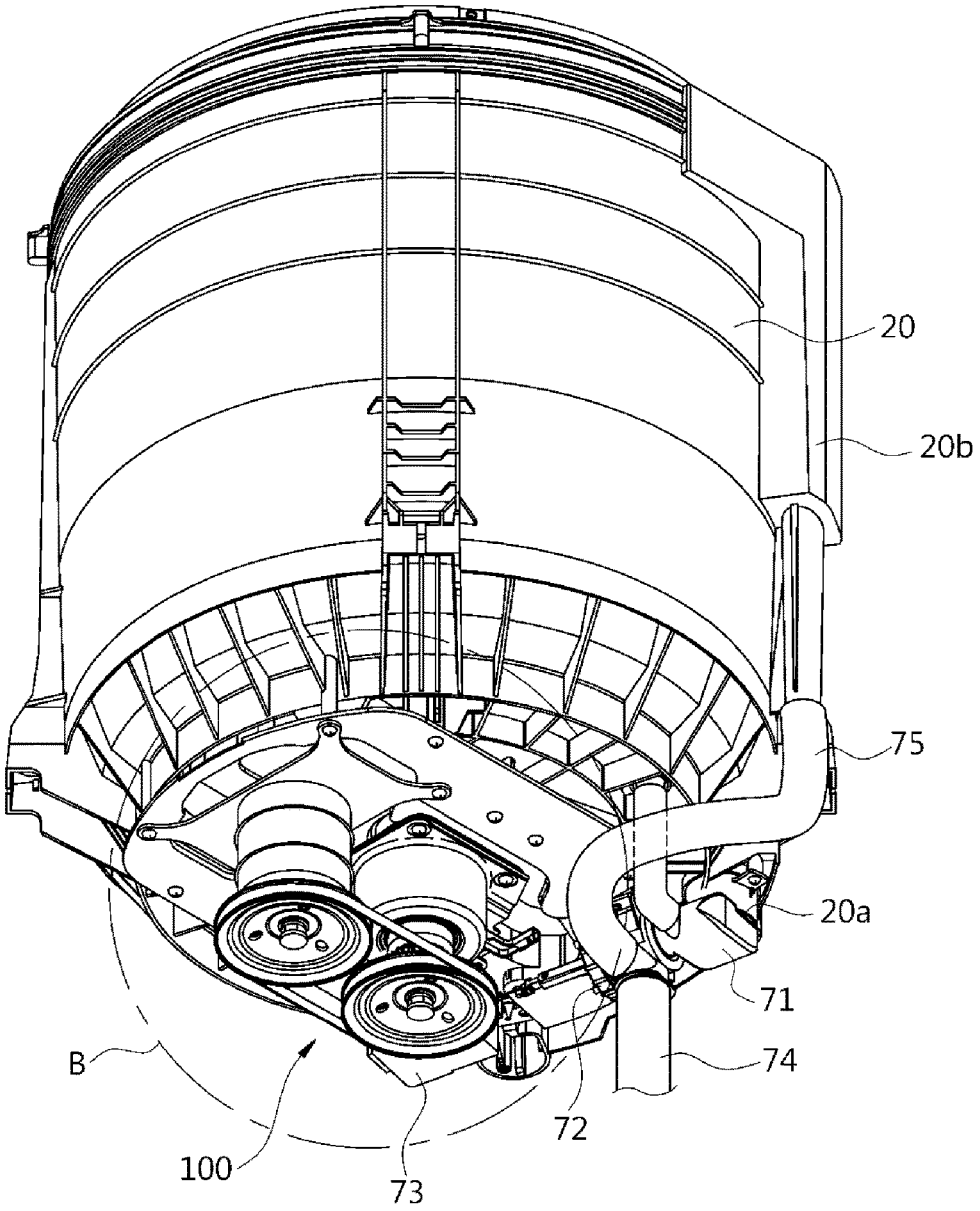
FIG. 2 is a view illustrating a lower portion of the washing apparatus according to one embodiment of the present disclosure.

FIG. 1 is a side cross-sectional view of a washing apparatus according to one embodiment of the present disclosure, and FIG. 2 is a view illustrating a bottom surface of the washing apparatus according to one embodiment of the present disclosure.

Referring to FIGS. 1 and 2, the washing apparatus 1 includes a cabinet 10 which forms an exterior, a water tub 20 which accommodates water, a rotating tub 30 which is rotatably disposed in the water tub 20, a pulsator 40 which generates a water stream in the rotating tub 30, a water supplier 50 which supplies water into the water tub 20, a detergent supplier 60 which supplies a detergent into the rotating tub 30, a drain part 70 which drains the water accommodated in the water tub 20, and a rotational driving part 100 which selectively rotates the rotating tub 30 and the pulsator 40.

An entrance 11 through which laundry is put into the rotating tub 30 is formed at an upper portion of the cabinet 10. The entrance 11 is opened and closed by a door 13 installed at the upper portion of the cabinet 10.

The water tub 20 may be formed in a cylindrical shape of which an upper portion is opened so as to put the laundry therein.

A drain hole 20*a* which drains the water accommodated in the water tub 20 is provided at a bottom surface of the water tub 20, and an overflow pipe 20*b* which drains the water accommodated over a predetermined water level is provided at a side surface of the water tub 20.

Further, the water tub 20 is supported while suspended in the cabinet 10 by a damper 21. The damper 21 serves to damp down vibration generated at the water tub 20 when the rotating tub 30 or the pulsator 40 is rotated, and is provided between an outer surface of the water tub 20 and an inner surface of the cabinet 10.

Further, a pressure sensor 22*a* and a water level detecting pipe 22*b* which determine a water level of the water accommodated in the water tub 20 may be installed adjacent to the water tub 20. The water level detecting pipe 22*b* extends from a bottom surface of the water tub 20 to an upper portion thereof, and the pressure sensor 22*a* is installed at one end of the water level detecting pipe 22*b*.

The water level detecting pipe 22*b* accommodates the water having the same water level as that in the water tub 20, and a pressure in the water level detecting pipe 22*b* is changed according to the water level of the water level detecting pipe 22*b*. Specifically, when the water level of the water level detecting pipe 22*b* is high, the pressure in the water level detecting pipe 22*b* is increased, and when the water level of the water level detecting pipe 22*b* is low, the pressure in the water level detecting pipe 22*b* is reduced.

The pressure sensor 22*a* detects the pressure in the water level detecting pipe 22*b*, which is changed according to the water level of the water level detecting pipe 22*b*, and outputs an electrical signal corresponding to the detected pressure. Since the water level of the water level detecting pipe 22*b* is the same as that of the water tub 20, the pressure sensor 22*a* outputs the electrical signal corresponding to the water level of the water tub 20.

The rotating tub 30 may be formed in a cylindrical shape of which an upper portion is opened so as to put the laundry therein, and is rotatably disposed in the water tub 20.

The rotating tub 30 accommodates the laundry and the water therein, and a plurality of spin-drying holes 31 are formed at a side surface of the rotating tub 30 so that an internal space of the rotating tub 30 and an internal space of the water tub 20 are in communication with each other.

Further, a balancer 33 which offsets an unbalanced load generated at the rotating tub 30 during rotation of the rotating tub 30 is installed at an upper portion of the rotating tub 30 to allow the rotating tub 30 to be stably rotated.

The pulsator 40 may be provided at an inner side of a bottom surface of the rotating tub 30 to be rotated in a normal or reverse direction and thus to generate the water stream. The laundry in the rotating tub 30 is stirred along with the water due to the water stream generated by the pulsator 40, and a washing operation is performed by friction between the laundry and the water.

The water supplier 50 is provided above the water tub 20 to supply the water into the water tub 20 from an external water source (not shown).

The water supplier 50 includes a water supplying pipe 51 which guides the water from the external water source (not shown) to the water tub 20, and a water supplying valve 53 which is disposed on the water supplying pipe 51 to open and close the water supplying pipe 51.

In particular, one end of the water supplying pipe 51 is connected with the detergent supplier 60, and thus the water guided by the water supplying pipe 51 is supplied into the water tub 20 via the detergent supplier 60.

The detergent supplier 60 includes a detergent container 63 which accommodates the detergent, and a detergent container case 61 which accommodates the detergent container 63.

The detergent container case 61 is provided to be fixed to the cabinet 10, and connected with one end of the water supplying pipe 51. Also, a discharging hole 61*a* which discharges the water passing through the detergent supplier 60 to the water tub 20 is provided at a bottom surface of the detergent container case 61.

The detergent container 63 is provided to correspond to the water supplying pipe 51, such that the water supplied through the water supplying pipe 51 is mixed with the detergent accommodated in the detergent container 63.

Further, the detergent container 63 is removably installed at the detergent container case 61, and a user may pull out the detergent container 63 from the detergent container case 61 and then may put the detergent into the detergent container 63.

As described above, the water supplied by the water supplier 50 is mixed with the detergent accommodated in the detergent container 63, while passing through the detergent container 63, and the water mixed with the detergent is supplied into the water tub 20 through the discharging hole 61*a* formed at the bottom surface of the detergent container case 61.

The drain part 70 may be provided at a lower side of the water tub 20 to discharge the water accommodated in the water tub 20 to an outside of the cabinet 10.

The drain part 70 includes a first drain pipe 71 which guides the water accommodated in the water tub 20 to an outside of the water tub 20, a drain valve 72 which opens and closes the first drain pipe 71, a drain motor 73 which drives the drain valve 72, a second drain pipe 74 which guides the water passing through the drain valve 72 to the outside of the cabinet 10, and a third drain pipe 75 which guides the water overflowing over the predetermined water level to the second drain pipe 74.

One end of the first drain pipe 71 is connected with the drain hole 20*a* provided at the bottom surface of the water tub 20, and the other end thereof is connected with the drain valve 72.

The drain valve 72 is provided at one end of the first drain pipe 71 to open and close the first drain pipe 71. Specifically, when the drain valve 72 is opened, the water of the water tub 20 may be discharged to the outside through the first drain pipe 71.

The opening and closing of the drain valve 72 may be performed by receiving a driving force from the drain motor 73 through a link wire.

The drain motor 73 drives the opening and closing of the drain valve 72 through the link wire. For example, when the drain motor 73 is operated, the drain valve 72 is opened, and the water of the water tub 20 is drained, and when the drain motor 73 is not operated, the drain valve 72 may be closed.

One end of the second drain pipe 74 is connected with the drain valve 72, and the other end thereof extends to the outside of the cabinet 10 and guides the water discharged through the first and third drain pipes 71 and 75 to the outside of the cabinet 10.

The third drain pipe 75 serves to connect the overflow pipe 20*b* provided at the side surface of the water tub 20 with the second drain pipe 74.

The rotational driving part 100 is provided under the water tub 20 to selectively provide a rotating force to the rotating tub 30 or the pulsator 40. Specifically, the rotational driving part 100 provides the rotating force in the normal or reverse direction to the pulsator 40 during a washing process and a rinsing process, and provides the rotating force in the reverse direction to the rotating tub 30 and the pulsator 40 during a spin-drying process.

The rotational driving part 100 will be described below.

Figure 3:
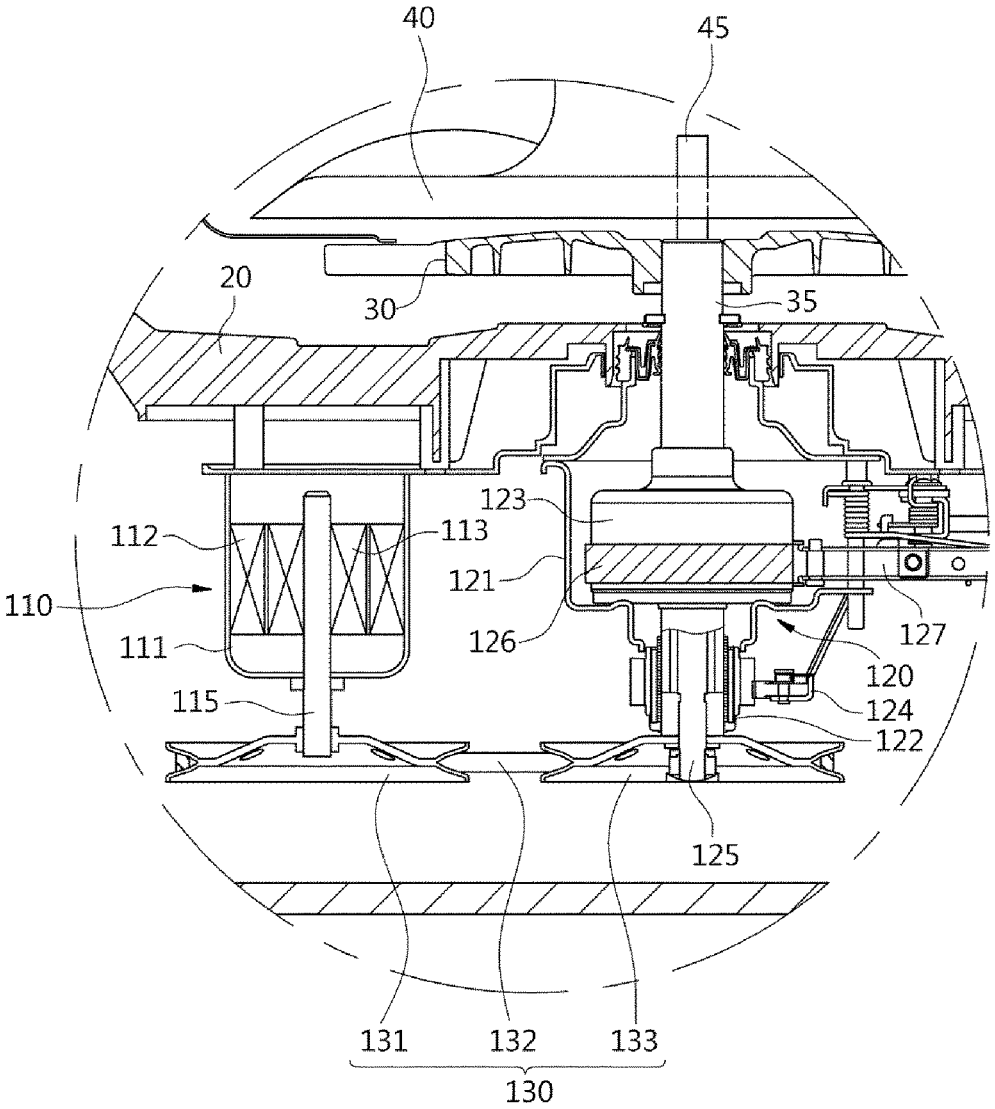
FIG. 3 is an enlarged view of a portion A of FIG. 1.
Figure 4:
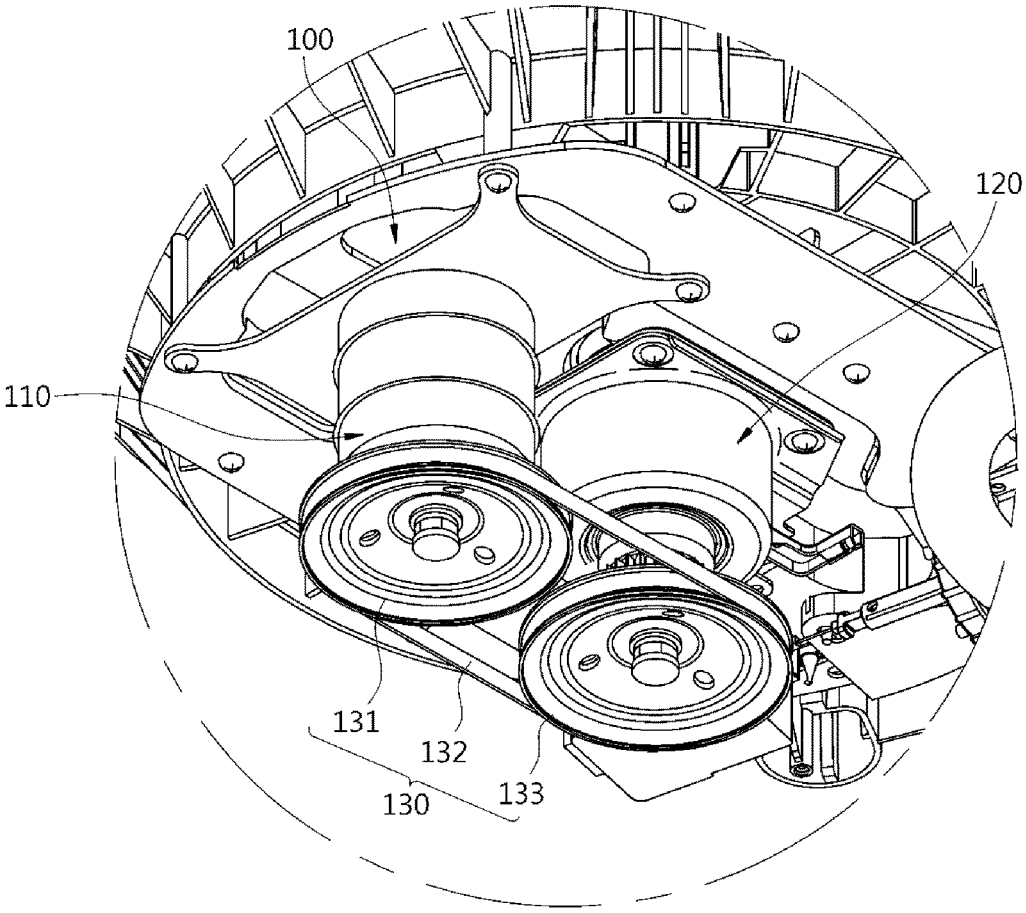
FIG. 4 is an enlarged view of a portion B of FIG. 2.
Figure 5:
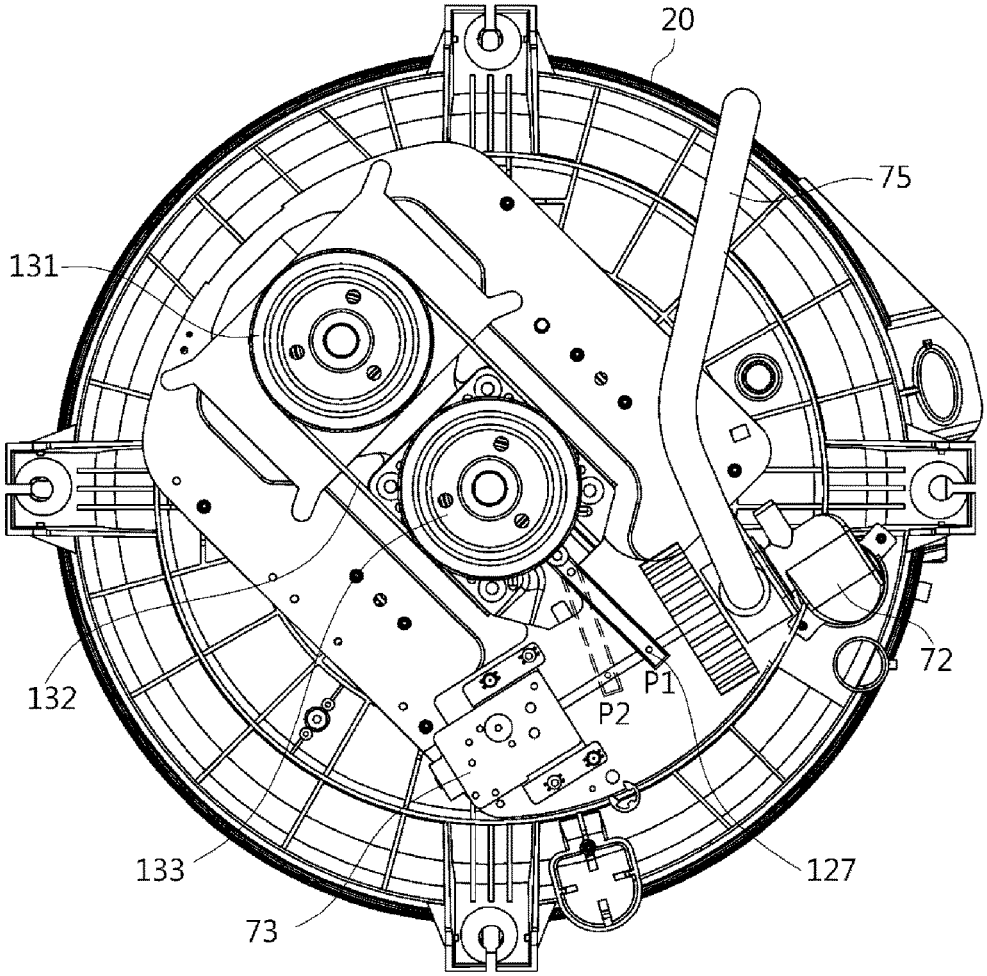
FIG. 5 is a view illustrating a bottom surface of a water tub included in the washing apparatus according to one embodiment of the present disclosure.
Figure 6:
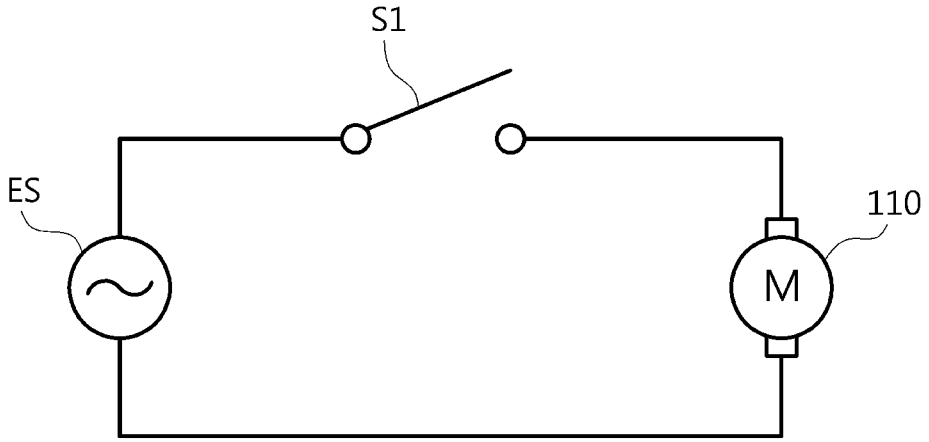
FIG. 6 is a view illustrating a driving circuit of a driving motor included in the washing apparatus according to one embodiment of the present disclosure.
Figure 7:
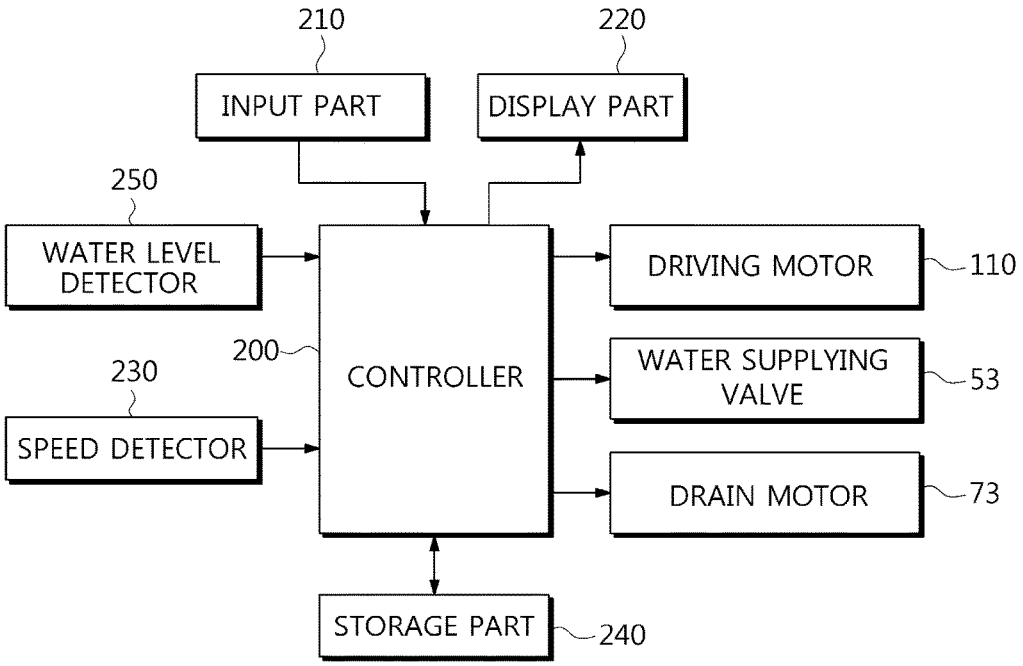
FIG. 7 is a view illustrating a control structure of the washing apparatus according to one embodiment of the present disclosure.

FIG. 3 is an enlarged view of a portion A of FIG. 1, FIG. 4 is an enlarged view of a portion B of FIG. 2, FIG. 5 is a view illustrating the bottom surface of the water tub included in the washing apparatus according to one embodiment of the present disclosure, FIG. 6 is a view illustrating a driving circuit of a driving motor included in the washing apparatus according to one embodiment of the present disclosure, and FIG. 7 is a view illustrating a control structure of the washing apparatus according to one embodiment of the present disclosure;

Referring to FIGS. 3 to 7, the rotational driving part 100 includes a driving motor 110 which generates the rotating force, a clutch unit 120 which selectively provides the rotating force received from the driving motor 110 to the rotating tub 30 and the pulsator 40, and a pulley unit 130 which transmits the rotating force generated by the driving motor 110 to the clutch unit 120.

The driving motor 110 includes a motor casing 111 which forms an exterior of the driving motor 110, a stator 112 which generates a rotating magnetic field, a rotor 113 which is rotated by the rotating magnetic field, and a motor rotating shaft 115 which is coupled with the rotor 113 to be rotated with the rotor 113. The driving motor 110 generates the rotating force which rotates the rotating tub 30 and the pulsator 40.

The stator 112 is fixed to an inner side of the motor casing 111 and may have a cylindrical shape having a hollow portion. Further, the stator 112 includes a coil which generates the rotating magnetic field when a current is applied, and the coil is disposed along an inner circumferential surface of the stator 112.

The rotor 113 is rotatably provided in the stator 112, and rotated by an interaction with the rotating magnetic field generated by the stator 112.

The motor rotating shaft 115 is coupled with the rotor 113 to be rotated with the rotor 113 and thus to transmit a rotating force of the rotor 113 to the pulley unit 130 to be described later.

An induction motor (IM), in which an induced current is generated at the rotor 113 due to the rotating magnetic field generated by the stator 112, and the rotor 113 is rotated by an interaction between a magnetic field formed due to the induced current and the rotating magnetic field generated by the stator 112, may be used as the driving motor 110.

However, the driving motor 110 included in the washing apparatus 1 according to one embodiment of the present disclosure is not limited to the induction motor. For example, a synchronous motor (SM) in which the rotor 113 includes a permanent magnet generating a magnetic field may be used as the driving motor 110. However, it is assumed that the driving motor 110 included in the washing apparatus 1 according to one embodiment of the present disclosure uses the induction motor.

Also, the washing apparatus 1 does not include a separate speed control circuit which controls a rotating speed of the driving motor 110. In other words, as illustrated in FIG. 6, the washing apparatus 1 may include a driving switch 51 which directly supplies an external power source ES to the driving motor 110 and turns on or off the driving motor 110.

Specifically, when the driving switch 51 is switched on, the power source is supplied to the driving motor 110, and thus the driving motor 110 is operated, and when the driving switch 51 is switched off, the power supply to the driving motor 110 is cut, and thus the driving motor 110 is stopped. In other words, the washing apparatus 1 may control an operation and an operation stop of the driving motor 110, but does not control the rotating speed of the driving motor 110.

The clutch unit 120 includes a clutch housing 121, a switch gear 122, a reduction gear 123, a clutch lever 124, a brake belt 126 and a clutch lever 127. Such a clutch unit 120 may be operated in a washing mode in which the driving force of the driving motor 110 is transmitted to the pulsator 40, and a spin-drying mode in which the rotating force is transmitted to the rotating tub 30 and the pulsator 40.

The clutch housing 121 forms an exterior of the clutch unit 120, and accommodates the switch gear 122 and the reduction gear 123 therein.

A clutch rotating shaft 125 receives the rotating force of the driving motor 110 from the pulley unit 130, and transmits the received rotating force to the switch gear 122.

The switch gear 122 selectively transmits a rotating force of the clutch rotating shaft 125 to a rotating tub rotating shaft 35 connected with the rotating tub 30 and a pulsator rotating shaft 45 connected with the pulsator 40 according to an operation of the washing apparatus 1.

Specifically, according to an operation of the clutch lever 124, the switch gear 122 may transmit a rotating force of the clutch rotating shaft 125 to the pulsator rotating shaft 45 or may transmit the rotating force of the clutch rotating shaft 125 to both of the pulsator rotating shaft 45 and the rotating tub rotating shaft 35.

The clutch lever 124 is connected with the drain motor 73 to control an operation of the switch gear 122 according to an operation of the drain motor 73.

As illustrated in FIG. 5, the clutch lever 124 may be located at a first position P1 or a second position P2 according to the operation of the drain motor 73. Specifically, when the drain motor 73 is operated, the clutch lever 124 is located at the second position P2, and when the drain motor 73 is not operated, the clutch lever 124 is located at the first position P1.

Further, the clutch lever 124 may control the operation of the switch gear 122 according to its positions P1 and P2.

Specifically, when the clutch lever 124 is located at the first position P1, the switch gear 122 may transmit the rotating force of the clutch rotating shaft 125 to the pulsator rotating shaft 45. Also, when the clutch lever 124 is located at the second position P2, the switch gear 122 may transmit the rotating force of the clutch rotating shaft 125 to both of the pulsator rotating shaft 45 and the rotating tub rotating shaft 35.

Eventually, when the drain motor 73 is operated, only the pulsator 40 is rotated, and when the drain motor 73 is not operated, the pulsator 40 and the rotating tub 30 may be rotated together.

The reduction gear 123 may reduce the rotating force of the clutch rotating shaft 125 in the washing mode and then may provide the reduced rotating force to the pulsator rotating shaft 45, and also may provide the rotating force of the clutch rotating shaft 125 to the pulsator rotating shaft 45, as it is, in the spin-drying mode.

Specifically, when the rotating tub rotating shaft 35 is fixed, the reduction gear 123 reduces the rotating force of the clutch rotating shaft 125 and then provides the reduced rotating force to the pulsator rotating shaft 45, and when the rotating tub rotating shaft 35 is rotated with the pulsator rotating shaft 45, the reduction gear 123 provides the rotating force of the clutch rotating shaft 125, as it is, to the pulsator rotating shaft 45 and the rotating tub rotating shaft 35.

According to the operation of the clutch lever 127, the brake belt 126 serves to fix the rotating tub rotating shaft 35 so that the rotating tub rotating shaft 35 may not be rotated, or to release the rotating tub rotating shaft 35 so that the rotating tub rotating shaft 35 may be rotated.

Also, as described above, the clutch lever 127 is connected with the drain motor 73 to operate the brake belt 126 according to the operation of the drain motor 73.

When the clutch lever 127 is located at the first position P1, the brake belt 126 fixes the rotating tub rotating shaft 35, and when the clutch lever 127 is located at the second position P2, the brake belt 126 releases the rotating tub rotating shaft 35. Also, as described above, when the drain motor 73 is not operated, the clutch lever 124 is located at the first position P1, and when the drain motor 73 is operated, the clutch lever 124 is located at the second position P2.

Therefore, when the drain motor 73 is not operated, the brake belt 126 fixes the rotating tub rotating shaft 35, and when the drain motor 73 is operated, the brake belt 126 releases the rotating tub rotating shaft 35.

Eventually, when the drain motor 73 is not operated, only the pulsator 40 may be rotated, and when the drain motor 73 is operated, the pulsator 40 and the rotating tub 30 may be rotated together.

Like this, an operating mode of the clutch unit 120 is switched according to whether the drain motor 73 is operated. In other words, when the drain motor 73 is operated, the clutch unit 120 is operated in the spin-drying mode, and when the drain motor 73 is not operated, the clutch unit 120 is operated in the washing mode.

Also, the operating mode of the clutch unit 120 is switched according to a draining operation. Specifically, when the draining operation is performed, the clutch unit 120 is operated in the spin-drying mode, and when the draining operation is not performed, the clutch unit 120 is operated in the washing mode.

The pulley unit 130 includes a driving pulley 131 which is coupled with the motor rotating shaft 115 of the driving motor 110, a driven pulley 133 which is coupled with the clutch rotating shaft 125 of the clutch unit 120, and a pulley belt 132 which transmits a rotating force of the driving pulley 131 to the driven pulley 133.

In the brief description of a process of transmitting the rotating force, the driving motor 110 generates the rotating force using alternating current (AC) power supplied from an external power source, and the generated rotating force is transmitted to the pulley unit 130. Also, the pulley unit 130 transmits the rotating force received from the driving motor 110 to the clutch unit 120 through the pulley belt 132.

Like this, since the rotating force generated by the driving motor 110 is transmitted to the clutch unit 120 through the pulley unit 130, a rotating speed of the driving motor 110 and a rotating speed of the clutch unit may be different from each other.

For example, when a diameter of the driving pulley 131 connected with the driving motor 110 is smaller than that of the driven pulley 133 connected with the clutch unit 120, the rotating force of the driving motor 110 is reduced by the pulley unit 130 and then transmitted to the clutch unit 120.

As described above, the clutch unit 120 selectively transmits the rotating force received from the pulley unit 130 to the rotating tub 30 and the pulsator 40. Specifically, the clutch unit 120 reduces and transmits the rotating force received from the pulley unit 130 to the pulsator 40 in the washing process or the rinsing process, and transmits the rotating force received from the pulley unit 130 to the rotating tub 30 and the pulsator 40, as it is, in the spin-drying process.

FIG. 7 is a view illustrating a control structure of the washing apparatus according to one embodiment of the present disclosure.

Referring to FIG. 7, the washing apparatus 1 includes an input part 210 which receives a user's control instruction, a display part 220 which displays operation information of the washing apparatus 1, a speed detector 230 which detects a rotating speed of the driving motor 110 or the clutch unit 120, a water level detector 250 which detects the water level of the water accommodated in the water tub 20, a storage part 240 which stores a program and data related to the operation of the washing apparatus 1, and a controller 200 which generally controls the operation of the washing apparatus 1, along with the driving motor 110, the water supplying valve 53, and the drain motor 73 which have been described above.

The input part 210 may include a plurality of operating buttons which receive the control instruction with respect to the washing apparatus 1, and a dial which receives a setup for the washing operation.

For example, the washing apparatus 1 may receive a washing course from the user through the dial and may receive the additional setup for the washing operation, such as a washing temperature, the number of rinsing operations and an intensity of the spin-drying operation, through the operating buttons.

The operating buttons may be micro-switches, membrane switches, touch pads or the like.

The display part 220 may include a display which visually indicates operation information of the washing apparatus 1 corresponding to the user's instruction to the user.

For example, before the washing operation, the washing apparatus 1 may display the washing course selected by the user, and the additional setup, such as the washing temperature, the number of rinsing operations and the intensity of the spin-drying operation, input by the user, and an estimated washing time estimated until the washing operation is completed, through the display. Further, during the washing operation, the washing apparatus 1 may display process information (e.g., the washing process, the rinsing process or the spin-drying process is being performed) and a remaining washing time remaining until the washing operation is completed, through the display.

Such a display panel (not shown) may be a liquid crystal display (LCD) panel, a light emitting diode (LED) panel, an organic light emitting diode (OLED) panel, or the like.

Further, the input part 210 and the display part 220 are not always provided separately from each other.

For example, the washing apparatus 1 may include a touch screen panel in which a touch panel detecting coordinates touched by the user and the display panel displaying a visual image are integrally provided.

The touch screen panel displays the control instructions, which may be selected by the user, through the display panel. When the user selects and touches one of the control instructions displayed on the display panel, the touch screen panel detects the coordinates touched through the touch panel by the user, compares the detected coordinates with coordinates of each control instruction, and thus recognizes the input control instruction.

The speed detector 230 detects the rotating speed of the driving motor 110 or the clutch unit 120.

The speed detector 230 will be described later in detail.

The water level detector 250 detects the water level of the water accommodated in the water tub 20. Specifically, the water level detector 250 may include the water level detecting pipe 22*b* and the pressure sensor 22*a* which have been described above, and may output an electrical signal corresponding to the water level of the water accommodated in the water tub 20.

The storage part 240 may include a non-volatile memory (not shown), such as a magnetic disc and a solid state disk, which stores a control program and control data controlling the operation of the washing apparatus 1, and a volatile memory (not shown), such as a D-RAM and an S-RAM, which temporarily stores temporary data generated while the operation of the washing apparatus 1 is controlled.

The controller 200 controls the operation of the washing apparatus 1 according to the user's control instruction input through the input part 210 and the program and the data stored in the storage part 240.

During the washing process, the controller 200 may control each element included in the washing apparatus 1 to perform a water supplying operation, a washing operation and an interim spin-drying operation.

Specifically, the controller 200 opens the water supplying valve 53 to supply the water into the water tub 20 during the water supplying operation, and operates the driving motor 110 to rotate the pulsator 40 during the washing operation.

Also, during the interim spin-drying operation, the controller 200 operates the drain motor 73 to drain the water in the water tub 20, and also operates the driving motor 110 to rotate the rotating tub 30 and the pulsator 40. (As described above, when the drain motor 73 is operated, the clutch unit 120 transmits the rotating force of the driving motor 110 to both of the rotating tub 30 and the pulsator 40.)

Then, during the rinsing process, the controller 200 may control each element included in the washing apparatus 1 to perform a water supplying operation of rinsing, a rinsing operation and an interim spin-drying operation.

Then, during the spin-drying process, the controller 200 may control each element included in the washing apparatus 1 to operate the driving motor 110 while the drain motor 73 is operated and thus to perform the spin-drying operation in which both of the rotating tub 30 and the pulsator 40 are rotated.

Also, various operations of the washing apparatus 1 to be described below may be interpreted to be performed by control operations of the controller 200.

Figure 8:
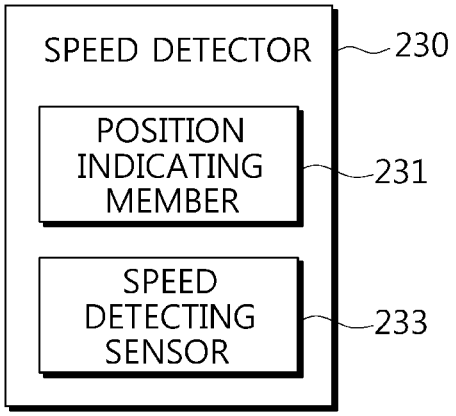
FIG. 8 is a view illustrating a structure of a speed detector included in the washing apparatus according to one embodiment of the present disclosure.

FIG. 8 is a view illustrating a structure of the speed detector included in the washing apparatus according to one embodiment of the present disclosure, and FIGS. 9 to 13 are views illustrating an example of an arrangement of the speed detector included in the washing apparatus according to one embodiment of the present disclosure.

Referring to FIGS. 8 to 13, the speed detector 230 includes a position indicating member 231 which indicates rotation of the driving motor 110 or the clutch unit 120, and a speed detecting sensor 233 which detects the position indicating member 231.

The position indicating member 231 may be located at a rotating structure such as the motor rotating shaft 115 or the clutch rotating shaft 125, and the speed detecting sensor 233 may be located at a fixed structure such as the motor casing 111 or the clutch housing 121.

Figure 9:
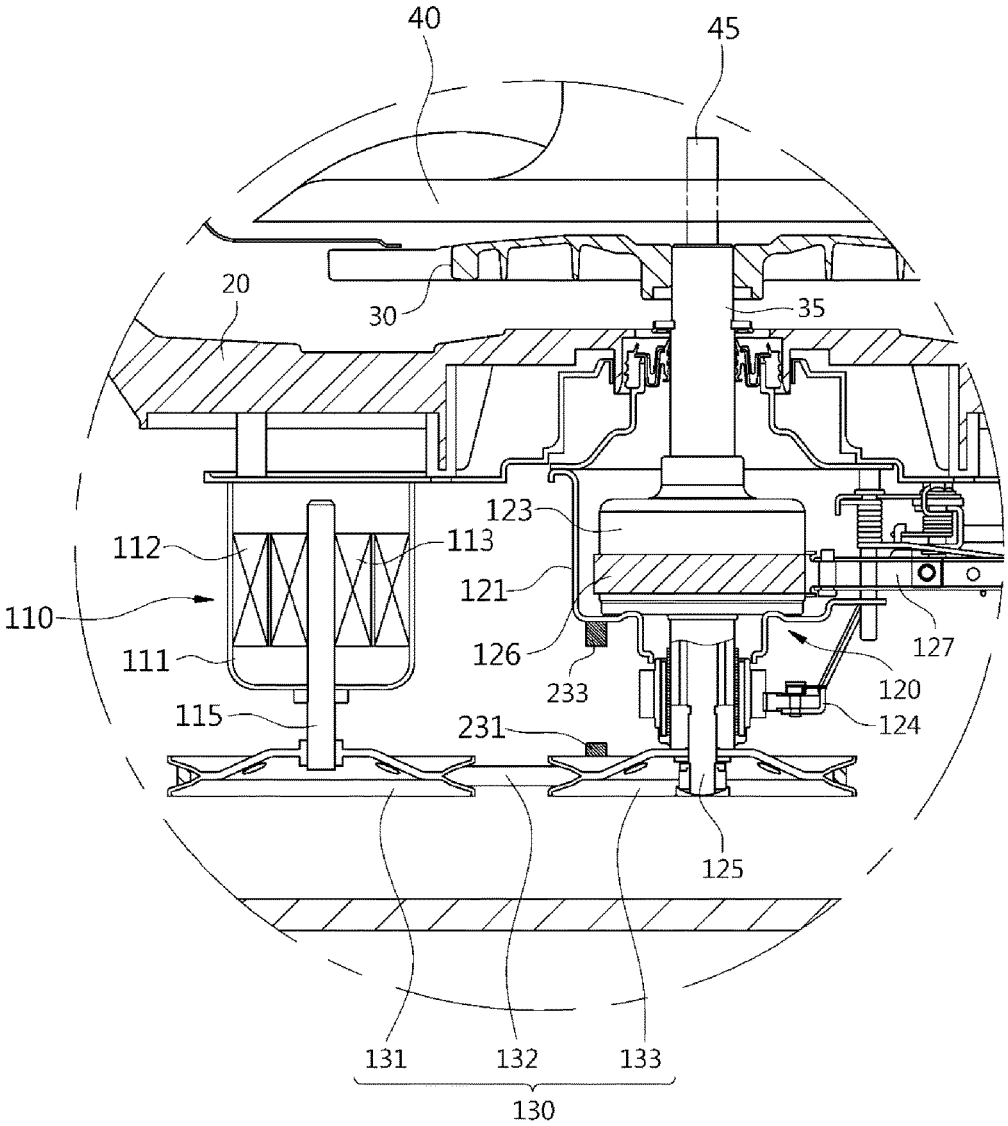
FIGS. 9 to 13 are views illustrating an example of an arrangement of the speed detector included in the washing apparatus according to one embodiment of the present disclosure.

For example, as illustrated in FIG. 9, the position indicating member 231 may be provided at the driven pulley 133 coupled with the clutch rotating shaft 125, and the speed detecting sensor 233 may be provided at a lower portion of the clutch housing 121.

In this case, the position indicating member 231 may be rotated along with the driven pulley 133 about the clutch rotating shaft 125, and the speed detecting sensor 233 may periodically detect the position indicating member 231 while the position indicating member 231 is rotated.

Also, the speed detector 230 may calculate the rotating speed of the clutch rotating shaft 125 using the number of the position indicating members 231 detected by the speed detecting sensor 233 for a period or a predetermined reference period of time while the speed detecting sensor 233 detects the position indicating member 231.

Further, the washing apparatus 1 may calculate the rotating speed of the rotating tub 30 or the pulsator 40 based on the rotating speed of the clutch rotating shaft 125 detected by the speed detector 230.

Furthermore, according to the embodiment, when two or more position indicating members 231 are provided in a circumferential direction of the driven pulley 133, the speed detector 230 may determine a rotating direction of the clutch rotating shaft 125 as well as the rotating speed of the clutch rotating shaft 125.

Figure 10:
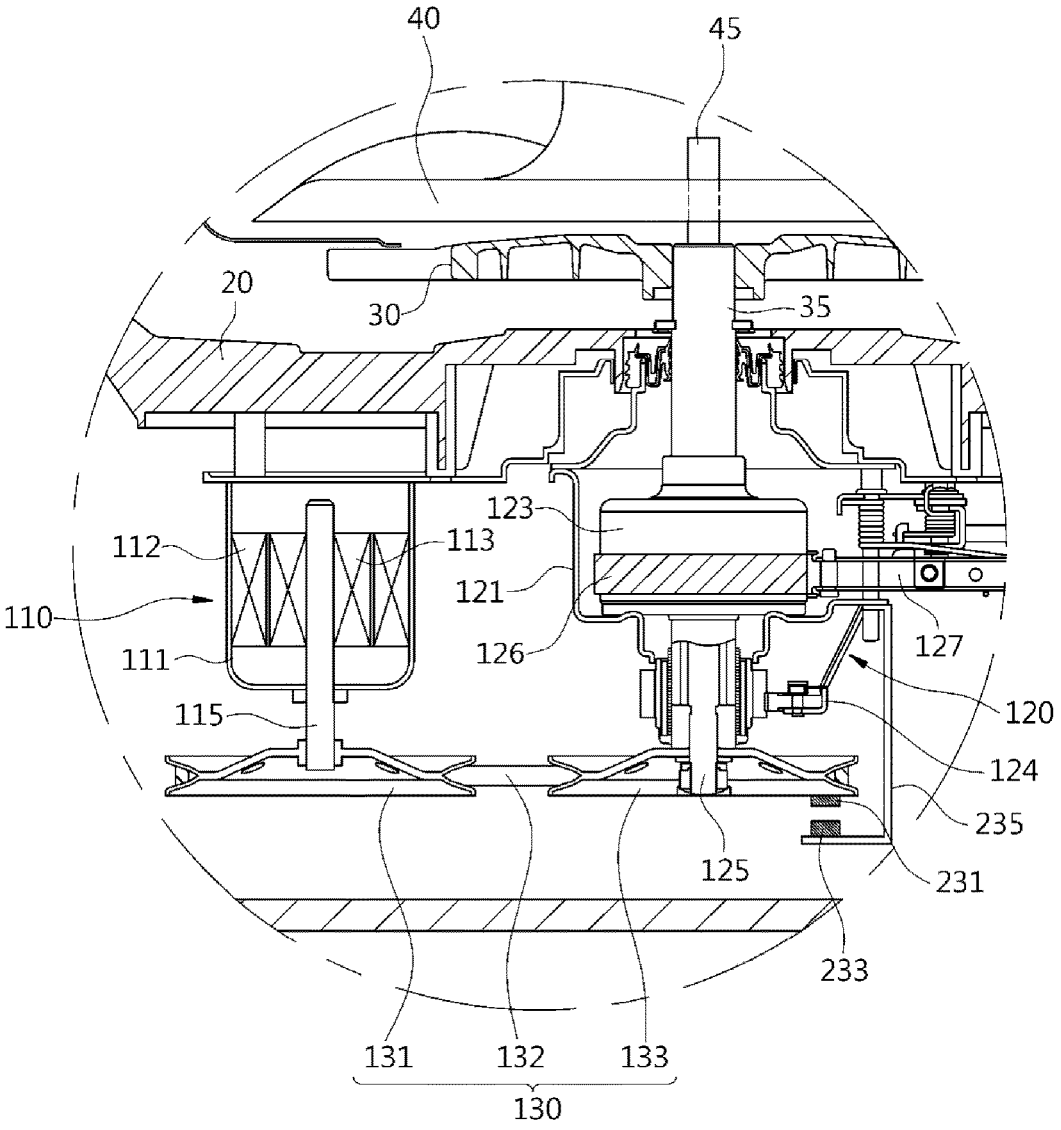

According to the embodiment, as illustrated in FIG. 10, the speed detector 230 may further include a supporting member 235 which supports the speed detecting sensor 233 so that the speed detecting sensor 233 is located more adjacent to the position indicating member 231.

Specifically, the supporting member 235 may be provided to extend from the lower portion of the clutch housing 121 toward the driven pulley 133, such that the speed detecting sensor 233 is located adjacent to the position indicating member 231.

Figure 11:
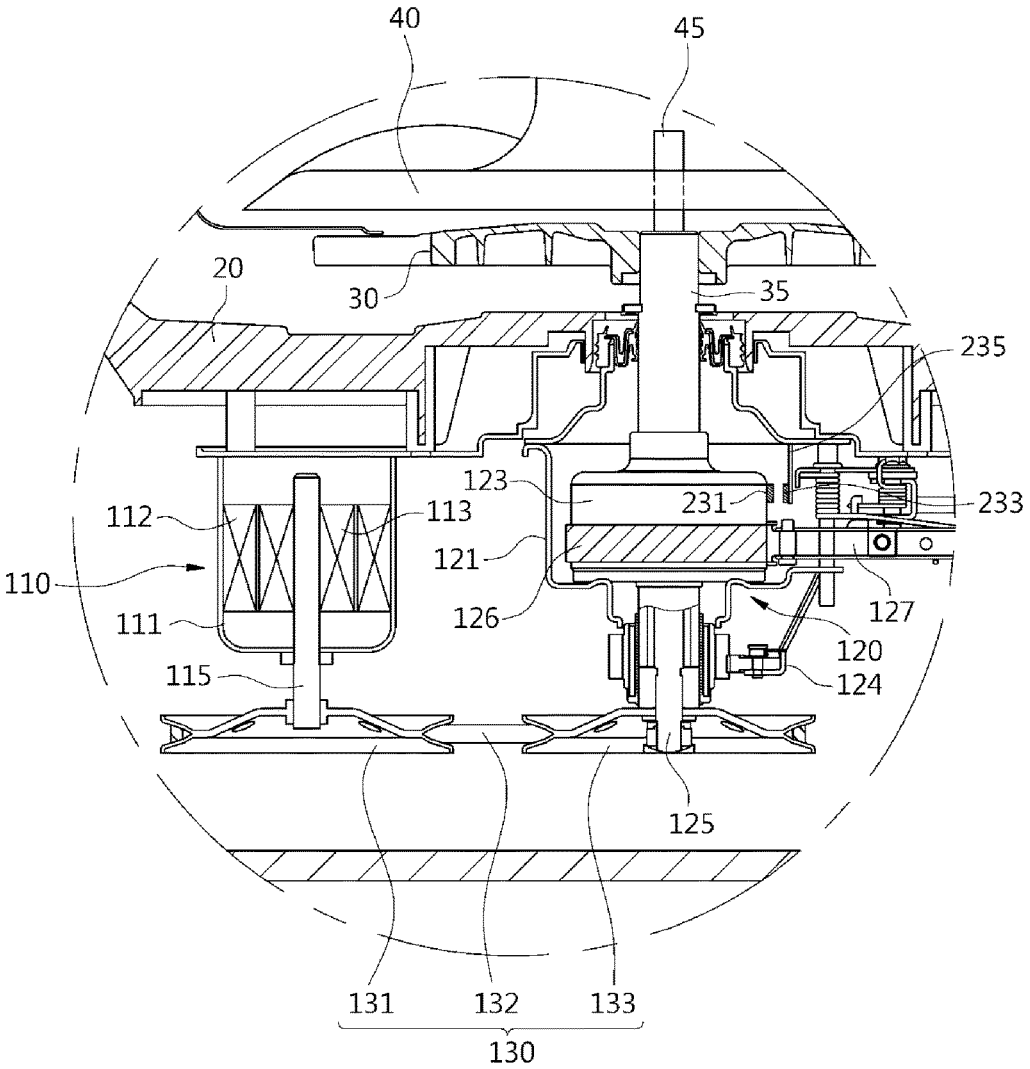

As another example, as illustrated in FIG. 11, the position indicating member 231 may be provided at an outer surface of the reduction gear 123 included in the clutch unit 120, and the speed detecting sensor 233 may be provided at one side of the clutch housing 121.

In this case, the position indicating member 231 may be rotated with the reduction gear 123, and the speed detecting sensor 233 may periodically detect the position indicating member 231.

Further, the speed detector 230 may calculate the rotating speed of the clutch rotating shaft 125 using the number of the position indicating members 231 detected by the speed detecting sensor 233 for a period or a predetermined reference period of time while the speed detecting sensor 233 detects the position indicating member 231.

Further, the washing apparatus 1 may calculate the rotating speed of the rotating tub 30 or the pulsator 40 based on the rotating speed of the clutch rotating shaft 125 detected by the speed detector 230.

Furthermore, according to the embodiment, when two or more position indicating members 231 are provided in a circumferential direction of the outer surface of the reduction gear 123, the speed detector 230 may determine a rotating direction of the clutch rotating shaft 125 as well as the rotating speed of the clutch rotating shaft 125.

Figure 12:
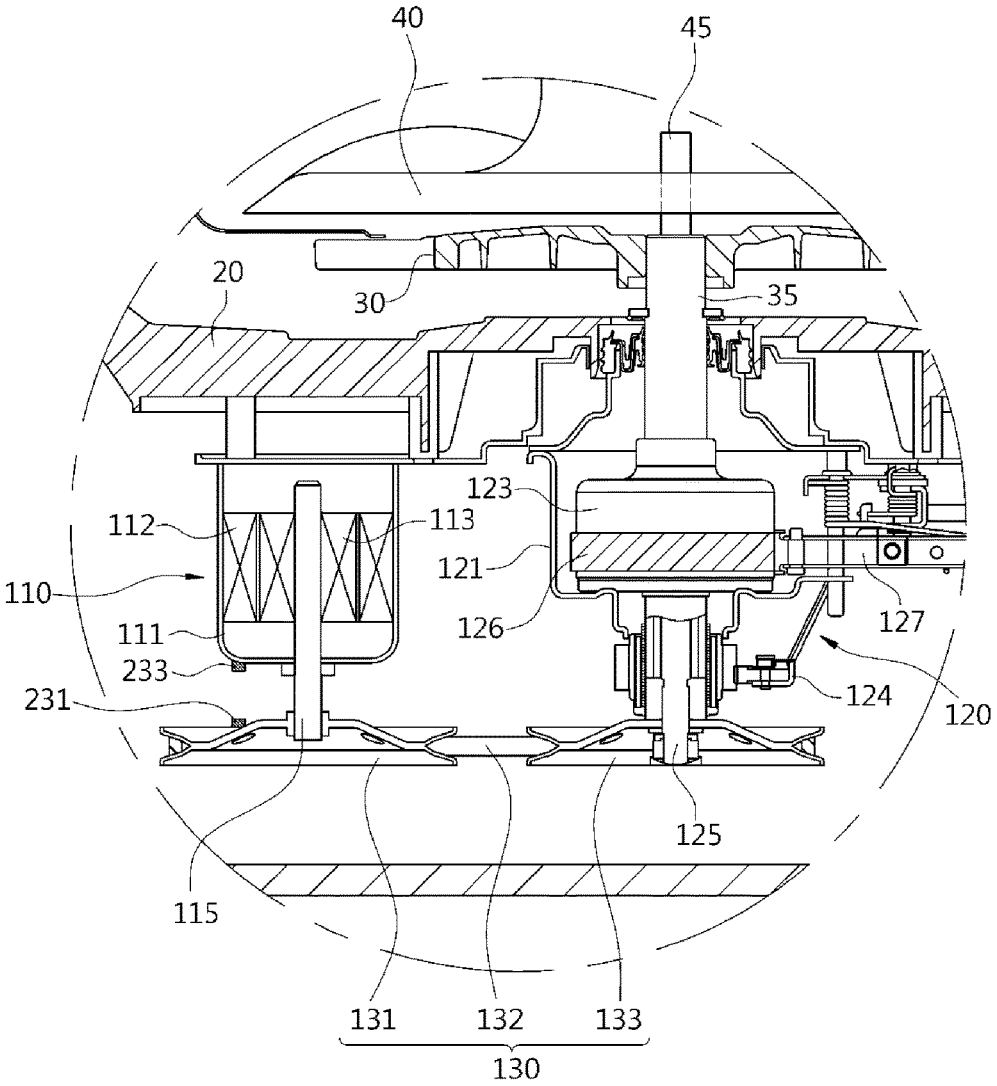

As still another example, as illustrated in FIG. 12, the position indicating member 231 may be provided at the driving pulley 131 coupled with the motor rotating shaft 115, and the speed detecting sensor 233 may be provided at a lower portion of the motor casing 111.

In this case, the position indicating member 231 may be rotated along with the driving pulley 131 about the motor rotating shaft 115, and the speed detecting sensor 233 may periodically detect the position indicating member 231 while the position indicating member 231 is rotated.

Also, the speed detector 230 may calculate the rotating speed of the clutch rotating shaft 125 using the number of the position indicating members 231 detected by the speed detecting sensor 233 for a period or a predetermined reference period of time while the speed detecting sensor 233 detects the position indicating member 231.

Further, the washing apparatus 1 may calculate the rotating speed of the rotating tub 30 or the pulsator 40 based on the rotating speed of the clutch rotating shaft 125 detected by the speed detector 230.

Furthermore, according to the embodiment, when two or more position indicating members 231 are provided in a circumferential direction of the driving pulley 131, the speed detector 230 may determine a rotating direction of the motor rotating shaft 115 as well as the rotating speed of the motor rotating shaft 115.

Figure 13:
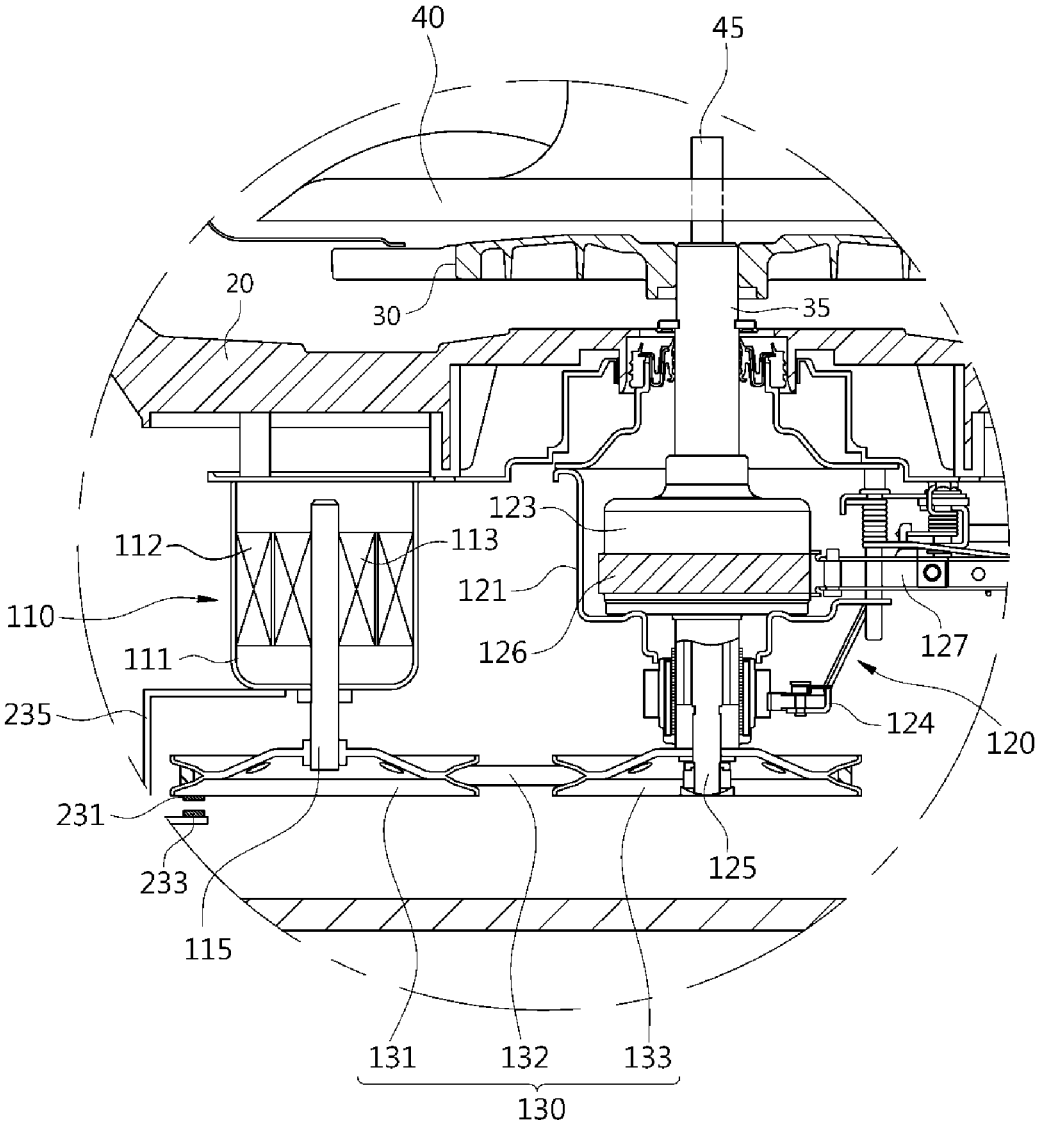

According to the embodiment, as illustrated in FIG. 13, the speed detector 230 may further include the supporting member 235 which supports the speed detecting sensor 233 so that the speed detecting sensor 233 is located more adjacent to the position indicating member 231. Specifically, the supporting member 235 may be provided to extend from the lower portion of the motor casing 111 toward the driving pulley 131, such that the speed detecting sensor 233 is located adjacent to the position indicating member 231.

As described above, the speed detecting sensor 233 and the position indicating member 231 may be located at various positions.

To detect the rotating speed of the driving motor 110 or the clutch unit 120, the speed detector 230 may use various structures in which a rotational displacement or a rotating speed of a rotating body is detected.

For example, the speed detector 230 may include a hall sensor and a permanent magnet.

Specifically, in the washing apparatus 1, the hall sensor which detects a magnetic field may be used as the speed detecting sensor 233, and the permanent magnet which generates the magnetic field may be used as the position indicating member 231.

Specifically, the permanent magnet may be disposed on the driving pulley 131 or the driven pulley 133 to be rotated with the motor rotating shaft 115 or the clutch rotating shaft 125, and the hall sensor may be disposed at the motor casing 111 or the clutch housing 121 to detect the permanent magnet.

While the driving pulley 131 or the driven pulley 133 to which the permanent magnet is disposed is rotated, the hall sensor periodically detects the magnetic field generated by the permanent magnet. Further, the speed detector 230 may calculate the rotating speed of the motor rotating shaft or the clutch rotating shaft 125 based on the number of the magnetic fields detected by the hall sensor for a period or a predetermined reference period of time while the hall sensor detects the magnetic field.

As another example, the speed detector 230 may include an infrared sensor.

Specifically, in the washing apparatus 1, an infrared LED which generates infrared light and the infrared sensor which receives the infrared light may be used as the speed detecting sensor 233, and a slit through which the infrared light passes may be used as the position indicating member 231.

Specifically, the slit through which the infrared light passes may be disposed in the driving pulley 131 or the driven pulley 133, and the infrared LED and the infrared sensor may be disposed so that the driving pulley 131 or the driven pulley 133 is disposed therebetween.

While the driving pulley 131 or the driven pulley 133 in which the slit is formed is rotated, the infrared sensor periodically detects the infrared light emitted from the infrared LED. Also, the speed detector 230 may calculate the rotating speed of the motor rotating shaft or the clutch rotating shaft 125 based on the detected number of the infrared light detected by the infrared sensor for a period or a predetermined reference period of time while the infrared sensor detects the infrared light.

Also, the speed detector 230 may include an encoder or a resolver other than the driving motor 110, the clutch unit 120 and the pulley unit 130.

For example, the motor rotating shaft 115 of the driving motor 110 may further extend under the driving pulley 131, and the encoder or the resolver may be provided at an end of the motor rotating shaft 115.

As another example, the clutch rotating shaft 125 of the clutch unit 120 may further extend under the driven pulley 133, and the encoder or the resolver may be provided at an end of the clutch rotating shaft 125.

The structure of the washing apparatus 1 according to one embodiment of the present disclosure has been described above.

Hereinafter, the operation of the washing apparatus 1 according to one embodiment of the present disclosure will be described.

Figure 14:
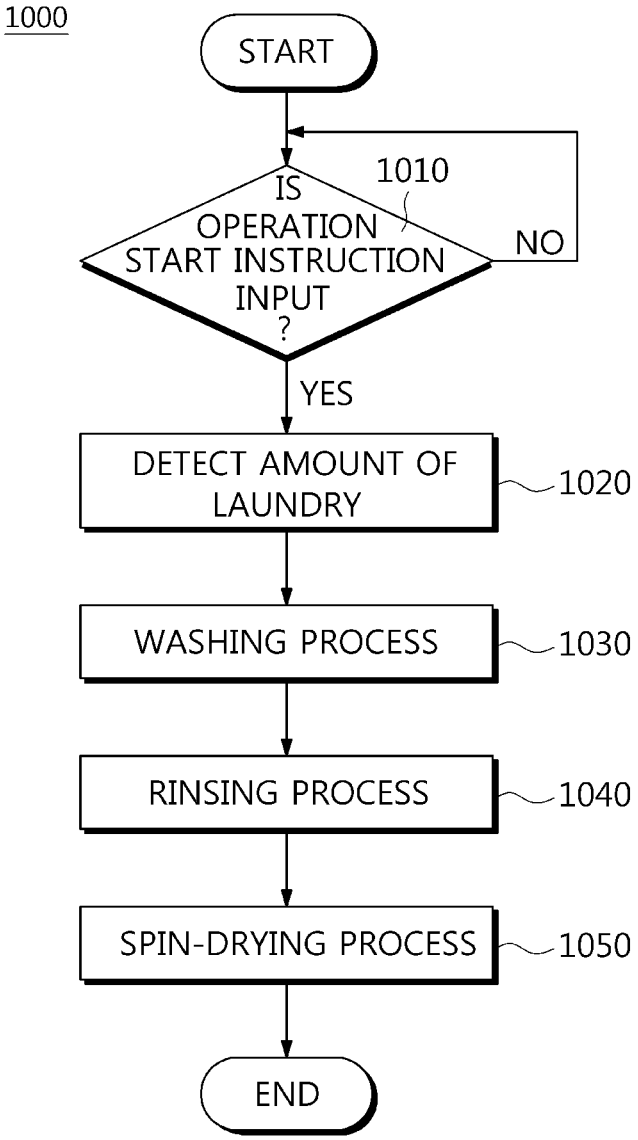
FIG. 14 is a view illustrating an operation of the washing apparatus according to one embodiment of the present disclosure.

FIG. 14 is a view illustrating the operation of the washing apparatus according to one embodiment of the present disclosure.

The user may select the washing course through the input part 210, and may also input detailed settings, such as the washing temperature, the number of rinsing operations and the intensity of the spin-drying operation, according to the washing course. Then, when the user inputs an operation start instruction through the input part 210, the washing apparatus 1 performs a series of operations 1000 to be described below.

As illustrated in FIG. 14, the washing apparatus 1 determines whether the operation start instruction is input (1010). For example, the washing apparatus 1 may receive the operation start instruction through an operation start button included in the input part 210.

When the operation start instruction is not input (NO in 1010), the washing apparatus 1 stands by until the operation start instruction is input. Further, the washing apparatus 1 may receive the settings for the washing course or the washing operation from the user before the operation start instruction is input.

When the operation start instruction is input (YES in 1010), the washing apparatus 1 detects an amount of the laundry (1020).

For example, the washing apparatus 1 may operate the driving motor 110 for a predetermined period of time, and may detect the amount of the laundry accommodated in the rotating tub 30 based on changes in the driving current and the rotating speed of the driving motor 110 or the clutch unit 120. In other words, the washing apparatus 1 may calculate the amount of the laundry using a phenomenon in which, as the amount of the laundry accommodated in the rotating tub 30 is increased, a rotational acceleration of the driving motor 110 or the clutch unit 120 is reduced.

As another example, the washing apparatus 1 may have a weight sensor which detects a weight of the damper 21 supporting the water tub 20, and may directly detect the amount of the laundry accommodated in the rotating tub 30 based on an output of the weight sensor.

When a weight of the laundry is calculated, the washing apparatus 1 may determine an amount of the water, which will be supplied to the water tub 20, according to the detected amount of the laundry.

Then, the washing apparatus 1 may perform the washing process (1030), the rinsing process (1040) and the spin-drying process (1050) in turn.

Also, the washing apparatus 1 may perform only part of the washing process (1030), the rinsing process (1040) and the spin-drying process (1050) according to a user's selection. For example, the user may operate the washing apparatus 1 to perform only the washing process for a rough washing, or may operate the washing apparatus 1 to perform only the spin-drying process after a hand washing operation.

The washing process 1030, the rinsing process 1040 and the spin-drying process 1050 will be described below in detail.

During the washing process, the washing apparatus 1 separates foreign substances attached to the laundry using a mechanical action between the water and the laundry and a chemical action of the detergent.

For the mechanical action between the water and the laundry, the washing apparatus 1 supplies the water into the water tub 20, rotates the pulsator 40 in a clockwise or counterclockwise direction, and thus generates a water stream. Further, for the chemical action of the detergent, the washing apparatus 1 adapts the water to pass through the detergent supplier 60 and thus supplies the detergent into the rotating tub 30.

Specifically, during the washing process, the washing apparatus 1 may perform the water supplying, the washing operation, the draining operation and the interim spin-drying operation.

The water supplying operation is an operation in which the washing apparatus 1 supplies the water into the water tub 20, and the washing apparatus 1 opens the water supplying valve 53 of the water supplier 50 for a water supplying time predetermined according to the detected amount of the laundry.

After the water supplying operation is completed, the washing apparatus 1 performs the washing operation 1100. The washing operation 1100 is an operation in which the pulsator 40 is rotated to wash the laundry.

Figure 15:
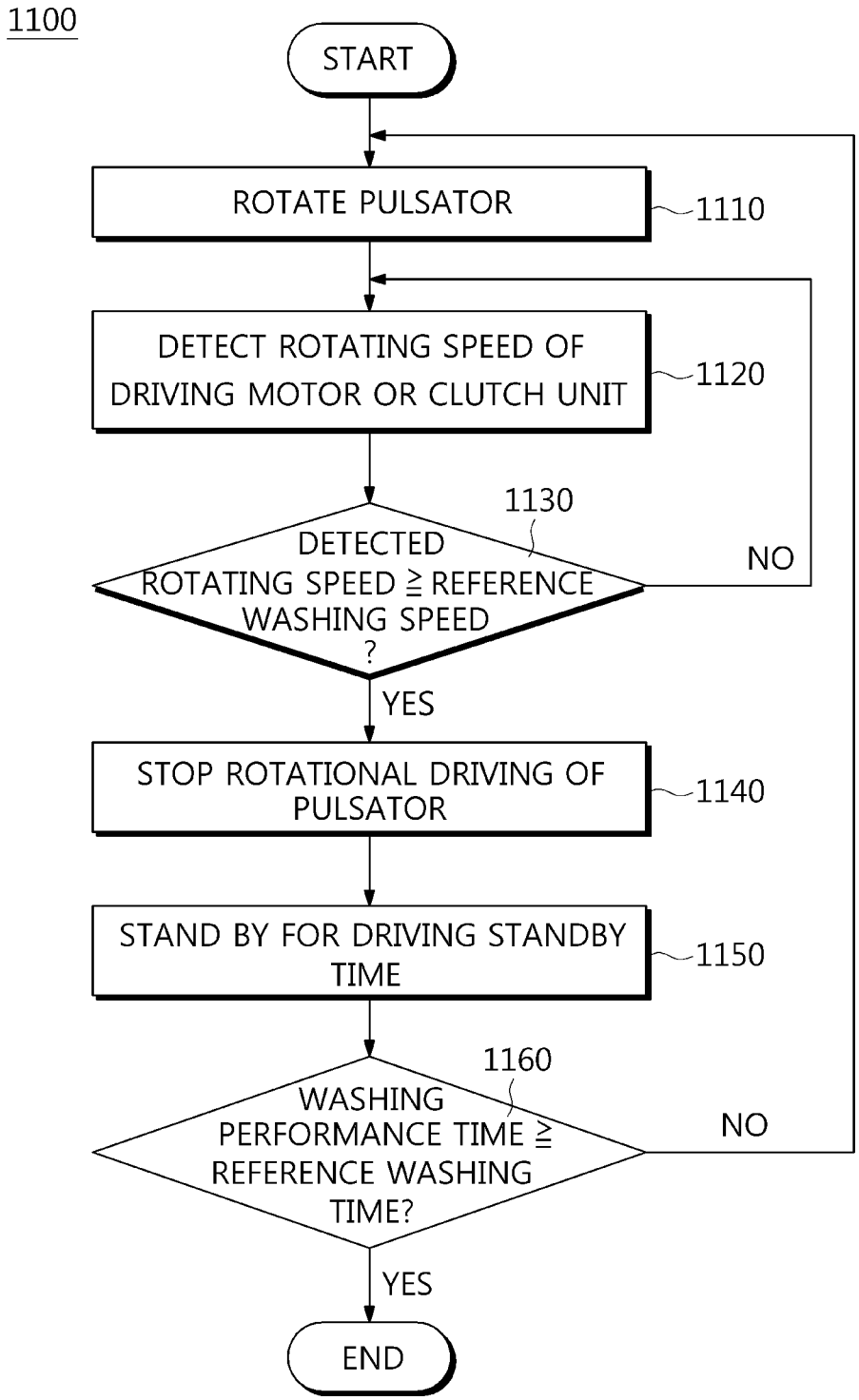
FIG. 15 is a view illustrating a washing operation of the washing apparatus according to one embodiment of the present disclosure.
Figure 16:
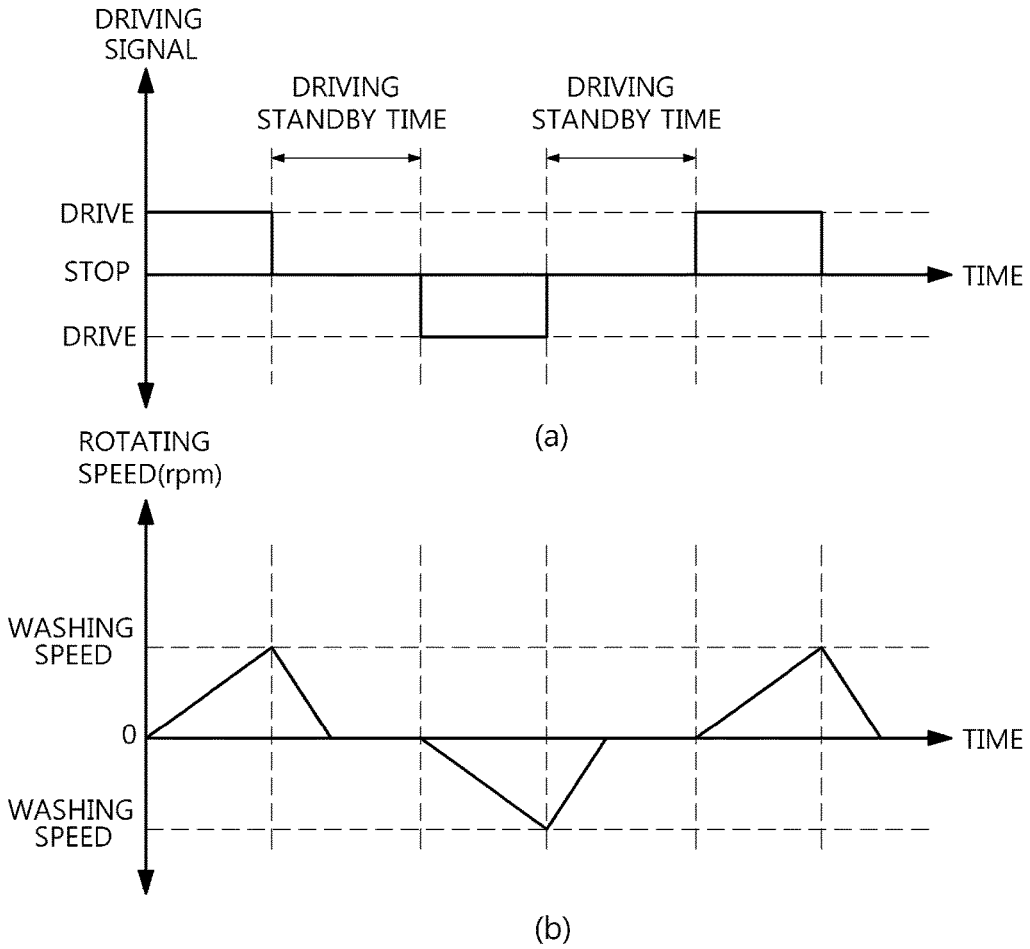
FIG. 16 is a view illustrating a driving signal and a rotating speed by the washing operation of the washing apparatus according to one embodiment of the present disclosure.

FIG. 15 is a view illustrating the washing operation of the washing apparatus according to one embodiment of the present disclosure, and FIG. 16 is a view illustrating a driving signal and a rotating speed by the washing operation of the washing apparatus according to one embodiment of the present disclosure.

Referring to FIG. 15, the washing apparatus 1 rotates the pulsator 40 (1110).

Specifically, the washing apparatus 1 operates the clutch unit 120 so that the rotating force of the driving motor 110 is transmitted to only the pulsator 40. For example, when the washing apparatus 1 does not operate the drain motor 73 (referring to FIG. 6), the washing apparatus 1 may enable the clutch unit 120 to transmit the rotating force of the driving motor 110 to only the pulsator 40 and not to transmit the rotating force of the driving motor 110 to the rotating tub 30.

When the clutch unit 120 is operated so that the rotating force of the driving motor 110 is transmitted to only the pulsator 40, the clutch unit 120 reduces the rotating force received from the driving motor 110 and then transmits the reduced rotating force to the pulsator 40, as described above.

Further, as illustrated in FIG. 16, part (a), the washing apparatus 1 operates the driving motor 110. In other words, the washing apparatus 1 switches on the driving switch 51 (referring to FIG. 6) which supplies the power to the driving motor 110.

As a result, as illustrated in FIG. 16, part (b), the rotating speed of the pulsator 40 is gradually increased. At this time, an increased speed of the rotating speed of the pulsator 40 may be changed according to the amount of the water and the laundry accommodated in the rotating tub 30.

Then, the washing apparatus 1 detects the rotating speed (1120), and determines whether the detected rotating speed is equal to or more than a predetermined reference washing speed (1130).

Specifically, the washing apparatus 1 may detect the rotating speed of the driving motor 110 or the clutch unit 120 using the speed detector 230, and may calculate the rotating speed of the pulsator 40 based on the detected rotating speed of the driving motor 110 or the clutch unit 120.

As described above, the rotating speed of the driving motor 110 and the rotating speed of the clutch unit 120 may be different from each other, and the washing apparatus may detect the rotating speed of the driving motor 110 or the clutch unit 120 according to the arrangement of the speed detector 230.

When the detected rotating speed is not the reference washing speed or more (NO in 1130), the washing apparatus 1 detects the rotating speed of the pulsator 40 and compares the detected rotating speed with the reference washing speed, repeatedly.

When the detected rotating speed is equal to or more than the reference washing speed (YES in 1130), the washing apparatus 1 stops a rotational driving of the pulsator 40 (1140).

Specifically, as illustrated in FIG. 16, part (a), the washing apparatus 1 stops the operation of the driving motor 110. In other words, the washing apparatus 1 switches off the driving switch 51 (referring to FIG. 6) which supplies the power to the driving motor 110.

As a result, as illustrated in FIG. 16, part (b), the rotating speed of the pulsator 40 is gradually reduced.

Then, the washing apparatus 1 stops the rotation of the pulsator 40 and then stands by for a predetermined standby time (1150).

And the washing apparatus 1 determines whether a washing performance time is equal to or more than a reference washing time (1160). Specifically, the washing apparatus 1 compares the reference washing time predetermined according to the amount of the laundry with the washing performance time when the washing operation 1100 illustrated in FIG. 14 is performed.

When the washing performance time is not the reference washing time or more (NO in 1160), the washing apparatus 1 repeats the washing operation.

At this time, as illustrated in FIG. 16, the washing apparatus 1 may change a rotating direction of the pulsator 40 whenever the washing operation 1100 is performed.

For example, in a first washing operation 1100, the washing apparatus 1 may rotate the pulsator 40 in the clockwise direction, and in a second washing operation 1100, the washing apparatus 1 may rotate the pulsator 40 in the counterclockwise direction. Also, in a third washing operation 1100, the washing apparatus 1 may rotate the pulsator 40 again in the clockwise direction.

Specifically, the washing apparatus 1 may control the driving motor 110 to be alternately rotated in the clockwise and counterclockwise directions during the washing process, and thus the pulsator 40 may be repeatedly and alternately rotated in the clockwise and counterclockwise directions during the washing process.

When the washing performance time is equal to or more than the reference washing time (YES in 1160), the washing apparatus 1 finishes the washing operation.

As described above, the washing apparatus 1 repeats the washing operation for the reference washing time predetermined according to the amount of the laundry.

Also, in the washing operation 1100 illustrated in FIG. 15, the driving motor 110 is controlled based on the rotating speed of the pulsator 40, but not limited thereto.

For example, the washing apparatus 1 may operate the driving motor 110 for a predetermined on-time, and then may stop the operation of the driving motor 110 for a predetermined off-time, repeatedly.

As another example, the washing apparatus 1 may operate the driving motor 110 until the rotating speed of the pulsator 40 arrives at a predetermined reference washing speed, and then may stop the operation of the driving motor 110, and may operate the driving motor 110 again when the rotating speed of the pulsator 40 is "0".

The washing apparatus 1 may perform the washing operation illustrated in FIG. 15 for the washing time predetermined according to the amount of the laundry.

After the washing operation 1100 is completed, the washing apparatus 1 performs the draining operation.

The draining operation is an operation in which the washing apparatus 1 discharges the water accommodated in the water tub 20 to the outside. Specifically, the washing apparatus 1 may operate the drain motor 73 to open the drain valve 72.

After the draining operation, the washing apparatus 1 may perform the interim spin-drying operation.

The interim spin-drying operation is an operation in which the rotating tub 30 and the pulsator 40 are rotated at a high speed, and the water is separated from the laundry by the centrifugal force due to the high speed rotation.

Since the interim spin-drying operation is the same as an operation of the washing apparatus 1 in the spin-drying process to be described later, the detailed description thereof will be described below.

When the washing process is completed, the washing apparatus 1 performs the rinsing process, and during the rinsing process, the washing apparatus 1 removes the foreign substances and the detergent from the laundry.

Specifically, during the rinsing process, the washing apparatus 1 may perform the water supplying operation, the rinsing operation, the draining operation and the interim spin-drying operation.

During the rinsing process, the washing apparatus 1 performs the water supplying operation by supplying the water into the water tub 20, performs the rinsing operation by rotating the pulsator 40 in the clockwise or counterclockwise direction, and performs the interim spin-drying operation by rotating the rotating tub 30 and the pulsator 40 at the high speed after the water in the water tub 20 is discharged to the outside.

Since the water supplying operation, the rinsing operation, the draining operation and the interim spin-drying operation in the rinsing process are the same as those in the washing process, the detailed description thereof will be omitted.

When the rinsing process is completed, the washing apparatus 1 performs the spin-drying process.

During the spin-drying process, the washing apparatus 1 rotates the rotating tub 30 and the pulsator 40 at the high speed, and separates the water from the laundry by the centrifugal force due to the high speed rotation.

Specifically, during the spin-drying process, the washing apparatus 1 performs an intermittent spin-drying operation in which the rotating speed of the rotating tub 30 and the pulsator 40 is slowly increased, and a main spin-drying operation in which the rotating tub 30 and the pulsator 40 are rotated at a high speed of 700 rpm or more.

During the intermittent spin-drying operation, the washing apparatus 1 repeats the operation and shutdown of the driving motor 110, and during the main spin-drying operation, the washing apparatus 1 operates the driving motor 110 for the predetermined period of time.

The washing apparatus 1 may perform the intermittent spin-drying operation, and thus may reduce a load of the driving motor 110 in the main spin-drying operation. During the intermittent spin-drying operation, a great quantity of the water is separated from the laundry, and thus a weight of the laundry in the main spin-drying operation is considerably reduced, compared with that of the laundry in the intermittent spin-drying operation.

Further, the washing apparatus 1 may discharge the water separated from the laundry by performing the intermittent spin-drying operation.

While the rotating tub 30 is rotated at the high speed, the drainage of the water tub 20 is not efficiently performed. This is because the water is continuously supplied between the rotating tub 30 and the water tub 20 by the centrifugal force due to the rotation of the rotating tub 30, and the water between the rotating tub 30 and the water tub 20 obstructs the rotation of the rotating tub 30.

Before the rotating tub 30 is rotated at the high speed, the washing apparatus 1 rotates the rotating tub 30 at a low speed so that the great quantity of the water separated from the laundry is drained, and then rotates the rotating tub 30 at the high speed, thereby increasing spin-drying efficiency.

There is at least one resonance area within a rotating speed range of the rotating tub 30 during the intermittent spin-drying operation.

The resonance is a phenomenon in which vibration of the water tub 20 is greatly increased by the rotation of the rotating tub 30, when a vibration frequency of the water tub 20 accommodating the rotating tub 30 coincides with the rotating speed of the rotating tub 30.

When the resonance phenomenon occurs, vibration of the washing apparatus 1 and a noise due to the vibration are increased, and in severe cases, the washing apparatus 1 may be damaged.

The resonance generated by the rotation of the rotating tub 30 may be classified into two kinds in which there may be a difference according to a size of the rotating tub 30, and which includes a first resonance generated at a rotating speed of the rotating tub 30 of about 100 rpm and a second resonance generated at a rotating speed of the rotating tub 30 of about 300 rpm.

In the first resonance, the entire water tub 20 accommodating the rotating tub 30 is violently vibrated left and right while the rotating tub 30 is rotated, and in the second resonance, upper and lower portions of the water tub 20 accommodating the rotating tub 30 is vibrated in opposite directions to each other while the rotating tub 30 is rotated, and in the second resonance.

The rotating speed of the rotating tub 30 which generates the first resonance and the second resonance may be changed according to a size, a shape and a weight of the rotating tub 30, and particularly may be changed according to an amount and a position of the laundry accommodated in the rotating tub 30.

Further, the first resonance and the second resonance are not generated at only a particular rotating speed, but may be generated at a continuous rotating speed range.

Hereinafter, the rotating speed range which generates the first resonance is called a first resonance area R1, and the rotating speed range which generates the second resonance is called a second resonance area R2.

The vibration due to the resonance phenomenon may be minimized by reducing the passing number of the rotating speed of the rotating tub 30 passing through the resonance area or increasing a weight of the water tub 20 accommodating the rotating tub 30.

First, a method of minimizing the vibration due to the resonance phenomenon by reducing the passing number of the rotating speed of the rotating tub 30 passing through the resonance area will be described.

FIG. 17 is a view illustrating a driving signal and a rotating speed by an intermittent spin-drying operation according to the prior art.

To perform the intermittent spin-drying operation, a washing apparatus according to the prior art operates the driving motor for a predetermined on-time, and then stops the operation of the driving motor for a predetermined off-time.

For example, as illustrated in FIG. 17, the washing apparatus according to the prior art operates the driving motor for a first predetermined on-time, and stops the operation of the driving motor for a first predetermined off-time, and then operates the driving motor for a second predetermined on-time again, and stops the operation of the driving motor for a second predetermined off-time.

As illustrated in FIG. 17, part (b), by such an intermittent spin-drying operation, the rotating speed of the rotating tub 30 is increased when the driving motor is operated, and reduced when the driving motor is stopped.

At this time, the on-time and off-time of the driving motor may be properly set so that the rotating speed of the rotating tub passes once through the first resonance area R1 and the second resonance area R2, as illustrated in a first speed graph V1 of FIG. 17, part (b).

However, when the amount of the laundry is increased or the power source supplying electric energy to the driving motor is unstable, the rotating speed of the rotating tub passes many times through the first resonance area R1 and the second resonance area R2, as illustrated in a second speed graph V2 of FIG. 17, part (b). As a result, the vibration of the rotating tub may be considerably increased during the intermittent spin-drying operation.

In the intermittent spin-drying operation of the washing apparatus according to the prior art, since the operation of the driving motor is controlled based on the operation time, it is difficult to easily avoid the resonance area.

However, in the washing apparatus 1 according to one embodiment of the present disclosure, since the operation of the driving motor 110 is controlled based on the rotating speed, it is possible to easily avoid the resonance area.

Figure 18:
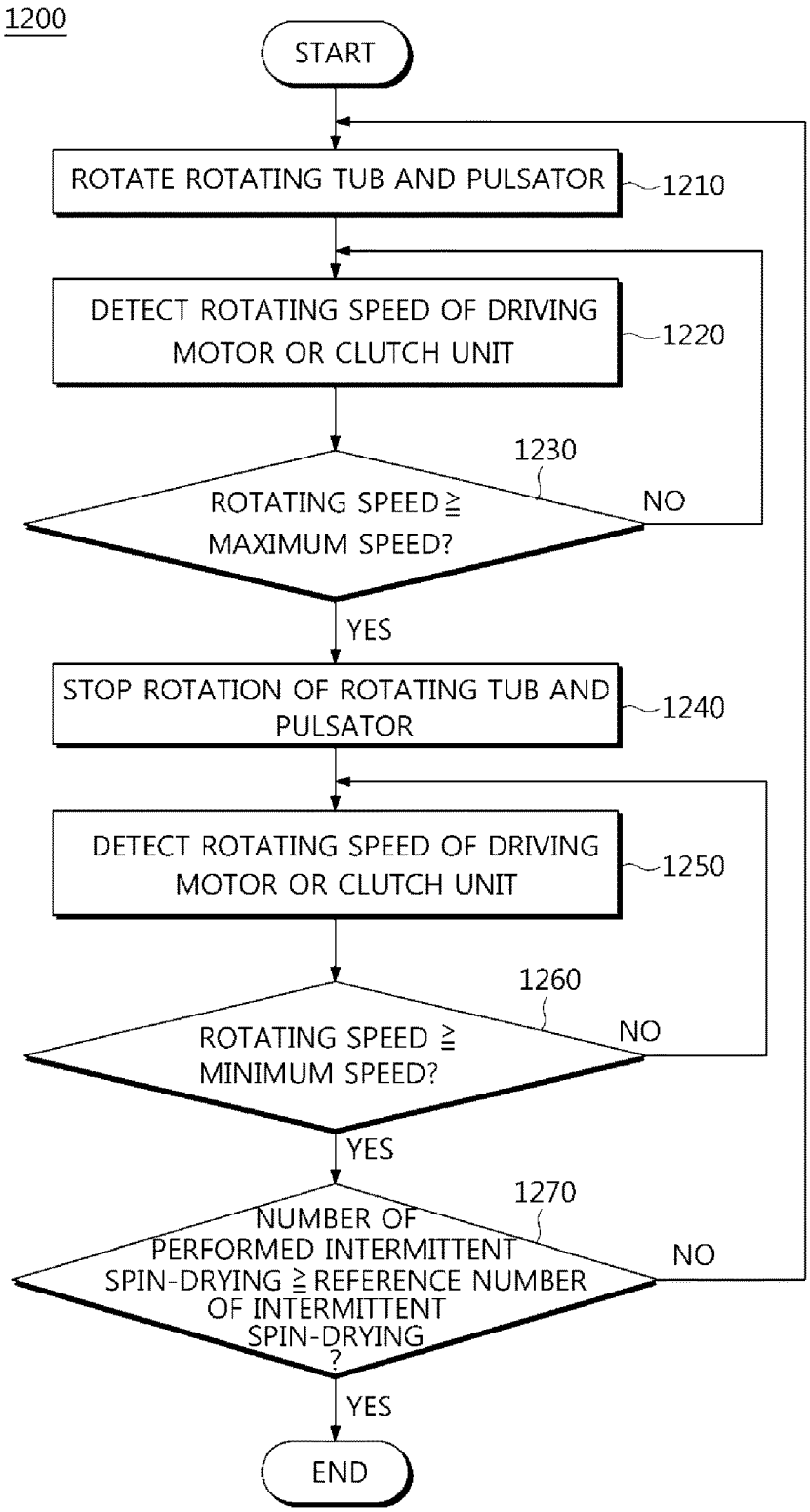
FIG. 18 is a view illustrating an intermittent spin-drying operation of the washing apparatus according to one embodiment of the present disclosure.
Figure 19:
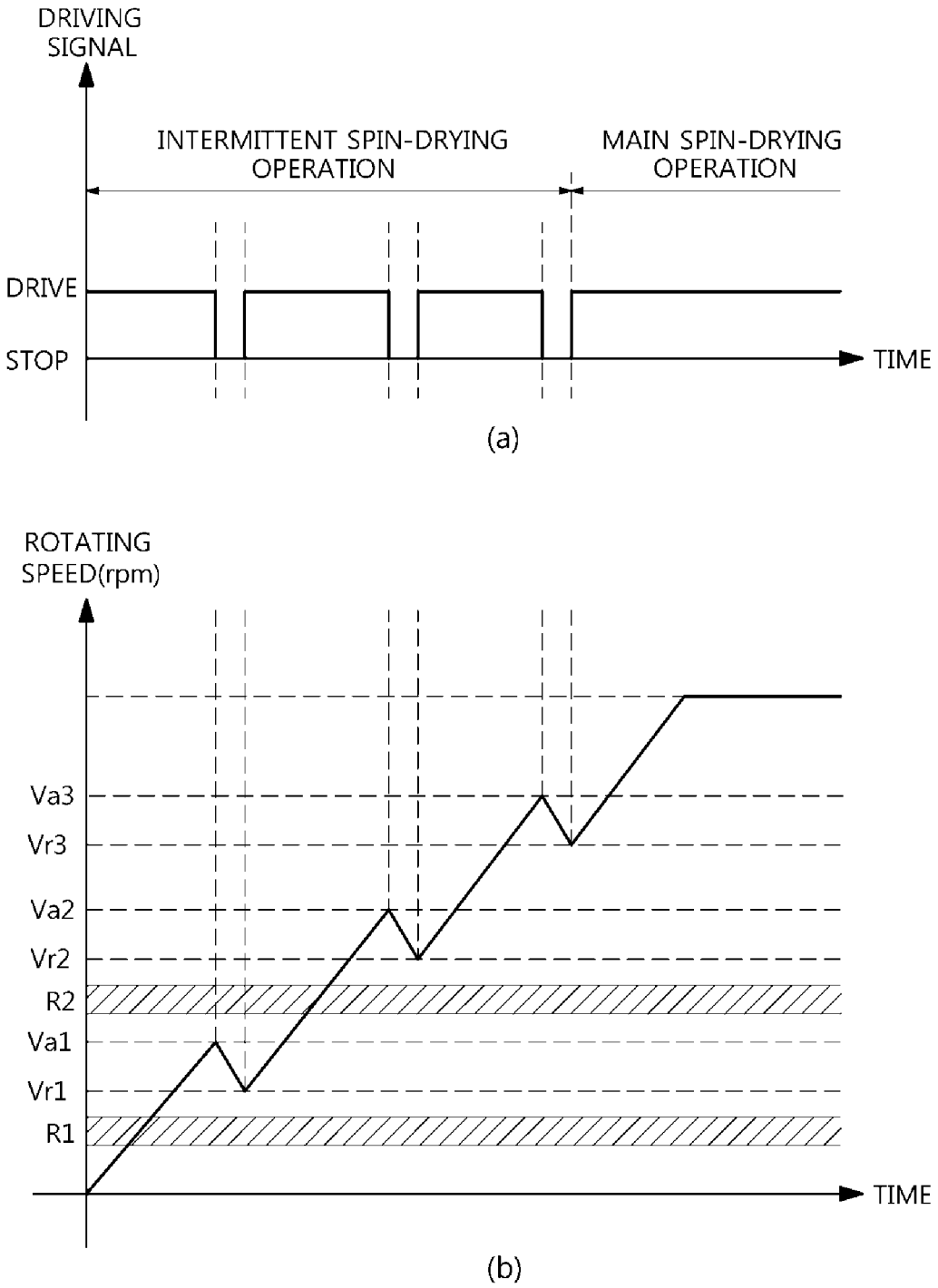
FIG. 19 is a view illustrating a driving signal and a rotating speed by the intermittent spin-drying operation of the washing apparatus according to one embodiment of the present disclosure.

FIG. 18 is a view illustrating an intermittent spin-drying operation of the washing apparatus according to one embodiment of the present disclosure, and FIG. 19 is a view illustrating a driving signal and a rotating speed by the intermittent spin-drying operation of the washing apparatus according to one embodiment of the present disclosure.

The intermittent spin-drying operation 1200 of the washing apparatus 1 according to one embodiment of the present disclosure will be described with reference to FIGS. 18 and 19.

During intermittent spin-drying operation, the washing apparatus 1 rotates the rotating tub 30 and the pulsator 40.

The washing apparatus 1 operates the clutch unit 120 so that the rotating force of the driving motor 110 is transmitted to both of the rotating tub 30 and the pulsator 40. For example, when the washing apparatus 1 operates the drain motor 73 (referring to FIG. 6), the clutch unit 120 may transmit the rotating force of the driving motor 110 to both of the rotating tub 30 and the pulsator 40.

When the clutch unit 120 is operated so that the rotating force of the driving motor 110 is transmitted to both of the rotating tub 30 and the pulsator 40, the clutch unit 120 transmits the rotating force of the clutch rotating shaft 125, as it is, to the pulsator rotating shaft 45, as described above.

Further, the washing apparatus 1 operates the driving motor 110, as illustrated in FIG. 19, part (a). In other words, the washing apparatus 1 switches on the driving switch 51 (referring to FIG. 6) which supplies the power to the driving motor 110.

As a result, as illustrated in FIG. 19, part (b), the rotating speed of the rotating tub 30 and the pulsator 40 is gradually increased. At this time, the increase in the rotating speed of the rotating tub 30 and the pulsator 40 may be changed according to the amount of the laundry and the water accommodated in the rotating tub 30.

Further, in the spin-drying process, unlike the washing process, the washing apparatus 1 may controls the driving motor 110 to be rotated in one of the clockwise and counterclockwise directions. As a result, during the spin-drying process, the rotating tub 30 and the pulsator 40 may be rotated in one of the clockwise and counterclockwise directions.

Then, the washing apparatus 1 detects the rotating speed of the rotating tub 30 and the pulsator 40 (1220), and determines whether the detected rotating speed is equal to or more than a maximum speed (1230).

Specifically, the washing apparatus 1 may detect the rotating speed of the driving motor 110 or the clutch unit 120 through the speed detector 230, and may calculate the rotating speed of the rotating tub 30 and the pulsator 40 based on the detected rotating speed of the driving motor 110 or the clutch unit 120.

When the detected rotating speed is not a maximum speed or more (NO in 1230), the washing apparatus 1 detects the rotating speed of the rotating tub 30 and the pulsator 40, and compares the detected rotating speed with the maximum speed, repeatedly.

When the detected rotating speed is equal to more than a maximum speed (YES in 1230), the washing apparatus 1 stops the rotational driving of the rotating tub 30 and the pulsator 40 (1240).

Specifically, the washing apparatus 1 stops the operation of the driving motor 110, as illustrated in FIG. 19, part (a). In other words, the washing apparatus 1 switches off the driving switch 51 (referring to FIG. 6) which supplies the power to the driving motor 110.

As a result, the rotating speed of the rotating tub 30 and the pulsator 40 is gradually reduced, as illustrated in FIG. 19, part (b).

Then, the washing apparatus 1 detects the rotating speed of the rotating tub 30 and the pulsator 40, and determines whether the detected rotating speed is equal to or less than a minimum speed (1260).

Specifically, the washing apparatus 1 may detect the rotating speed of the driving motor 110 or the clutch unit 120 using the speed detector 230, and may calculate the rotating speed of the rotating tub 30 and the pulsator 40 based on the detected rotating speed of the driving motor 110 or the clutch unit 120.

When the detected rotating speed is not a minimum speed or less (NO in 1260), the washing apparatus 1 detects the rotating speed of the rotating tub 30 and the pulsator 40, and compares the detected rotating speed with the minimum speed, repeatedly.

When the detected rotating speed is equal to or less than the minimum speed (YES in 1260), the washing apparatus 1 determines whether the number of the performed intermittent dewatering operations is equal to or more than the reference number of the intermittent spin-drying operations (1270).

Specifically, the washing apparatus 1 may compare the number of the performed intermittent spin-drying operations with the reference number of the intermittent spin-drying operations predetermined according to the amount of the laundry, and may determine whether the number of the performed intermittent spin-drying operations is more than the reference number of the intermittent spin-drying operations.

When the number of the performed intermittent spin-drying operations is not the reference number of the intermittent spin-drying operations or more (NO in 1270), the washing apparatus 1 repeats the intermittent spin-drying operation.

At this time, the maximum speed and the minimum speed may be renewed to new maximum and minimum speeds.

For example, as illustrated in FIG. 19, part (a), when a first intermittent spin-drying operation is performed, the washing apparatus 1 may set the maximum speed to a first maximum speed Va1, and may set the minimum speed to a first minimum speed Vr1. Specifically, when the driving motor 110 is operated, and then the rotating speed of the rotating tub 30 and the pulsator 40 is equal to or more than the first maximum speed Va1, the washing apparatus 1 may stop the operation of the driving motor 110, and when the rotating speed of the rotating tub 30 and the pulsator 40 is equal to or less than the first minimum speed Vr1, the washing apparatus 1 may operate the driving motor 110 again.

At this time, each of the first maximum speed Va1 and the first minimum speed Vr1 may be determined to a rotating speed between the first resonance area R1 and a second resonance area R2.

Also, when a second intermittent spin-drying operation is performed, the washing apparatus 1 may set the maximum speed to a second maximum speed Va2, and may set the minimum speed to a second minimum speed Vr2. Specifically, when the rotating speed of the rotating tub 30 and the pulsator 40 is equal to or more than the second maximum speed Va2, the washing apparatus 1 may stop the operation of the driving motor 110, and when the rotating speed of the rotating tub 30 and the pulsator 40 is equal to or less than the second minimum speed Vr2, the washing apparatus 1 may operate the driving motor 110 again.

At this time, the second maximum speed Va2 and the second minimum speed Vr2 may be greater than the first maximum speed Va1 and the first minimum speed Vr1, respectively. Further, the second maximum speed Va2 may be greater than the first minimum speed Vr1, and the second maximum speed Va2 and the first minimum speed Vr1 may be determined to rotating speeds which are faster than the first resonance area R1 and the second resonance area R2.

Also, when a third intermittent spin-drying operation is performed, the maximum speed may be set to a third maximum speed Va3, and the minimum speed may be set to a third minimum speed Vr3. Specifically, when the rotating speed of the rotating tub 30 and the pulsator 40 is more than the third maximum speed Va3, the washing apparatus 1 may stop the operation of the driving motor 110, and when the rotating speed of the rotating tub 30 and the pulsator 40 is less than the third minimum speed Vr3, the washing apparatus 1 may operate the driving motor 110 again.

At this time, the third maximum speed Va3 and the third minimum speed Vr3 may be greater than the second maximum speed Va2 and the second minimum speed Vr2, respectively.

As such, when the intermittent spin-drying operation is repeated, the maximum speed and the minimum speed are gradually increased, and the rotating speed of the rotating tub 30 and the pulsator 40 is gradually increased.

When the number of the performed intermittent spin-drying operations is equal to or more than the reference number of the intermittent spin-drying operations (YES in 1270), the washing apparatus 1 stops the intermittent spin-drying operation, and starts the main spin-drying operation.

Specifically, the washing apparatus 1 may continuously operate the driving motor 110 for a predetermined spin-drying time without the stopping of the driving motor 110. As a result, the rotating speed of the rotating tub 30 and the pulsator 40 may be rotated at a rotating speed of about 720 rpm.

As described above, since the turning on/off of the driving motor 110 is repeated based on the rotating speed of the rotating tub 30 and the pulsator 40, the rotating speed of the rotating tub 30 and the pulsator 40 passes once through the first resonance area R1 and the second resonance area R2, respectively, during the intermittent spin-drying operation.

As a result, during the intermittent spin-drying operation (1200), the washing apparatus 1 may minimize the vibration and the noise generated by the resonance. Although the amount of the laundry is changed, the washing apparatus 1 may minimize the vibration and the noise due to the resonance.

Figure 20:
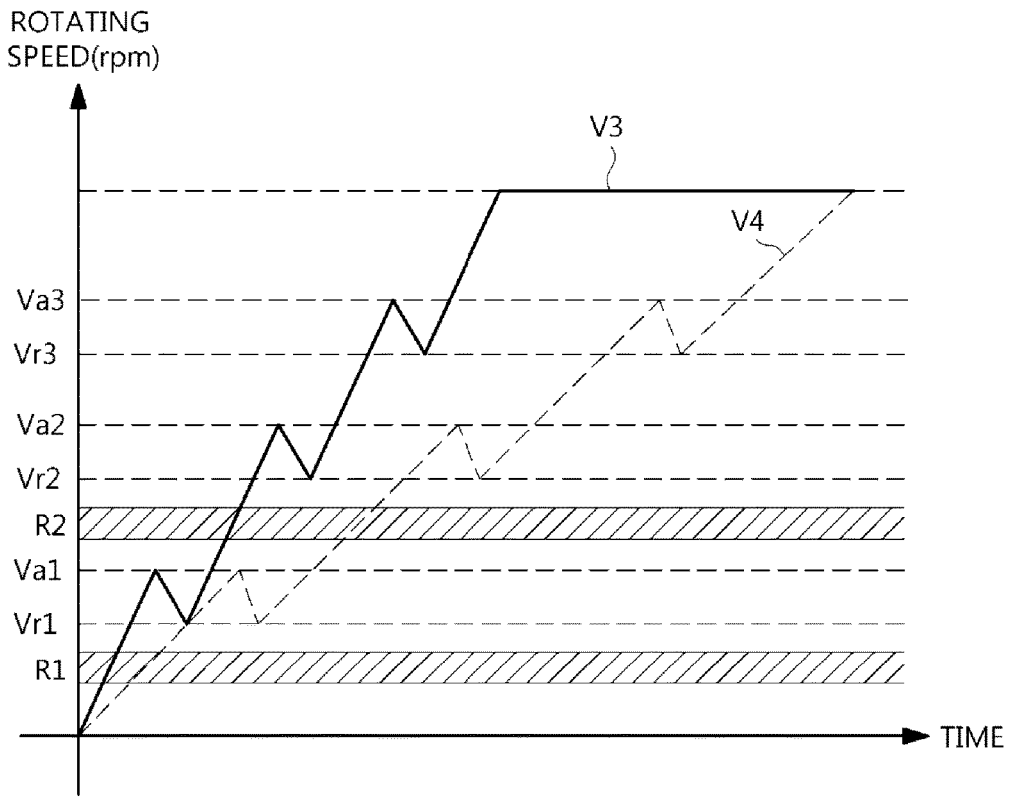
FIG. 20 is a view illustrating a rotating speed according to an amount of laundry in the washing apparatus according to one embodiment of the present disclosure.

FIG. 20 is a view illustrating the rotating speed according to the amount of the laundry in the washing apparatus according to one embodiment of the present disclosure. Specifically, FIG. 20 illustrates a third speed graph V3 which indicates the rotating speed of the driving motor 110 or the clutch unit 120 when the amount of the laundry is small, and a fourth speed graph V4 which indicates the rotating speed of the driving motor 110 or the clutch unit 120 when the amount of the laundry is large.

Referring to FIG. 20, both of the third speed graph V3 and the fourth speed graph V4 pass only once through the first resonance area R1 and the second resonance area R2. This is because the washing apparatus 1 controls the operation of the driving motor 110 based on the rotating speed of the driving motor 110 or the clutch unit 120.

Like this, during the intermittent spin-drying operation (1200), since the washing apparatus 1 controls the operation of the driving motor 110 based on the rotating speed of the rotating tub 30 or the pulsator 40, the washing apparatus 1 may minimize the vibration and the noise regardless of the amount of the laundry accommodated in the rotating tub 30.

After the intermittent spin-drying operation (1200), the washing apparatus 1 performs the main spin-drying operation.

Specifically, the washing apparatus 1 operates continuously the driving motor for a predetermined spin-drying operation time so that the rotating tub 30 is rotated at a main spin-drying speed of 700 to 800 rpm.

When the intermittent spin-drying operation and the main spin-drying operation are completed, the washing apparatus 1 finishes the operation and informs the user of the completion of all operations.

The structure and the operation of the washing apparatus 1 according to one embodiment of the present disclosure have been described above.

Hereinafter, a structure and an operation of a washing apparatus 1' according to another embodiment of the present disclosure have been described.

Figure 21:
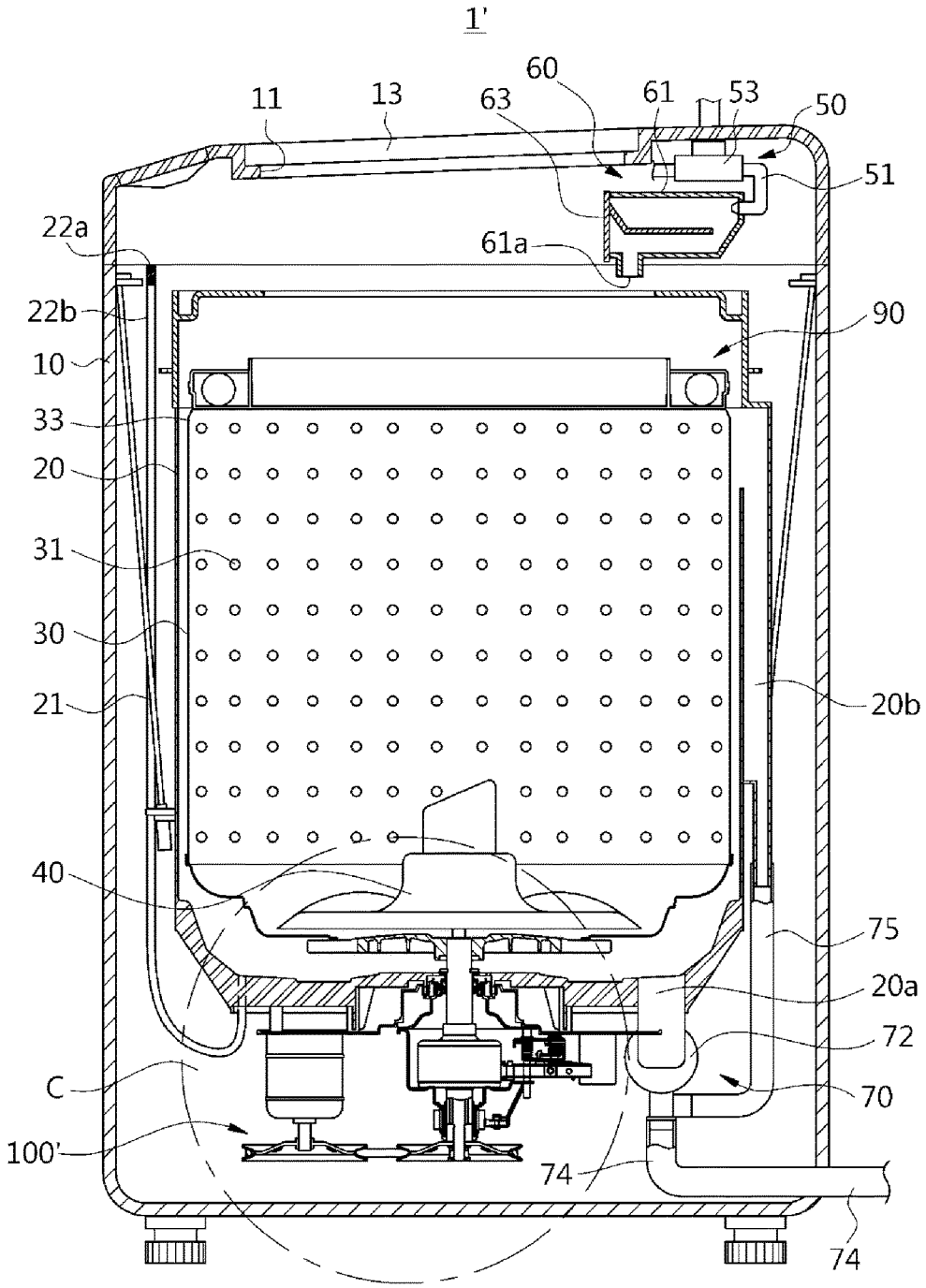
FIG. 21 is a side cross-sectional view of a washing apparatus according to another embodiment of the present disclosure.
Figure 22:
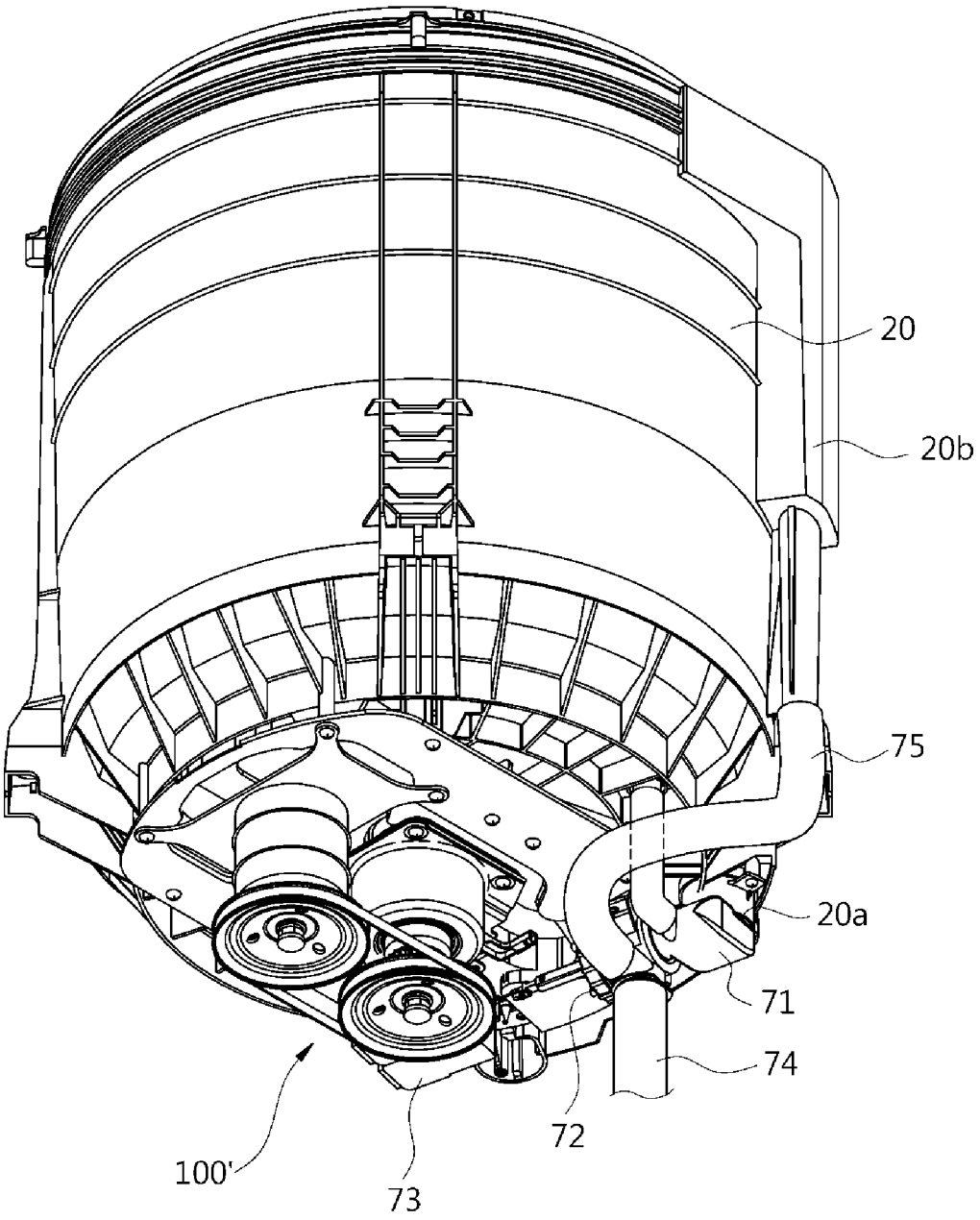
FIG. 22 is a view illustrating a lower portion of the washing apparatus according to another embodiment of the present disclosure.
Figure 23:
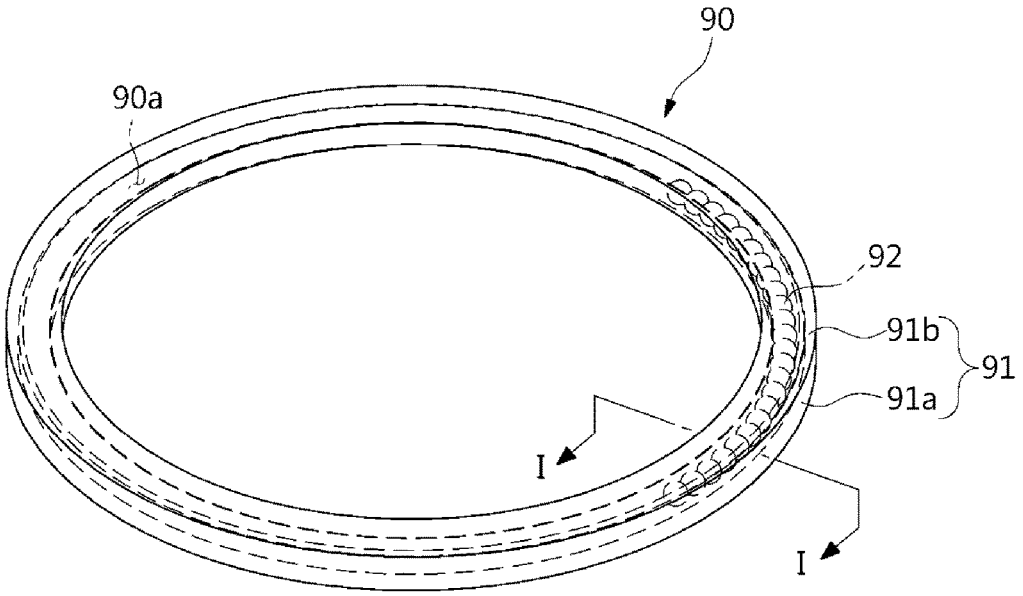
FIG. 23 is a view illustrating a ball balancer included in the washing apparatus according to another embodiment of the present disclosure.
Figure 24:
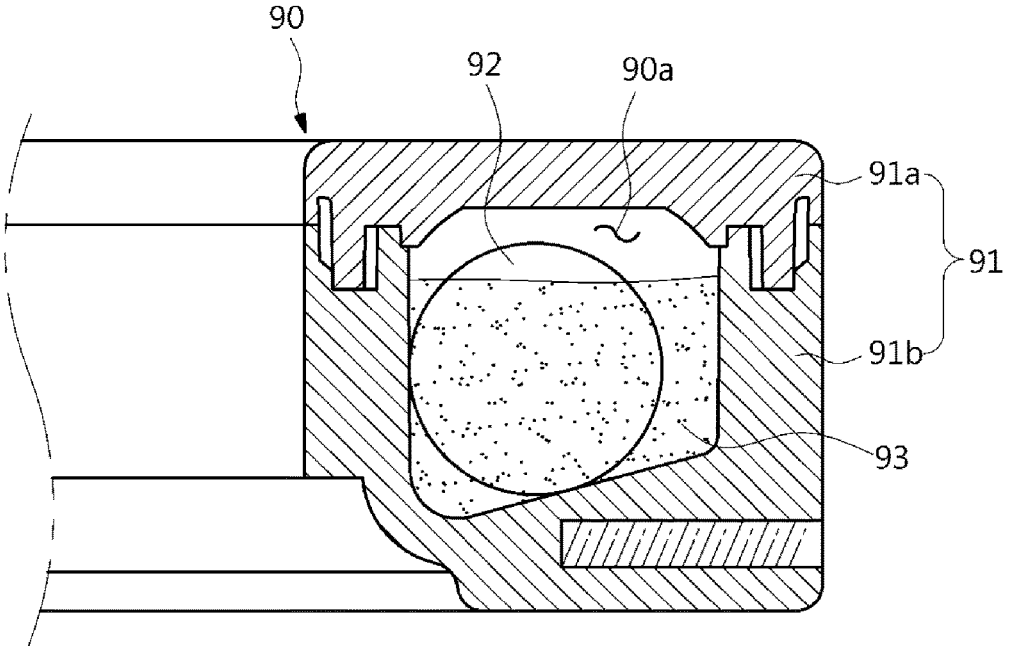
FIG. 24 is a cross-sectional view taken along a line I-I' of FIG. 23.

FIG. 21 is a side cross-sectional view of a washing apparatus according to another embodiment of the present disclosure, and FIG. 22 is a view illustrating a lower portion of the washing apparatus according to another embodiment of the present disclosure. Also, FIG. 23 is a view illustrating a ball balancer included in the washing apparatus according to another embodiment of the present disclosure, and FIG. 24 is a cross-sectional view taken along a line I-I' of FIG. 23.

Referring to FIGS. 21 to 24, the washing apparatus 1' includes a cabinet 10 which forms an exterior, a water tub 20 which accommodates water, a rotating tub 30 which is rotatably disposed in the water tub 20, a pulsator 40 which generates a water stream in the rotating tub 30, a water supplier 50 which supplies water into the water tub 20, a detergent supplier 60 which supplies a detergent into the rotating tub 30, a drain part 70 which drains the water accommodated in the water tub 20, a ball balancer 90 which induces stable rotation of the rotating tub 30, and a rotational driving part 100' which selectively rotates the rotating tub 30 and the pulsator 40.

Since the cabinet 10, the water tub 20, the rotating tub 30, the pulsator 40, the water supplier 50, the detergent supplier 60 and the drain part 70 are the same as those in the washing apparatus 1 according to one embodiment of the present disclosure, as described above, the description thereof will be omitted.

The ball balancer 90 is provided at an upper end of the rotating tub 30 to compensate for eccentricity of a weight and thus to smoothly rotate the rotating tub 30.

Such a ball balancer 90 includes a balancer housing 91 which is formed in an annular shape to have an annular race 90*a* therein, a plurality of balls 92 which are movably installed in the balancer housing 91, and viscous oil 93 which has a predetermined viscosity and is filled in the race 90*a* to have a predetermined height. The plurality of balls 92 may be moved along the race 90*a* in a circumferential direction of the rotating tub 30.

The balancer housing 91 includes a first balancer housing 91*a* and a second balancer housing 91*b* which are respectively formed in an annular shape to be coupled up and down with each other and thus to form the annular race 90*a*. The first balancer housing 91*a* is formed to have a U-shaped cross section and to define an upper surface, an inner circumferential surface and an outer circumferential surface of the race 90*a*, and the second balancer housing 91*b* covers an lower side of the opened first balancer housing 91*a* to define the lower surface of the race 90*a*.

As described above, the race 90*a* is formed in the annular shape to have a greater width and height than a diameter of each ball 92 and to guide the circumferential movement of the balls 92 when the rotating tub 12 is rotated. The race 90*a* is formed to have the sufficient great width, compared with the diameter of each ball 92. This is to enable the balls 92 to be radially moved by a centrifugal force acting on the balls 92 when the rotating tub 30 is rotated.

Also, a lower surface of the race 90*a* may be formed to extend to a radial outside and to be inclined upward, and the outer circumferential surface of the race 90*a* may be formed to be greater than the diameter of each ball 92. This is to enable the balls 92 to be moved to the radial outside along the inclined lower surface of the race 90*a* only when the centrifugal force acting on the balls 92 is more than a predetermined value.

The balls 92 may be formed of a spherical metallic material, and may be arranged to be movable along the race 90*a* in the circumferential direction of the rotating tub 30 and thus to offset an unbalanced load generated at the rotating tub 30 due to unbalance of the laundry when the rotating tub 30 is rotated. When the rotating tub 30 is rotated, the balls 92 perform a balancing function of the rotating tub 30, while moved along the race 90*a*.

The viscous oil 93 is filled in the race 90*a* to have an oil surface having a height which is relatively lower than the diameter of each ball 92. An amount of the viscous oil 93 filled in the race 90*a* may be set so that the balls 92 in the viscous oil 93 is completely submerged in the viscous oil 93, while the viscous oil 93 and the balls 92 are radially moved by the centrifugal force.

The width of the race 90*a* may be formed to be relatively greater than a depth thereof. Since the lower surface of the race 90*a* is formed to be inclined, the width of the race 90*a* may be formed to be relatively greater than an average depth thereof. When the width and the depth of the race 90*a* are formed as described above, a width of the viscous oil 93 which is radially moved by the centrifugal force is greater than the height of the viscous oil 93 which is filled in the race 90*a* due to its own weight. Thus, upper portions of the balls 92 which are supported on the lower surface of the race 90*a* due to their own weights protrude above the oil surface of the viscous oil 93. However, the balls 92 which are radially moved by the centrifugal force are completely submerged in the viscous oil 93.

In the case in which the race 90*a* and the viscous oil 93 are provided as described above, when the rotating tub 30 is rotated at the low speed and thus the centrifugal force acting on the balls is small, the balls 92 are maintained to be located at an radial inside of the race 90*a*. In this state, since the upper portions of the balls 92 are exposed to an outside of the viscous oil 93, the viscosity acting on the balls 92 is relatively small, and thus the balls 92 may be moved in the circumferential direction.

The rotational driving part 100' is provided under the water tub 20 to selectively provide a rotating force to the rotating tub 30 or the pulsator 40. Specifically, the rotational driving part 100' may be operated in a washing mode, in which the rotating force in the normal or reverse direction is provided to the pulsator 40, during a washing process and a rinsing process, and may be operated in a spin-drying mode, in which the rotating force in the reverse direction is provided to the rotating tub 30 and the pulsator 40, during a spin-drying process.

The rotational driving part 100' will be described below.

Figure 25:
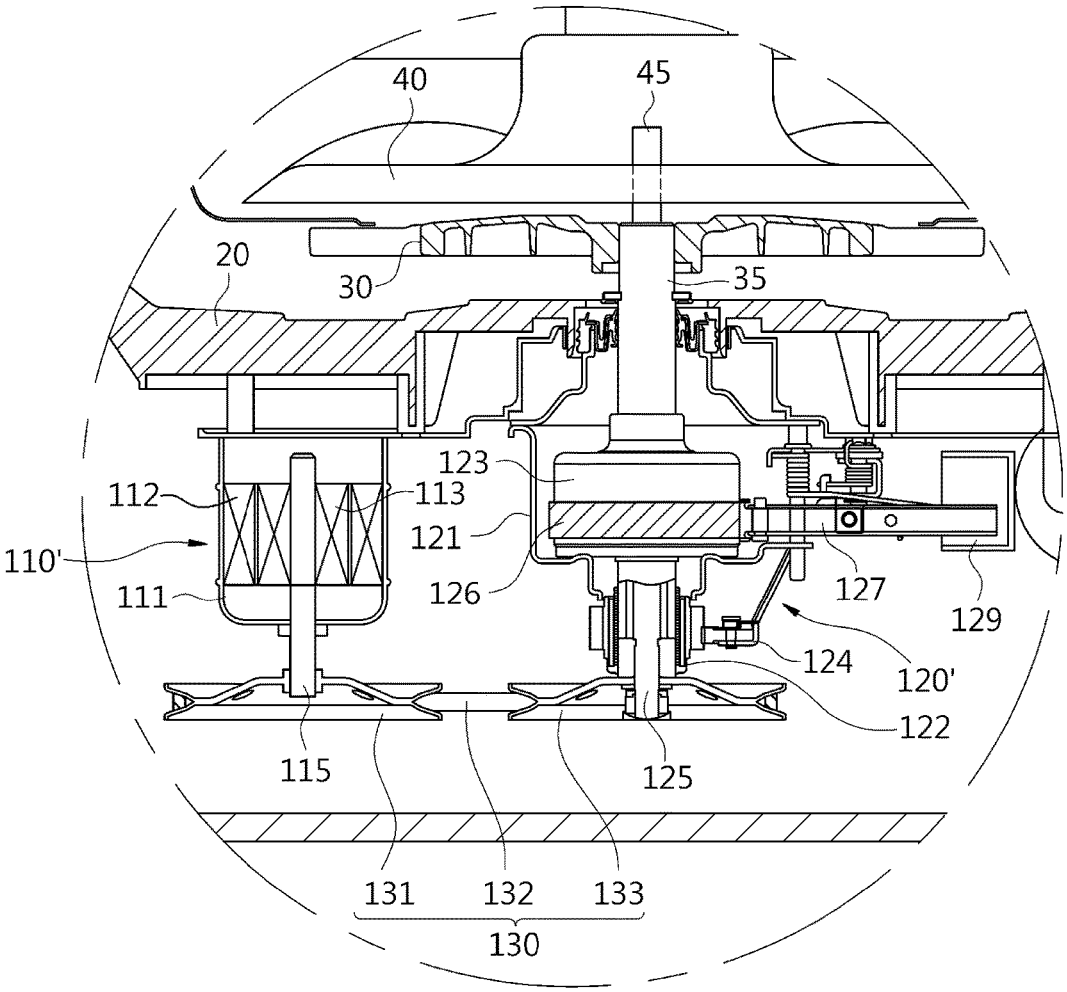
FIG. 25 is an enlarged view of a portion C of FIG. 21.
Figure 26:
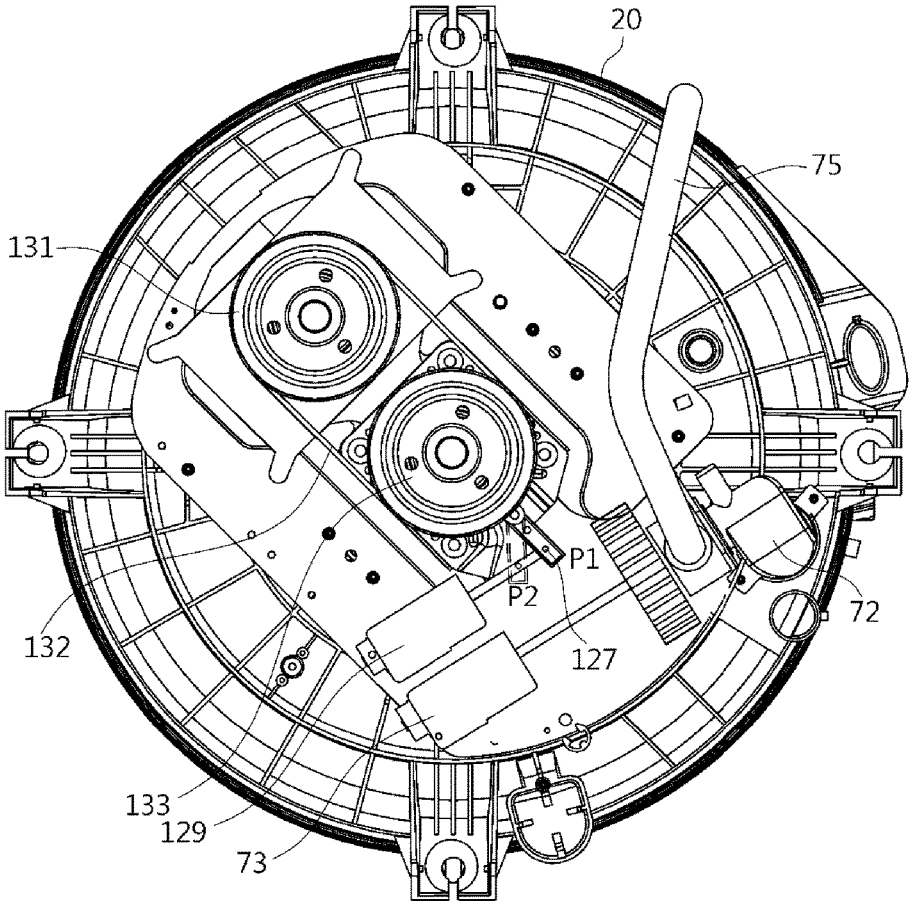
FIG. 26 is a view illustrating a bottom surface of a water tub included in the washing apparatus according to another embodiment of the present disclosure.

FIG. 25 is an enlarged view of a portion C of FIG. 21, and FIG. 26 is a view illustrating a bottom surface of the water tub included in the washing apparatus according to another embodiment of the present disclosure.

Referring to FIGS. 25 and 26, the rotational driving part 100' includes a driving motor 110' which generates the rotating force, a clutch unit 120' which selectively provides the rotating force received from the driving motor 110' to the rotating tub 30 and the pulsator 40, and a pulley unit 130 which transmits the rotating force generated by the driving motor 110' to the clutch unit 120.

The driving motor 110' includes a motor casing 111 which forms an exterior of the driving motor 110', a stator 112 which generates a rotating magnetic field, a rotor 113 which is rotated by the rotating magnetic field, and a motor rotating shaft 115 which is coupled with the rotor 113 to be rotated with the rotor 113. The driving motor 110' generates the rotating force which rotates the rotating tub 30 and the pulsator 40.

An induction motor (IM), in which an induced current is generated at the rotor 113 by the rotating magnetic field generated by the stator 112, and the rotor 113 is rotated by an interaction between a magnetic field formed by the induced current and the rotating magnetic field generated by the stator 112, may be used as the driving motor 110'.

However, the driving motor 110' included in the washing apparatus 1' is not limited to the induction motor. For example, a synchronous motor (SM) in which the rotor 113 includes a permanent magnet generating a magnetic field may be used as the driving motor 110'. However, it is assumed that the driving motor 110' included in the washing apparatus 1' uses the induction motor.

The clutch unit 120' includes a clutch housing 121, a switch gear 122, a reduction gear 123, a clutch lever 124, a brake belt 126, a clutch lever 127 and a mode switching motor 129. Such a clutch unit 120' may be operated in the washing mode in which the driving force of the driving motor 110' is transmitted to the pulsator 40, and the spin-drying mode in which the rotating force is transmitted to the rotating tub 30 and the pulsator 40.

The clutch housing 121 forms an exterior of the clutch unit 120', and accommodates a switch gear 122 and a reduction gear 123 therein.

A clutch rotating shaft 125 receives the rotating force of the driving motor 110' from the pulley unit 130, and transmits the received rotating force to the switch gear 122.

The switch gear 122 selectively transmits a rotating force of the clutch rotating shaft 125 to a rotating tub rotating shaft 35 connected with the rotating tub 30 and a pulsator rotating shaft 45 connected with the pulsator 40 according to an operation of the washing apparatus 1'.

Specifically, according to an operation of the clutch lever 124, the switch gear 122 may transmit a rotating force of the clutch rotating shaft 125 to the pulsator rotating shaft 45 or may transmit the rotating force of the clutch rotating shaft 125 to both of the pulsator rotating shaft 45 and the rotating tub rotating shaft 35.

The clutch lever 124 controls an operation of the switch gear 122, and the mode switching motor 129 controls the operation of the clutch lever 124 through a link wire.

As illustrated in FIG. 26, the clutch lever 124 may be located at a first position P1 or a second position P2 according to an operation of the mode switching motor 129. Specifically, when the mode switching motor 129 is operated, the clutch lever 124 is located at the second position P2, and when the mode switching motor 129 is not operated, the clutch lever 124 is located at the first position P1.

Further, the clutch lever 124 may control the operation of the switch gear 122 according to its positions P1 and P2.

Specifically, when the clutch lever 124 is located at the first position P1, the switch gear 122 may transmit the rotating force of the clutch rotating shaft 125 to the pulsator rotating shaft 45. Also, when the clutch lever 124 is located at the second position P2, the switch gear 122 may transmit the rotating force of the clutch rotating shaft 125 to both of the pulsator rotating shaft 45 and the rotating tub rotating shaft 35.

Eventually, when the mode switching motor 129 is operated, only the pulsator 40 is rotated, and when the drain motor 73 is not operated, the pulsator 40 and the rotating tub 30 may be rotated together.

The reduction gear 123 may reduce the rotating force of the clutch rotating shaft 125 in the washing mode and then may provide the reduced rotating force to the pulsator rotating shaft 45, and also may provide the rotating force of the clutch rotating shaft 125 to the pulsator rotating shaft 45, as it is, in the spin-drying mode.

Specifically, when the rotating tub rotating shaft 35 is fixed, the reduction gear 123 reduces the rotating force of the clutch rotating shaft 125 and then provides the reduced rotating force to the pulsator rotating shaft 45, and when the rotating tub rotating shaft 35 is rotated with the pulsator rotating shaft 45, the reduction gear 123 provides the rotating force of the clutch rotating shaft 125, as it is, to the pulsator rotating shaft 45 and the rotating tub rotating shaft 35.

According to the operation of the clutch lever 127, a brake belt 126 serves to fix the rotating tub rotating shaft 35 so that the rotating tub rotating shaft 35 may not be rotated, or to release the rotating tub rotating shaft 35 so that the rotating tub rotating shaft 35 may be rotated.

Also, as described above, the clutch lever 127 is connected with the mode switching motor 129 to operate the brake belt 126 according to the operation of the mode switching motor 129.

When the clutch lever 127 is located at the first position P1, the brake belt 126 fixes the rotating tub rotating shaft 35, and when the clutch lever 127 is located at the second position P2, the brake belt 126 releases the rotating tub rotating shaft 35. Also, as described above, when the mode switching motor 129 is not operated, the clutch lever 124 is located at the first position P1, and when the mode switching motor 129 is operated, the clutch lever 124 is located at the second position P2.

Therefore, when the mode switching motor 129 is not operated, the brake belt 126 fixes the rotating tub rotating shaft 35, and when the mode switching motor 129 is operated, the brake belt 126 releases the rotating tub rotating shaft 35.

Eventually, when the mode switching motor 129 is not operated, only the pulsator 40 may be rotated, and when the mode switching motor 129 is operated, the pulsator 40 and the rotating tub 30 may be rotated together.

Like this, an operating mode of the clutch unit 120' is switched according to whether the mode switching motor 129 is operated. In other words, when the mode switching motor 129 is operated, the clutch unit 120' is operated in the spin-drying mode, and when the mode switching motor 129 is not operated, the clutch unit 120' is operated in the washing mode.

Also, the operating mode of the clutch unit 120' is switched separately from a draining operation. Specifically, the operation mode of the clutch unit 120' is switched according to the operation of the mode switching motor 129 included in the clutch unit 120', regardless of the operation of a drain motor 73.

The pulley unit 130 includes a driving pulley 131 which is coupled with the motor rotating shaft 115 of the driving motor 110', a driven pulley 133 which is coupled with the clutch rotating shaft 125 of the clutch unit 120', and a pulley belt 132 which transmits a rotating force of the driving pulley 131 to the driven pulley 133.

In the brief description of a process of transmitting the rotating force, the driving motor 110' generates the rotating force using alternating current (AC) power supplied from an external power source, and the generated rotating force is transmitted to the pulley unit 130. Also, the pulley unit 130 transmits the rotating force received from the driving motor 110' to the clutch unit 120' through the pulley belt 132.

Figure 27:
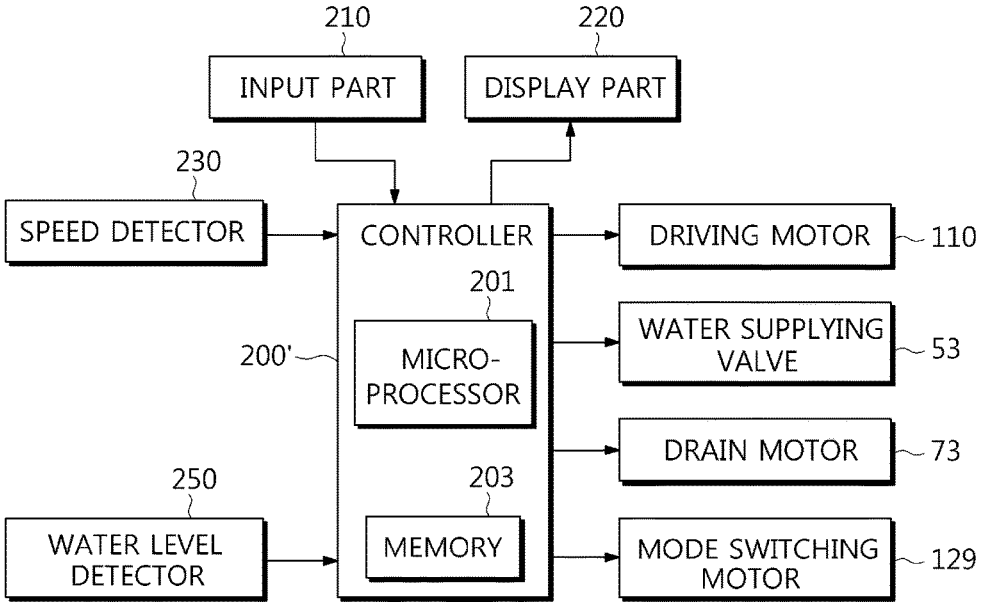
FIG. 27 is a view illustrating a control structure of the washing apparatus according to another embodiment of the present disclosure.

FIG. 27 is a view illustrating a control structure of the washing apparatus according to another embodiment of the present disclosure.

Referring to FIG. 27, the washing apparatus 1' includes an input part 210 which receives a user's control instruction, a display part 220 which displays operation information of the washing apparatus 1', a speed detector 230 which detects a rotating speed of the driving motor 110' or the clutch unit 120', a water level detector 250 which detects a water level of the water accommodated in the water tub 20, and a controller 200' which generally controls the operation of the washing apparatus 1, along with the driving motor 110', the water supplying valve 53, and the drain motor 73 which have been described above.

The input part 210 may include a plurality of operating buttons which receive the control instruction with respect to the washing apparatus 1', and a dial which receives a setup for the washing operation. And the display part 220 may include a display which visually indicates operation information of the washing apparatus 1' corresponding to the user's instruction to the user.

Since the input part 210 and the display part 220 are the same as those in the washing apparatus 1 (referring to FIG. 7) according to one embodiment, the detailed description thereof will be omitted.

The speed detector 230 detects the rotating speed of the driving motor 110' or the clutch unit 120'. Since the speed detector 230 is also the same as that in the washing apparatus 1 (referring to FIG. 7) according to one embodiment, the detailed description thereof will be omitted.

The water level detector 250 detects the water level of the water accommodated in the water tub 20. Since the water level detector 250 is also the same as that in the washing apparatus 1 (referring to FIG. 7) according to one embodiment, the detailed description thereof will be omitted.

The controller 200' may include a memory 203 which stores a program and data related to the operation of the washing apparatus 1', and a micro-processor 201 which performs calculations for controlling various elements included in the washing apparatus 1'.

The memory 203 may include a non-volatile memory which stores a control program and control data controlling the operation of the washing apparatus 1' and maintains stored information even when the power is cut, and a volatile memory which temporarily stores a variety of data related to the operation of the washing apparatus 1'.

The micro-processor 201 processes the data stored in the memory 203 according to the control program stored in the memory 203. For example, the micro-processor 201 may change a setup value for the washing operation according to a washing setup input through the input part 210, and may generate a control signal which controls the driving motor 110', the water supplying valve 53, the drain motor 73 and the mode switching motor 129.

The controller 200' may control various elements included in the washing apparatus 1'. For example, the controller 200' may control the driving motor 110', the water supplying valve 53, the drain motor 73 and the mode switching motor 129 to perform a waster supplying operation, a washing operation, a draining operation and an interim spin-drying operation during the washing process and the rinsing process, and may control the driving motor 110', the drain motor 73 and the mode switching motor 129 to perform a spin-drying operation.

Also, various operations of the washing apparatus 1' to be described below may be interpreted to be performed by controlling operations of the controller 200'.

The structure of the washing apparatus 1' according to another embodiment of the present disclosure has been described above.

Hereinafter, an operation of the washing apparatus 1' according to another embodiment of the present disclosure will be described.

Figure 28:
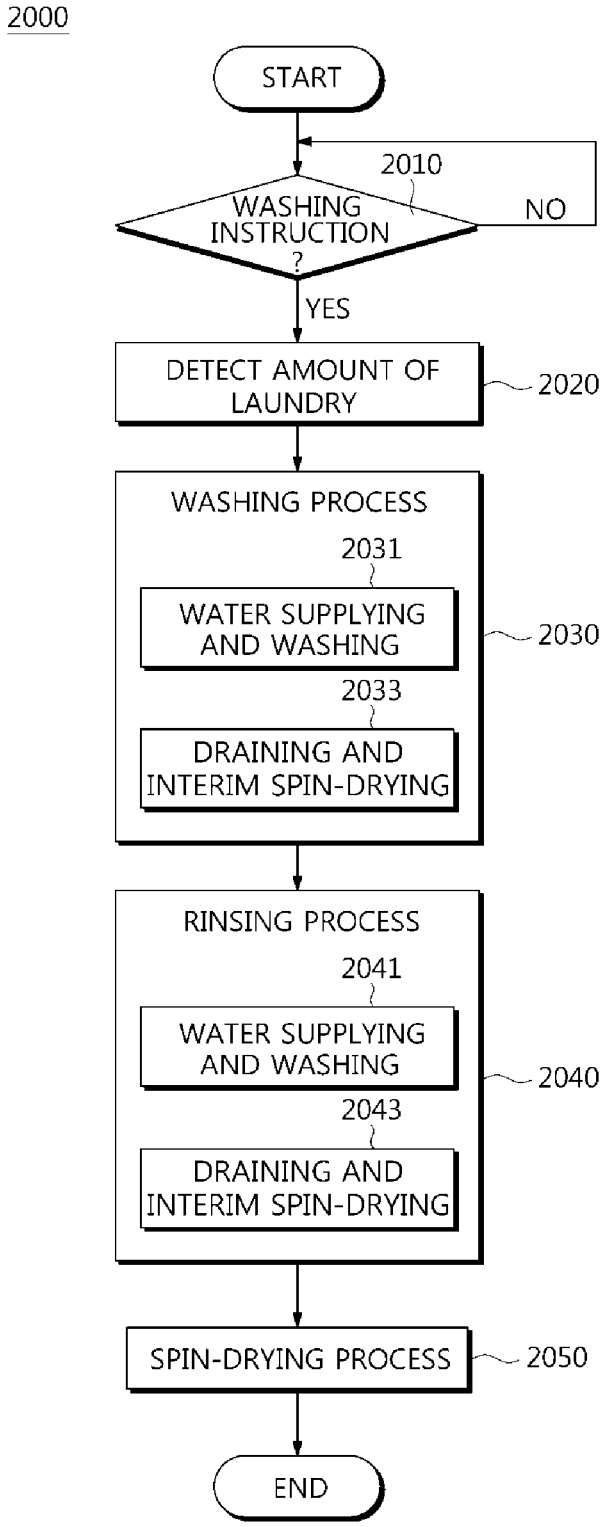
FIG. 28 is a view illustrating a laundry washing method in the washing apparatus according to another embodiment of the present disclosure.

FIG. 28 is a view illustrating a laundry washing method in the washing apparatus according to another embodiment of the present disclosure.

Referring to FIG. 28, the laundry washing method 2000 in the washing apparatus 1' will be described.

The washing apparatus 1' determines whether to perform the washing (2010).

Before the washing apparatus 1' is operated, the user may select a washing course through the input part 210, and may also input detailed settings such as a washing temperature, the number of rinsing operations and an intensity of the spin-drying operation. After the washing course and the detailed settings are input, the user inputs a washing start instruction through the input part 210.

When the washing start instruction is input from the user, the washing apparatus 1' may perform the washing.

When it is determined that the washing is performed (YES in 2010), the washing apparatus 1' detects an amount of the laundry (2020).

For example, the washing apparatus 1' may operate the driving motor 110' for a predetermined period of time, and may detect the amount of the laundry accommodated in the rotating tub 30 based on changes in the driving current and the rotating speed of the driving motor 110' or the clutch unit 120'. In other words, the washing apparatus 1' may calculate the amount of the laundry using a phenomenon in which, as the amount of the laundry accommodated in the rotating tub 30 is increased, a rotational acceleration of the driving motor 110' or the clutch unit 120' is reduced.

As another example, the washing apparatus 1' may have a weight sensor which detects a weight of the damper 21 supporting the water tub 20, and may directly detect the amount of the laundry accommodated in the rotating tub 30 based on an output of the weight sensor.

The washing apparatus 1' may determine an amount of the water, which will be supplied to the water tub 20 in the washing process or the rinsing process, according to the detected amount of the laundry.

Then, the washing apparatus 1' performs the washing process (2030).

The washing process includes a water supplying and washing operation (2031) in which the water is supplied into the water tub 20, and the pulsator 40 is rotated so as to wash the laundry, and a draining and interim spin-drying operation (2033) in which the water is discharged from the water tub 30, and the rotating tub 30 is rotated to separate the water from the laundry.

Since the washing process is the same as that in the washing apparatus 1 according to one embodiment of the present disclosure, the detailed description thereof will be omitted.

Then, the washing apparatus 1' performs the rinsing process (2040).

The rinsing process includes a water supplying and rinsing operation (2041) in which the water is supplied into the water tub 20 and the pulsator 40 is rotated to rinse the laundry, and a draining and interim spin-drying operation (2043) in which the water is discharged from the water tub 30, and the rotating tub 30 is rotated to separate the water from the laundry.

Since the rinsing process is the same as that in the washing apparatus 1 according to one embodiment of the present disclosure, the detailed description thereof will be omitted.

Then, the washing apparatus 1' performs the spin-drying process (2050).

The spin-drying process includes an intermittent spin-drying operation in which the rotating speed of the rotating tub 30 is slowly increased, and a main spin-drying operation in which the rotating tub 30 is rotated at the high speed.

The spin-drying operation of the washing process and the interim spin-drying process of the rinsing process, as well as the spin-drying process may also include the intermittent spin-drying operation and the main spin-drying operation.

The intermittent spin-drying operation and the main spin-drying operation will be described below in detail.

Until now, it has been described that the laundry washing method 2000 includes the washing process, rinsing process and the spin-drying process. However, the washing method is not limited thereto.

For example, the washing apparatus 1' may perform only part of the washing process, the rinsing process and the spin-drying process according to a user's selection. Specifically, the user may operate the washing apparatus 1' to perform only the washing process for a rough washing, or may operate the washing apparatus 1' to perform only the spin-drying process after hand washing.

Figure 29:
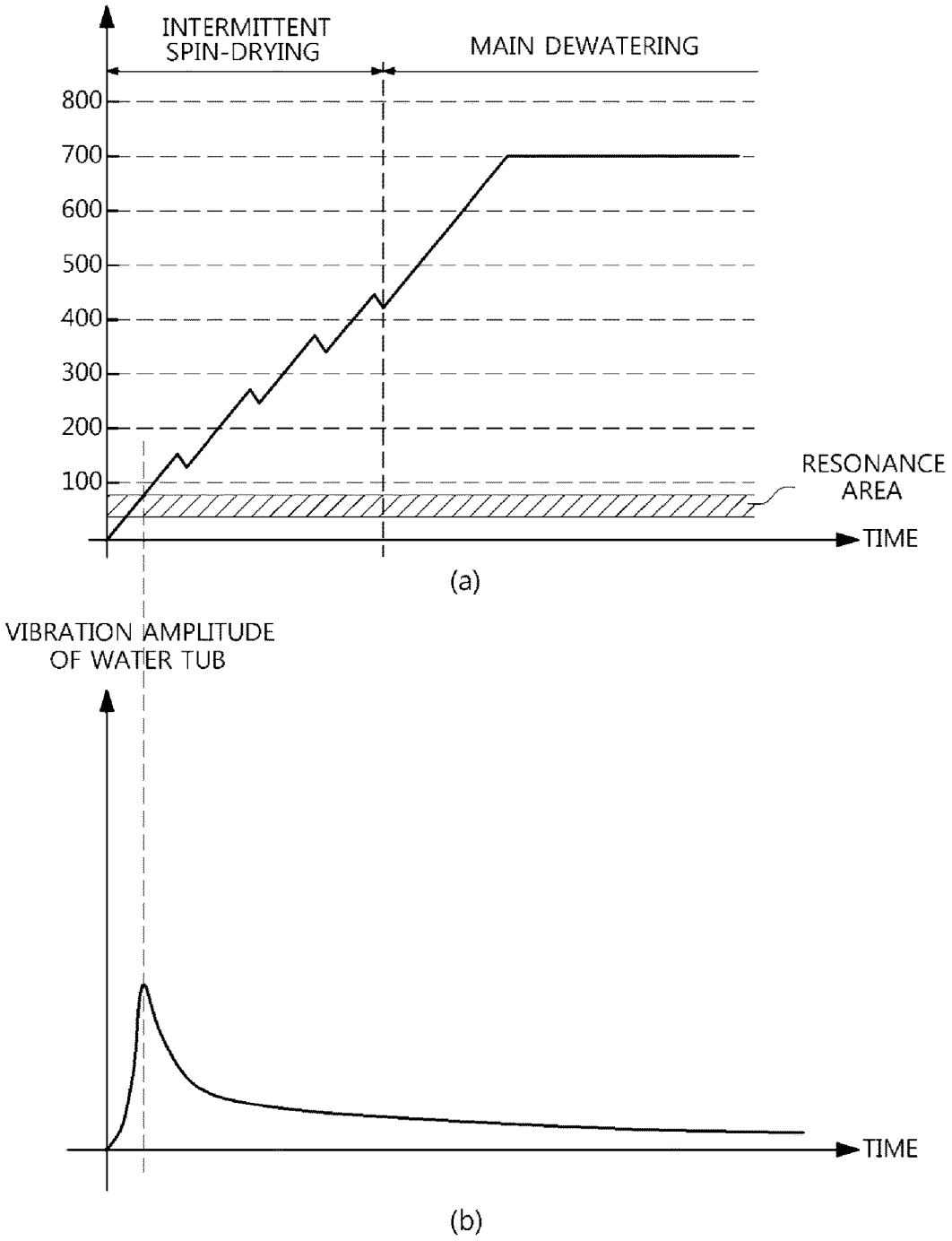
FIG. 29 is a view illustrating a spin-drying process and vibration of the water tub in the spin-drying process.

FIG. 29 is a view illustrating the spin-drying process and the vibration of the water tub in the spin-drying process.

Referring to FIG. 29, the spin-drying process includes the intermittent spin-drying operation and the main spin-drying operation.

As illustrated in FIG. 29, part (a), during the intermittent spin-drying operation, the washing apparatus 1' repeats the operation and shutdown of the driving motor 110', and during the main spin-drying operation, the washing apparatus 1' operates the driving motor 110' for the predetermined period of time so as to increase the rotating speed of the rotating tub 30.

The washing apparatus 1' may perform the intermittent spin-drying operation, and thus may reduce a load of the driving motor 110' in the main spin-drying operation. During the intermittent spin-drying operation, a great quantity of the water is separated from the laundry, and thus a weight of the laundry in the main spin-drying operation may be considerably reduced.

Further, the washing apparatus 1' may discharge the water separated from the laundry by performing the intermittent spin-drying operation. While the rotating tub 30 is rotated at the high speed, it is apprehended that the drainage of the water tub 20 is not good. This is because the water is continuously supplied between the rotating tub 30 and the water tub 20 due to the centrifugal force by the rotation of the rotating tub 30, and the water between the rotating tub 30 and the water tub 20 obstructs the rotation of the rotating tub 30.

There is at least one resonance area within a rotating speed range of the rotating tub 30 during the intermittent spin-drying operation. The resonance is a phenomenon in which vibration of the water tub 20 is greatly increased by the rotation of the rotating tub 30, when a vibration frequency of the water tub 20 accommodating the rotating tub 30 coincides with the rotating speed of the rotating tub 30.

When the resonance phenomenon occurs, an amplitude of the vibration of the water tub 20 included in the washing apparatus 1' becomes maximum, as illustrated in FIG. 29, part (b). As a result, a noise of the washing apparatus 1' is considerably increased, and the washing apparatus 1' may be damaged by the vibration.

The vibration due to the resonance phenomenon may be minimized by reducing the passing number of the rotating speed of the rotating tub 30 passing through the resonance area or increasing the weight of the water tub 20 accommodating the rotating tub 30.

The method of minimizing the vibration due to the resonance phenomenon by reducing the passing number of the rotating speed of the rotating tub 30 passing through the resonance area has been described previously.

Hereinafter, a method of minimizing the vibration due to the resonance phenomenon by increasing the weight of the water tub 20 will be described.

Figure 30:
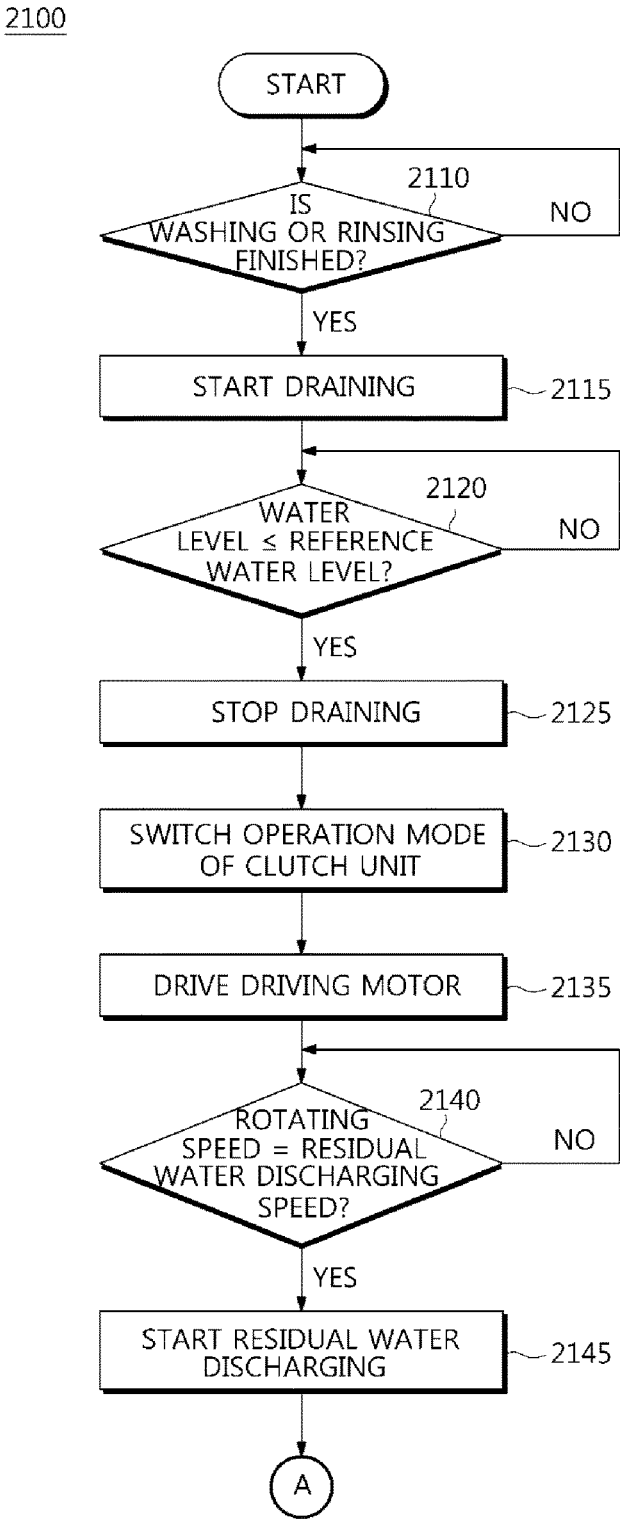
FIGS. 30 and 31 are views illustrating an example of the spin-drying process in the washing apparatus according to another embodiment of the present disclosure.
Figure 31:
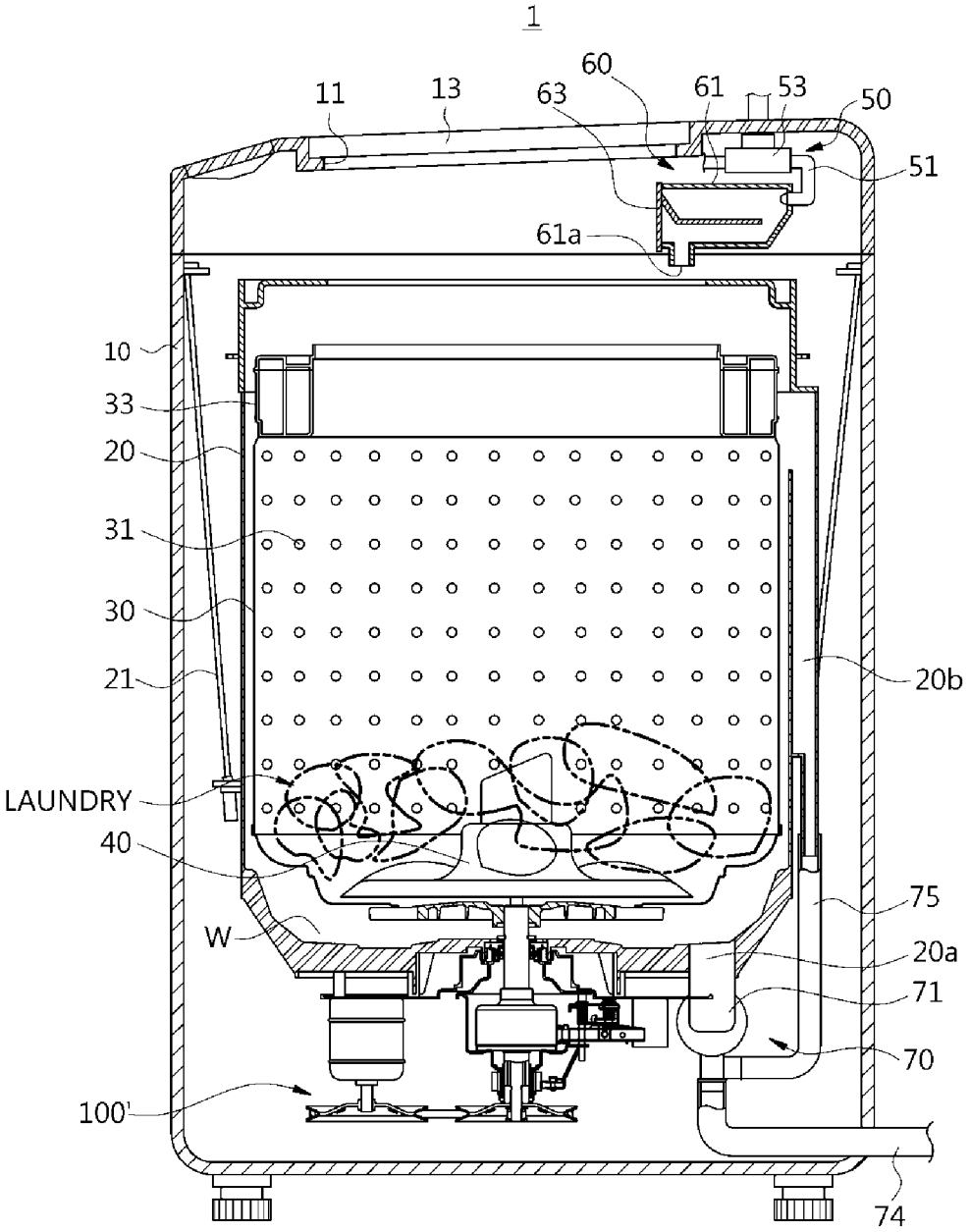
Figure 32:
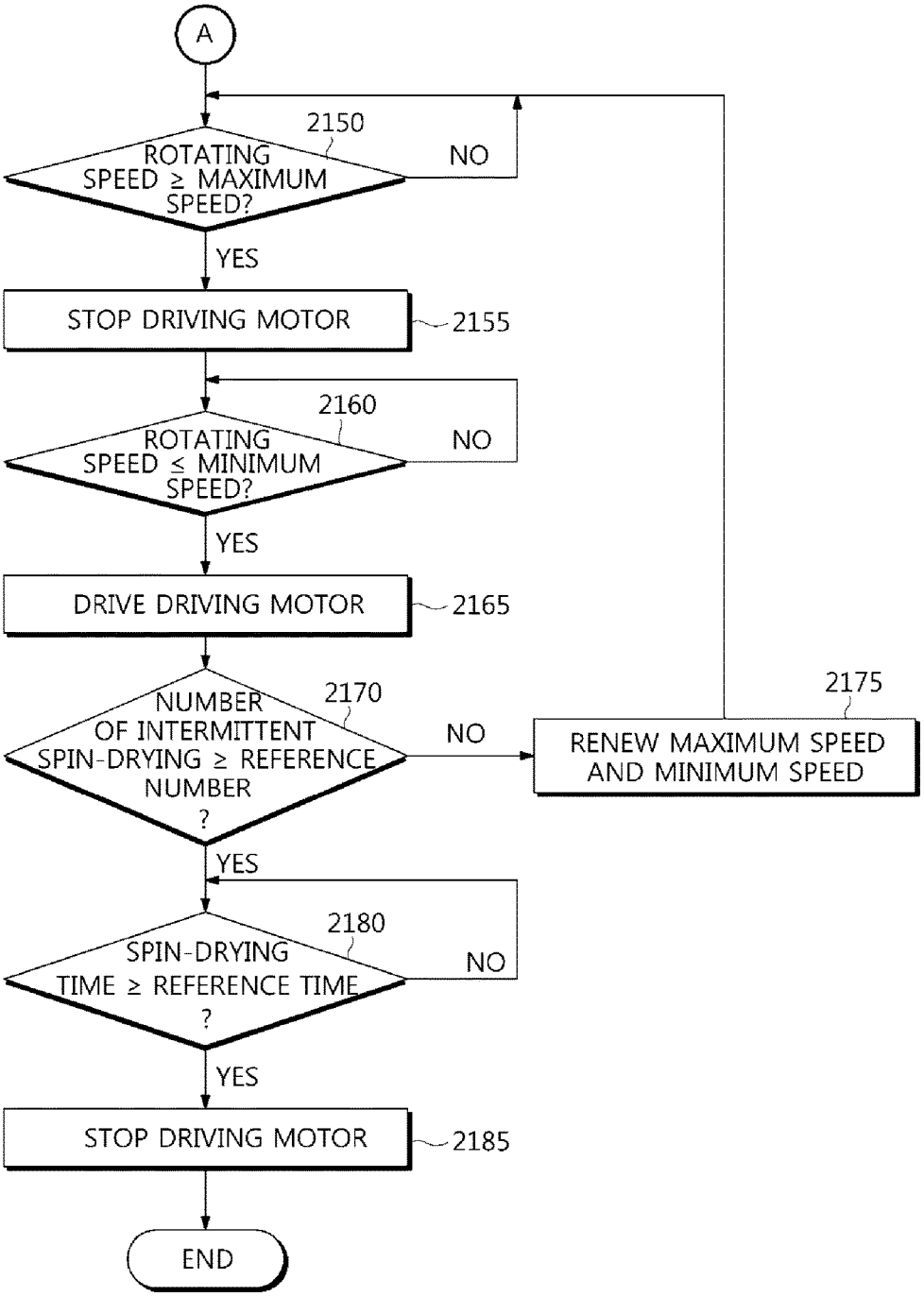
FIG. 32 is a view illustrating a water level of residual water remaining in the water tub during the spin-drying process illustrated in FIGS. 30 and 31.
Figure 33:
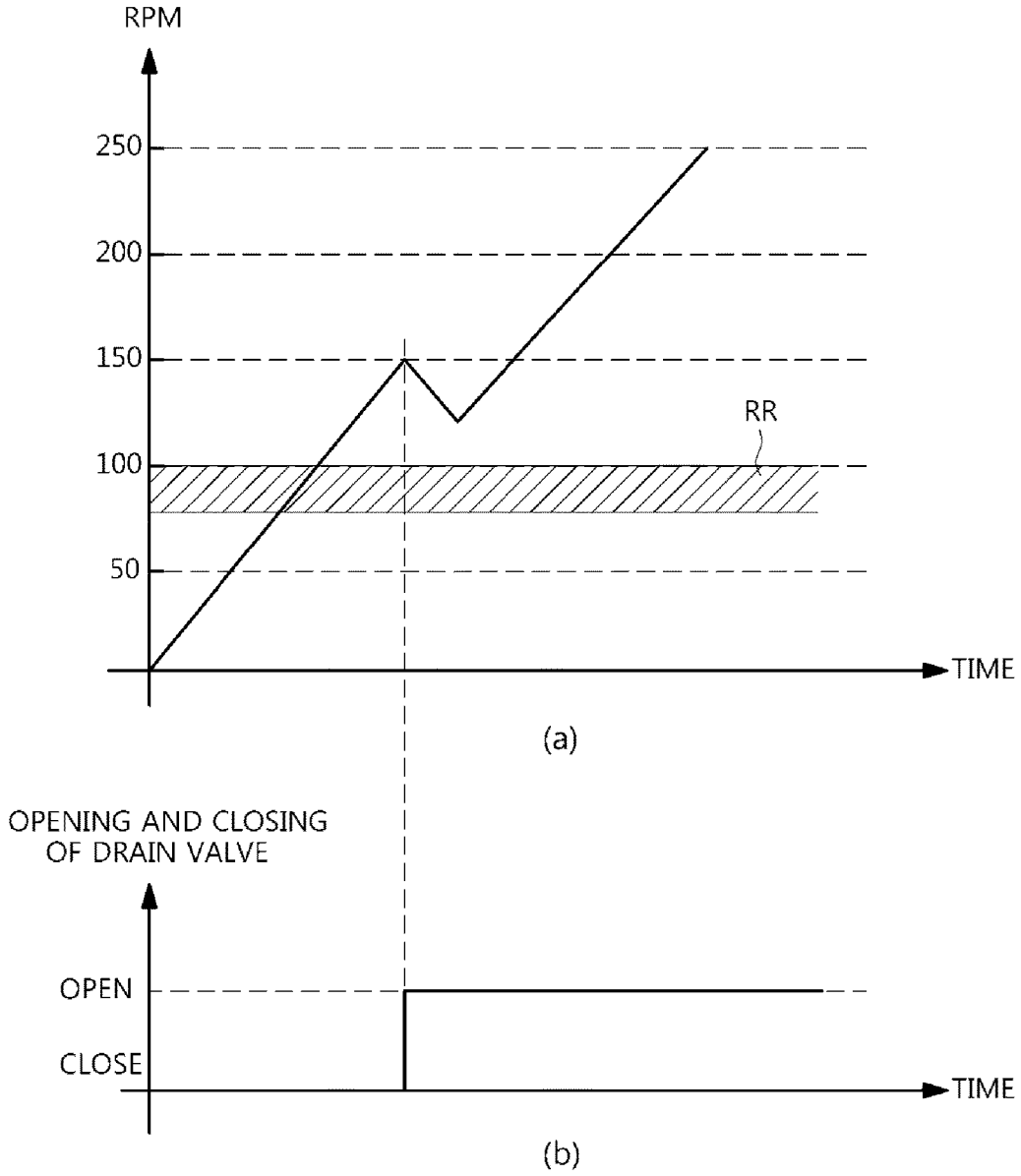
FIGS. 33 to 35 are views illustrating an example in which a drain valve is opened and closed according to a rotating speed of a rotating tub in the spin-drying process of the washing apparatus according to another embodiment of the present disclosure.
Figure 34:
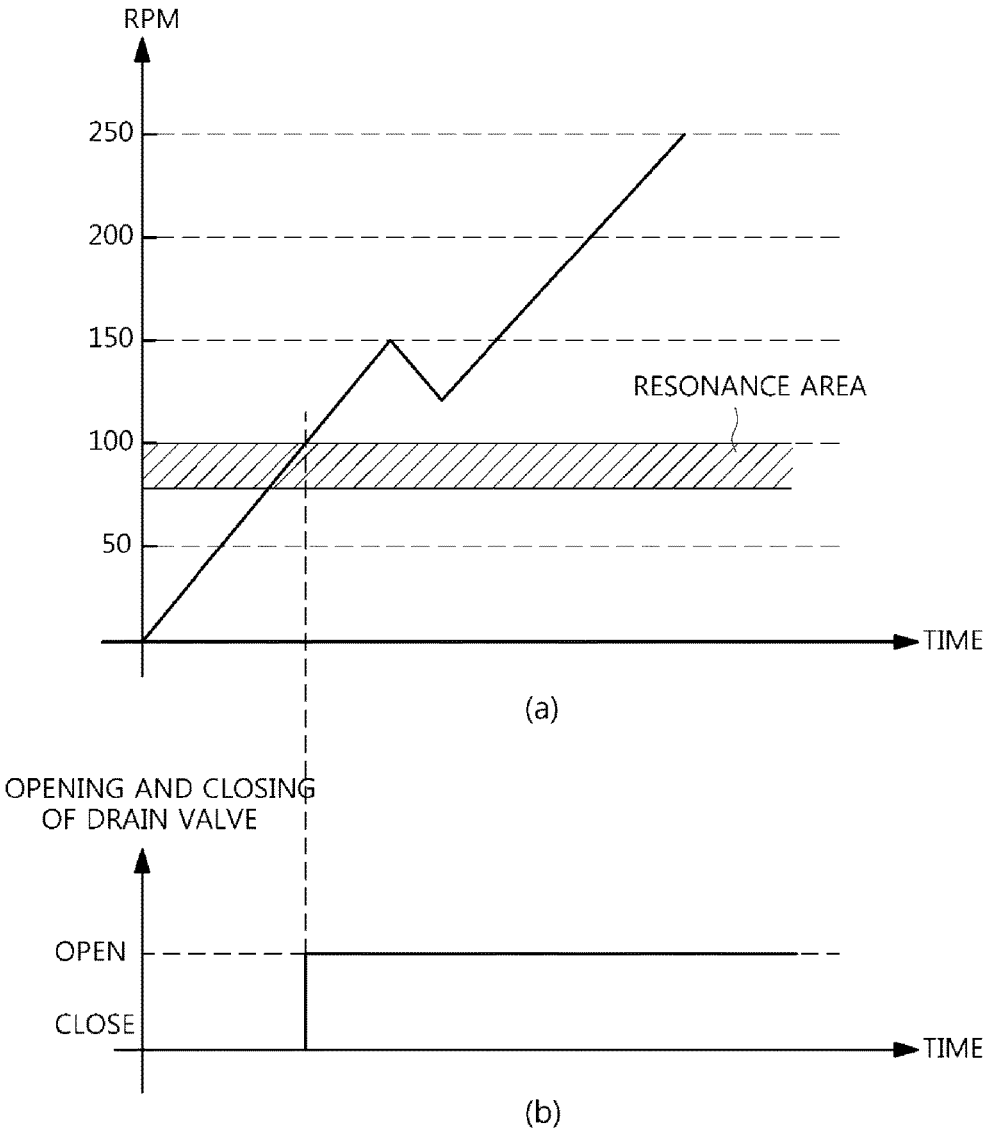
Figure 35:
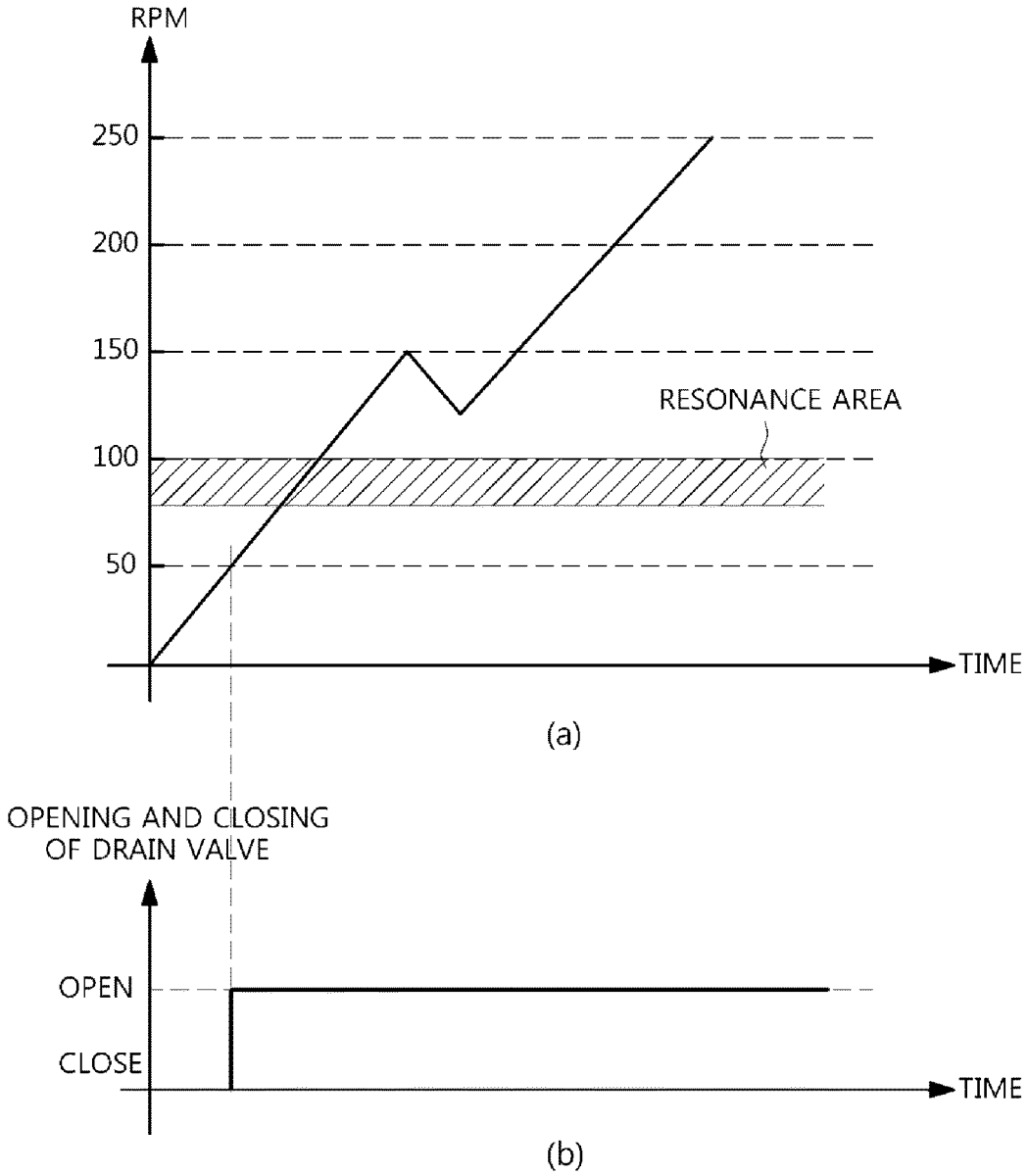

FIGS. 30 and 31 are views illustrating an example of the spin-drying process in the washing apparatus according to another embodiment of the present disclosure, and FIG. 32 is a view illustrating a water level of residual water remaining in the water tub during the spin-drying process illustrated in FIGS. 30 and 31. Also, FIGS. 33 to 35 are views illustrating an example in which the drain valve is opened and closed according to the rotating speed of the rotating tub in the spin-drying process of the washing apparatus according to another embodiment of the present disclosure.

The draining and spin-drying operation (2100) of the washing apparatus 1' according to another embodiment of the present disclosure will be described with reference to FIGS. 30 to 34. The draining and spin-drying operation (2100) to be described below may be applied to the draining and interim spin-drying operation of the washing process and the draining and interim spin-drying operation of the rinsing process as well as the draining and spin-drying operation of the spin-drying process.

First, the washing apparatus 1' determines whether the washing operation or the rinsing operation is finished (2110).

As described above, the draining and spin-drying operation is performed when the rinsing operation of the washing operation and the rinsing operation in the washing process is completed. Therefore, the washing apparatus 1' may determine whether the washing operation or the rinsing operation is finished, and thus may determine whether the draining and spin-drying operation is started.

When it is determined that the washing operation or the rinsing operation is finished (YES in 2110), the washing apparatus 1' starts the draining operation (2115).

The washing apparatus 1' opens the drain valve 72 to discharge the water accommodated in the water tub 20 to an outside. Specifically, the controller 200' of the washing apparatus 1' may operate the drain motor 73. When the drain motor 73 is operated, the drain valve 72 is opened by a link wire between the drain motor 73 and the drain valve 72, and the water in the water tub 20 is discharged to the outside.

During the draining operation, the washing apparatus 1' determines whether the water level in the water tub 20 is equal to or less than a reference water level (2120). Also, when the water level in the water tub 20 is equal to or less than the reference water level (YES in 2120), the washing apparatus 1' stops the draining operation (2125).

The washing apparatus 1' may detect the water level in the water tub 20 based on a detected result of the water level detector 250, and may compare the detected water level with the reference water level.

Also, when the detected water level arrives at the reference water level, the washing apparatus 1' closes the drain valve 72. Specifically, the controller 200' of the washing apparatus 1' stops the operation of the drain motor 73. Here, the reference water level may be set to a water level which is higher than a minimum water level of the water tub 20 and is lower than the bottom surface of the rotating tub 30.

When the water level in the water tub 20 arrives at the reference water level, residual water is remaining on the bottom surface of the water tub 20, as illustrated in FIG. 32.

An amount of the residual water remaining in the water tub 20 after the spin-drying process may be changed according to a size of the water tub 20, and the water tub 20 may accommodate the residual water W of about 10 to 15 l. That is, when the spin-drying operation is started after the drain operation, the weight of the water tub 20 is increased by about 10 to 15 kg.

Like this, when the residual water W is remaining in the water tub 20, the vibration of the water tub 20 due to the rotation of the rotating tub 30 may be reduced in the spin-drying operation. Specifically, the vibration amplitude of the water tub 20 is reduced by increasing the weight of the water tub 20.

In particular, when the rotating speed of the rotating tub 30 passes through the resonance area, the washing apparatus 1' may reduce the vibration of the water tub 20 due to the resonance of the rotating tub 20 by increasing the weight of the water tub 20.

Also, the washing apparatus 1' may set a water level of the residual water W remaining in the water tub 20 to be lower than the bottom surface of the rotating tub 30, and thus may prevent the rotation of the rotating tub 30 from being obstructed by the residual water W in the spin-drying operation.

Then, the washing apparatus 1' switches the operation mode of the clutch unit 120' from the washing mode to the spin-drying mode (2130).

To switch the operation mode of the clutch unit 120' to the spin-drying mode, the washing apparatus 1' operates the mode switching motor 129. When the mode switching motor 129 is operated, the clutch lever 127 included in the clutch unit 120' is moved from the first position P1 to the second position P2, and the switch gear 122 transmits the rotating force of the clutch rotating shaft 125 to the pulsator rotating shaft 45 and the rotating tub rotating shaft 35, and the brake belt 126 releases the rotating tub rotating shaft 35.

As a result, the rotating force of the driving motor 110' may be transmitted to both of the pulsator 40 and the rotating tub 30.

Then, the washing apparatus 1' operates the driving motor (2135).

When the washing apparatus 1' supplies the power to the driving motor 110', the driving motor 110' is rotated by the supplied power. Further, the rotating force of the driving motor 110' is transmitted to both of the pulsator 40 and the rotating tub 30 through the pulley unit 130 and the clutch unit 120'.

Eventually, when the driving motor 110' is operated, both of the pulsator 40 and the rotating tub 30 are rotated.

Then, the washing apparatus 1' determines whether the rotating speed of the pulsator 40 and the rotating tub 30 arrives at a residual water discharging speed (2140). When the rotating speed of the pulsator 40 and the rotating tub 30 arrives at the residual water discharging speed (2140), the washing apparatus 1' starts a residual water draining operation (2145).

The washing apparatus 1' may detect the rotating speed of the pulsator 40 and the rotating tub 30 through the speed detector 230, and may compare the detected rotating speed with the residual water discharging speed.

When the detected rotating speed arrives at the residual water discharging speed, the washing apparatus 1' opens the drain valve 72 to discharge the residual water accommodated in the water tub 20 to the outside. Specifically, the controller 200' of the washing apparatus 1' operates the drain motor 73.

When the drain motor 73 is operated, the drain valve 72 is opened by the link wire between the drain motor 73 and the drain valve 72, and the residual water remaining in the water tub 20 is discharged to the outside.

Here, the residual water discharging speed may be set variously.

For example, the residual water discharging speed may be set to a greater value than a speed of the first resonance area RR. Specifically, the residual water discharging speed may be set to a first maximum speed to be described below.

Like this, in the case in which the residual water discharging speed is set to the first maximum speed, when the rotating speed of the rotating tub 30 arrives at the first maximum speed, the drain valve 72 may be opened as illustrated in FIG. 33, and the residual water in the water tub 20 may be discharged.

As described above, the residual water in the water tub 20 increases the weight of the water tub 20, and thus the vibration of the water tub 20 may be reduced while the rotating speed of the rotating tub 30 passes through the resonance area RR.

In particular, in the case in which the amount of the laundry accommodated in the rotating tub 30 is small, compared with a capacity of the water tub 20 and the rotating tub 30, when the drain valve 72 is opened before the rotating speed of the rotating tub 30 passes through the resonance area RR, the weight of the water tub 20 reducing the vibration may be short.

Therefore, when the amount of the laundry accommodated in the rotating tub 30 is small, compared with a capacity of the water tub 20 and the rotating tub 30, to sufficiently maintain the weight of the water tub 20, the washing apparatus 1' may discharge the residual water after the rotating speed of the rotating tub 30 passes through the resonance area RR.

As another example, the residual water discharging speed may be set to the first resonance area RR.

Like this, in the case in which residual water discharging speed is set to the first resonance area RR, when the rotating speed of the rotating tub 30 arrives at the first resonance area RR, the drain valve 72 may be opened as illustrated in FIG. 34, and the residual water in the water tub 20 may be discharged.

As described above, the residual water in the water tub 20 increases the weight of the water tub 20, and thus the vibration of the water tub 20 may be reduced while the rotating speed of the rotating tub 30 passes through the resonance area RR.

In other words, it is sufficient as long as the residual water remains in the water tub 20, while the rotating speed of the rotating tub 30 passes through the resonance area RR. However, when the water level in the water tub 20 is increased by the water separated from the laundry while the drain valve 72 is closed, and the water level in the water tub 20 is increased, it is apprehended to obstruct the rotation of the rotating tub 30.

In particular, in the case in which the amount of the laundry which is proper to the capacity of the water tub 20 and the rotating tub 30 is accommodated in the rotating tub 30, when the drain valve 72 is opened before the rotating speed of the rotating tub 30 passes through the resonance area RR, it is apprehended that the weight of the water tub 20 reducing the vibration may be short, and when the drain valve 72 is opened after the rotating speed of the rotating tub 30 passes through the resonance area RR, it is apprehended that the water level in the water tub 20 may be higher than the bottom surface of the rotating tub 30.

Therefore, when the amount of the laundry which is proper to the capacity of the water tub 20 and the rotating tub 30 is accommodated in the rotating tub 30, to sufficiently maintain the weight of the water tub 20 and to prevent the water level in the water tub 20 from being higher than the bottom surface of the rotating tub 30, the washing apparatus 1' may discharge the residual water while the rotating speed of the rotating tub 30 passes through the resonance area RR.

As still another example, the residual water discharging speed may be set to a smaller value than the speed of the first resonance area RR.

Like this, when the residual water discharging speed is set so as to be smaller than the speed of the first resonance area RR, the drain valve 72 is opened before the rotating speed of the rotating tub 30 arrives at the first resonance area RR, as illustrated in FIG. 35, and the residual water in the water tub 20 may be discharged.

To reduce the vibration of the water tub 20 while the rotating speed of the rotating tub 30 passes through the resonance area RR, it is sufficient as long as the residual water remains in the water tub 20, while the rotating speed of the rotating tub 30 passes through the resonance area RR. However, when the water level in the water tub 20 is increased by the water separated from the laundry while the drain valve 72 is closed, and the water level in the water tub 20 is increased, it is apprehended to obstruct the rotation of the rotating tub 30.

To prevent the rotation of the rotating tub 30 from being obstructed by the water in the water tub 20, the washing apparatus 1' may discharge the residual water in the water tub 20 before the rotating speed of the rotating tub 30 arrives at the speed of the resonance area RR.

Even though the drain valve 72 is opened, a certain period of time is needed until the residual water in the water tub 20 is completely discharged, and also the water separated from the laundry is introduced into the water tub 20. Therefore, the water level in the water tub 20 is not sharply reduced.

In comparison, a period of time while the rotating speed of the rotating tub 30 arrives at the speed of the resonance area RR by the rotating force of the driving motor 110' is very short.

In particular, in the case in which the amount of the laundry accommodated in the rotating tub 30 is large, compared with the capacity of the water tub 20 and the rotating tub 30, when the drain valve 72 is opened after the rotating speed of the rotating tub 30 passes through the resonance area RR, it is apprehended that the water level in the water tub 20 may be higher than the bottom surface of the rotating tub 30.

Therefore, when the amount of the laundry accommodated in the rotating tub 30 is large, compared with the capacity of the water tub 20 and the rotating tub 30, to prevent the water level in the water tub 20 from being higher than the bottom surface of the rotating tub 30, the washing apparatus 1' may discharge the residual water before the rotating speed of the rotating tub 30 passes through the resonance area RR.

As described above, the washing apparatus 1' may control a time when the residual water remaining in the water tub 20 is discharged, according to the amount of the laundry accommodated in the rotating tub 30.

Specifically, when the amount of the laundry accommodated in the rotating tub 30 is small, the washing apparatus 1' may discharge the residual water after the rotating speed of the rotating tub 30 passes through the resonance area RR, and the amount of the laundry accommodated in the rotating tub 30 is proper, the washing apparatus 1' may discharge the residual water while the rotating speed of the rotating tub 30 passes through the resonance area RR, and when the amount of the laundry accommodated in the rotating tub 30 is large, the washing apparatus 1' may discharge the residual water before the rotating speed of the rotating tub 30 passes through the resonance area RR.

Then, the washing apparatus 1' determines whether the rotating speed of the rotating tub 30 and the pulsator 40 is equal to or more than a maximum speed (2150).

Specifically, the washing apparatus 1' may detect the rotating speed of the driving motor 110' or the clutch unit 120' through the speed detector 230, and may calculate the rotating speed of the rotating tub 30 and the pulsator 40 based on the detected rotating speed of the driving motor 110' or the clutch unit 120'.

When the rotating speeds of the rotating tub 30 and the pulsator 40 are not a maximum speed or more (NO in 2150), the washing apparatus 1' detects the rotating speed of the rotating tub 30 and the pulsator 40, and compares the detected rotating speed with the maximum speed, repeatedly.

When the rotating speeds of the rotating tub 30 and the pulsator 40 are equal to or more than a maximum speed (YES in 2150), the washing apparatus 1' stops the rotational driving of the rotating tub 30 and the pulsator 40 (2155).

Specifically, the controller 200' of the washing apparatus 1' may stop the operation of the driving motor 110'. As a result, the rotating speed of the rotating tub 30 and the pulsator 40 is gradually reduced.

Then, the washing apparatus 1' determines whether the rotating speeds of the rotating tub 30 and the pulsator 40 are equal to or less than a minimum speed (2160).

Specifically, the washing apparatus 1' may detect the rotating speed of the driving motor 110' or the clutch unit 120' using the speed detector 230, and may calculate the rotating speed of the rotating tub 30 and the pulsator 40 based on the detected rotating speed of the driving motor 110' or the clutch unit 120'.

When the rotating speeds of the rotating tub 30 and the pulsator 40 are not a minimum speed or less (NO in 2160), the washing apparatus 1' detects the rotating speeds of the rotating tub 30 and the pulsator 40, and compares the detected rotating speed with the minimum speed, repeatedly.

When the rotating speeds of the rotating tub 30 and the pulsator 40 are equal to or less than the minimum speed (YES in 2160), the washing apparatus 1' rotates the rotating tub 30 and the pulsator 40 (2165).

Specifically, the controller 200' of the washing apparatus 1' may operate the driving motor 110'. As a result, the rotating speeds of the rotating tub 30 and the pulsator 40 are gradually increased.

Then, the washing apparatus 1' determines whether the number of the performed intermittent spin-drying operations is equal to or more than the reference number (2170).

Specifically, the controller 200' of the washing apparatus 1' may compare the number of the performed intermittent spin-drying operations with the reference number predetermined according to the amount of the laundry, and may determine whether the number of the performed intermittent spin-drying operations is equal to or more than the reference number.

When the number of the performed intermittent spin-drying operations is smaller than the reference number (NO in 2170), the washing apparatus 1 renews the maximum speed and the minimum speed to new maximum and minimum speeds (2175), and repeats the operation and shutdown of the driving motor 110'.

For example, when a first intermittent spin-drying operation is performed, the washing apparatus 1' may set the maximum speed to a first maximum speed, and may set the minimum speed to a first minimum speed. Here, the first maximum speed and the first minimum speed may be greater than the speed of the resonance area RR.

Also, when a second intermittent spin-drying operation is performed, the washing apparatus 1' may set the maximum speed to a second maximum speed, and may set the minimum speed to a second minimum speed. Here, the second maximum speed may be greater than the first maximum speed, and the second minimum speed may be greater than the first minimum speed.

Also, when a third intermittent spin-drying operation is performed, the washing apparatus 1' may set the maximum speed to a third maximum speed, and may set the minimum speed to a third minimum speed. Here, the third maximum speed may be greater than the second maximum speed, and the second minimum speed may be greater than the second minimum speed.

Like this, when the intermittent spin-drying operation is repeated, the maximum speed and the minimum speed are gradually increased, and the rotating speed of the rotating tub 30 and the pulsator 40 is gradually increased.

When the number of the performed intermittent spin-drying operations is equal to or more than the reference number (YES in 2170), the washing apparatus 1' determines whether a spin-drying performance time is equal to or more than a reference time (2180). In other words, when the number of the performed intermittent spin-drying operations is equal to or more than the reference number, the washing apparatus 1' stops the intermittent spin-drying operation, and starts the main spin-drying operation.

When the spin-drying performance time is less than the reference time (NO in 2180), the washing apparatus 1' continues the operation of the driving motor 110'.

During the main spin-drying operation, the washing apparatus 1' may continuously operate the driving motor 110' for a predetermined spin-drying time without the stopping of the driving motor 110'. As a result, the rotating speed of the rotating tub 30 and the pulsator 40 may be rotated at a rotating speed of about 720 rpm.

When the spin-drying performance time is equal to or more than the reference time (YES in 2180), the washing apparatus 1' stops the operation of the driving motor 110' (2185).

When the spin-drying performance time is equal to or more than the reference time, the washing apparatus 1' stops all operations for washing the laundry, and stops the rotation of the rotating tub 30.

As described above, the washing apparatus 1' separately including the drain motor 73 and the mode switching motor 129 may remain the residual water in the water tub 20 before the intermittent spin-drying operation is started, and may rotate the rotating tub 30 while the drain valve 72 is closed. As a result, the vibration of the water tub 20 is reduced while the rotating speed of the rotating tub 30 passes through the resonance area RR.

Figure 36:
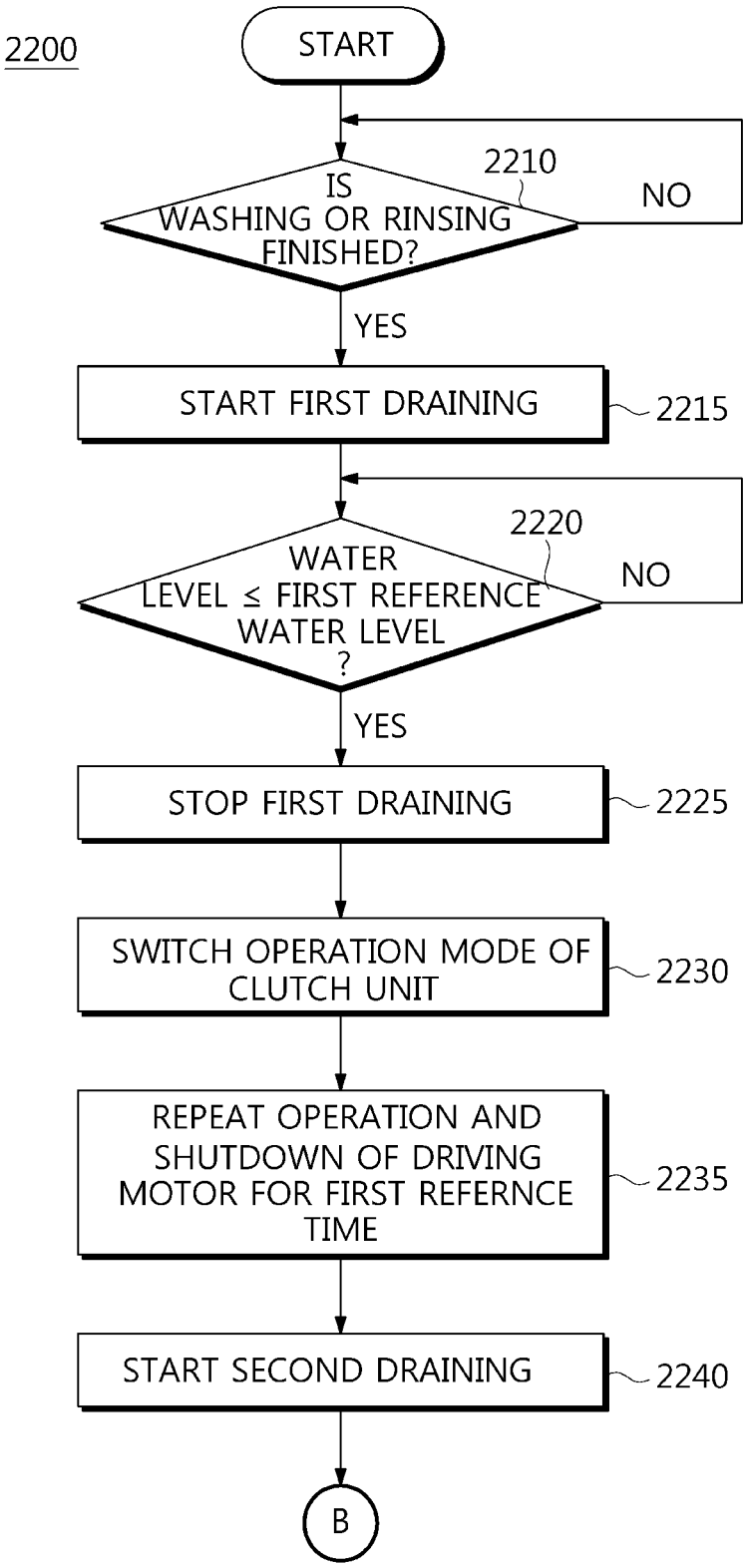
FIGS. 36 and 37 are views illustrating another example of the spin-drying process in the washing apparatus according to another embodiment of the present disclosure.
Figure 37:
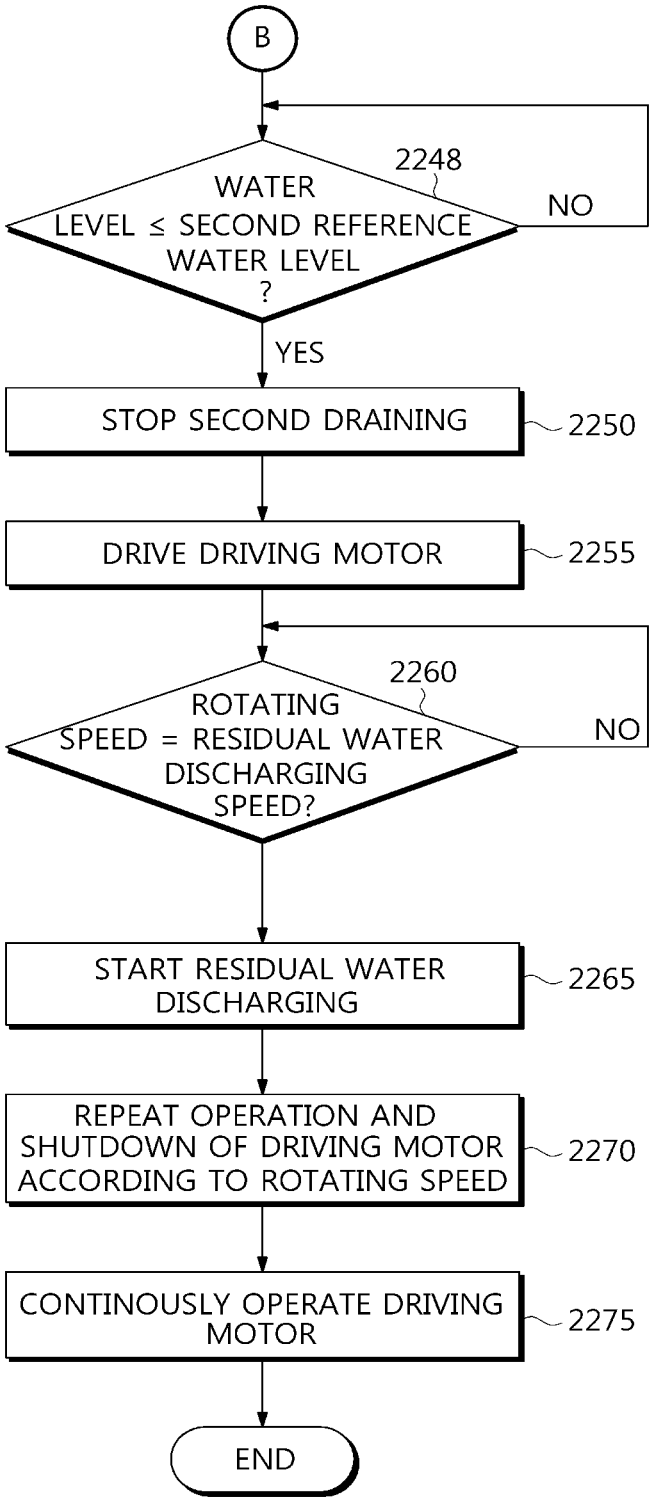
Figure 38:
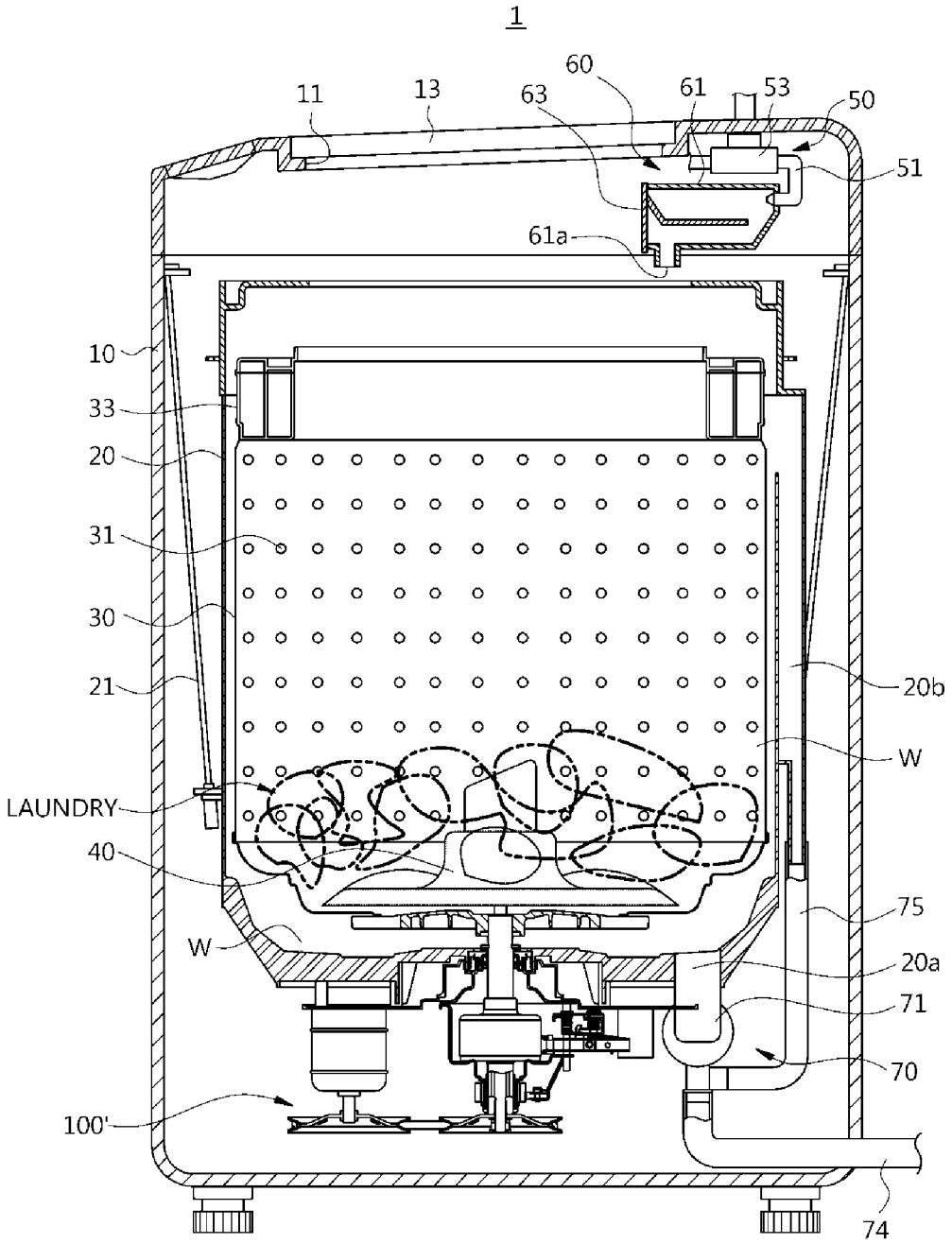
FIG. 38 is a view illustrating a water level of water which detangles twisted laundry during the spin-drying process illustrated in FIGS. 36 and 37.

FIGS. 36 and 37 are views illustrating another example of the spin-drying process in the washing apparatus according to another embodiment of the present disclosure, and FIG. 38 is a view illustrating a water level of the water which detangles twisted laundry during the spin-drying process illustrated in FIGS. 36 and 37.

The draining and spin-drying operation (2200) of the washing apparatus 1' according to another embodiment of the present disclosure will be described with reference to the FIGS. 36 to 38. The draining and spin-drying operation (2200) to be described below may be applied to the draining and interim spin-drying operation of the washing process and the draining and interim spin-drying operation of the rinsing process as well as the draining and spin-drying operation of the spin-drying process.

First, the washing apparatus 1' determines whether the washing operation or the rinsing operation is finished (2210).

As described above, the draining and spin-drying operation is performed when the rinsing operation of the washing operation and the rinsing operation in the washing process is completed. Therefore, the washing apparatus 1' may determine whether the washing operation or the rinsing operation is finished, and thus may determine whether the draining and spin-drying operation is started.

When it is determined that the washing operation or the rinsing operation is finished (YES in 2210), the washing apparatus 1' starts a first draining operation (2215).

The washing apparatus 1' opens the drain valve 72 to discharge the water accommodated in the water tub 20 to the outside. Specifically, the controller 200' of the washing apparatus 1' may operate the drain motor 73. When the drain motor 73 is operated, the drain valve 72 is opened by the link wire between the drain motor 73 and the drain valve 72, and the water in the water tub 20 is discharged to the outside.

During the first draining operation, the washing apparatus 1' determines whether the water level in the water tub 20 is equal to or less than a first reference water level (2220). When the water level in the water tub 20 is equal to or less than the first reference water level (YES in 2220), the washing apparatus 1' stops the first draining operation (2225).

The washing apparatus 1' may detect the water level in the water tub 20 based on a detected result of the water level detector 250, and may compare the detected water level with the first reference water level.

Also, when the detected water level arrives at the first reference water level, the washing apparatus 1' closes the drain valve 72. Specifically, the controller 200' of the washing apparatus 1' stops the operation of the drain motor 73.

Here, the first reference water level may be changed according to the amount of the laundry, and may be set so that the laundry is submerged in the water.

When the water level in the water tub 20 arrives at the first reference water level, the water remains on the lower portion of the water tub 20 so that the laundry is submerged therein, as illustrated in FIG. 38.

Then, the washing apparatus 1' switches the operation mode of the clutch unit 120' from the washing mode to the spin-drying mode (2230), and repeats the operation and shutdown of the driving motor 110' for the first reference time (2235). In other words, the washing apparatus 1' performs a detangling operation which detangles twisted laundry.

To switch the operation mode of the clutch unit 120' to the spin-drying mode, the washing apparatus 1' operates the mode switching motor 129. When the mode switching motor 129 is operated, the clutch lever 127 included in the clutch unit 120' is moved from the first position P1 to the second position P2, and the switch gear 122 transmits the rotating force of the clutch rotating shaft 125 to the pulsator rotating shaft 45 and the rotating tub rotating shaft 35, and the brake belt 126 releases the rotating tub rotating shaft 35.

When the operation and shutdown of the driving motor 110' are repeated after the clutch unit 120' is switched to the spin-drying mode, the rotating and stopping of the rotating tub 30 and the pulsator 40 are repeated, and also the laundry accommodated in the rotating tub 30 is repeatedly rotated and stopped.

While the laundry is repeatedly rotated and stopped in the rotating tub 30, the twisted laundry is detangled naturally. The laundry is moved near an inner surface of the rotating tub 30 by the rotation, and the unbalance of the weight in the rotating tub 30 is solved. That is, the unbalance due to an agglomeration of the laundry is solved.

Then, the washing apparatus 1' starts a second draining operation (2240). Specifically, the washing apparatus 1' opens the drain valve 72 to discharge the water accommodated in the water tub 20 to the outside.

During the second draining operation, the washing apparatus 1' determines whether the water level in the water tub 20 is equal to or less than a second reference water level (2245). When the water level in the water tub 20 is equal to or less than the second reference water level (YES in 2245), the washing apparatus 1' stops the second draining operation (2250).

The washing apparatus 1' may detect the water level in the water tub 20 based on a detected result of the water level detector 250, and may compare the detected water level with the second reference water level. Also, when the detected water level arrives at the second reference water level, the washing apparatus 1' closes the drain valve 72. Here, the second reference water level may be set to a water level which is higher than the minimum water level of the water tub 20 and lower than the bottom surface of the rotating tub 30.

That is, in the washing apparatus 1', the residual water in the water tub 20 remains to reduce the vibration of the water tub 20 generated during the intermittent spin-drying operation.

Then, the washing apparatus 1' operates the driving motor 110' (2255). When the driving motor 110' is operated, both of the pulsator 40 and the rotating tub 30 are rotated.

Then, the washing apparatus 1' determines whether the rotating speed of the pulsator 40 and the rotating tub 30 arrives at the residual water discharging speed (2260). When the rotating speed of the pulsator 40 and the rotating tub 30 arrives at the residual water discharging speed (YES in 2260), the washing apparatus 1' starts the residual water draining operation (2265).

The washing apparatus 1' may detect the rotating speed of the pulsator 40 and the rotating tub 30 through the speed detector 230, and may compare the detected rotating speed with the residual water discharging speed. Also, when the detected rotating speed arrives at the residual water discharging speed, the washing apparatus 1' opens the drain valve 72 to discharge the residual water accommodated in the water tub 20 to the outside. Specifically, the controller 200' of the washing apparatus 1' operates the drain motor 73.

As described above, the residual water discharging speed may be set variously according to the amount of the laundry.

Then, the washing apparatus 1' repeats the operation and shutdown of the driving motor 110' according to the rotating speed of the rotating tub 30 (2270). In other words, the washing apparatus 1' performs the intermittent spin-drying operation to rotate the rotating tub 30 at the high speed.

Then, the washing apparatus 1' continuously operates the driving motor 110'. In other words, the washing apparatus 1' performs the main spin-drying operation.

As described above, the washing apparatus 1' separately including the drain motor 73 and the mode switching motor 129 may rotate the rotating tub 30, while the water remains in the water tub 20 before the intermittent spin-drying operation is started, and the drain valve 72 is closed. As a result thereof, the washing apparatus 1' may detangle the twisted laundry by rotating the rotating tub 30, and may solve the unbalance due to the laundry.

The operation of the washing apparatus 1' for washing the laundry has been described above.

Hereinafter, an operation of the washing apparatus 1' for washing an inner side of the washing apparatus 1' will be described.

Foreign substances such as detergent grounds and pieces of the laundry may be attached to an inner surface of the water tub 20 and an outer surface of the rotating tub 30. However, since the inner surface of the water tub 20 and the outer surface of the rotating tub 30 are not exposed to the outside, it is not easy for the user to clean the inner surface of the water tub 20 and the outer surface of the rotating tub 30.

Figure 39:
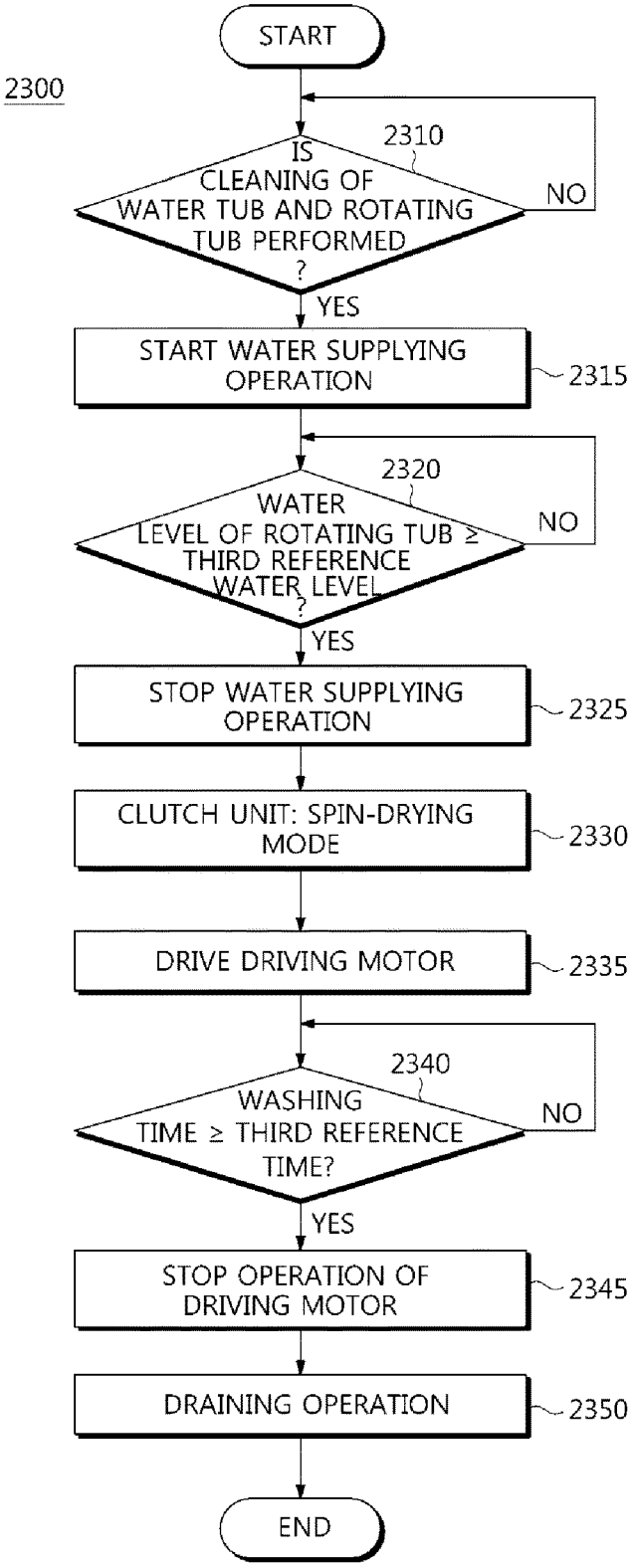
FIG. 39 is a view illustrating an example of a cleaning operation which washes the water tub and the rotating tub in the washing apparatus according to another embodiment of the present disclosure.

FIG. 39 is a view illustrating an example of a cleaning operation (2300) which washes the water tub and the rotating tub in the washing apparatus according to another embodiment of the present disclosure.

First, the washing apparatus 1' determines whether to perform the cleaning operation of the water tub 20 and the rotating tub 30 (2310).

The user may input a cleaning instruction for the water tub 20 and the rotating tub 30 through the input part 210. When the cleaning instruction for the water tub 20 and the rotating tub 30 is input, the washing apparatus 1' may start the cleaning operation of the water tub 20 and the rotating tub 30.

When the cleaning instruction is input (YES in 2310), the washing apparatus 1' performs the water supplying operation (2315). Specifically, the washing apparatus 1' opens the water supplying valve 53 to supply the water into the water tub 20 and the rotating tub 30.

During the water supplying operation, the washing apparatus 1' determines whether the water level of the water tub 20 is equal to or more than a third reference water level (2320). When the water level of the water tub 20 is equal to or more than the third reference water level (YES in 2320), the washing apparatus 1' stops the water supplying operation (2325).

The washing apparatus 1' may detect the water level of the water tub 20 based on a detecting result of the water level detector 250, and may compare the detected water level with the third reference water level. Further, when the detected water level arrives at the third reference water level, the washing apparatus 1' closes the water supplying valve 53.

Then, the washing apparatus 1' sets the operation mode of the clutch unit 120' to the spin-drying mode (2330), and operates the driving motor 110' (2335).

To switch the operation mode of the clutch unit 120' to the spin-drying mode, the washing apparatus 1' operates the mode switching motor 129. When the mode switching motor 129 is operated, the clutch lever 127 included in the clutch unit 120' is moved from the first position P1 to the second position P2, and the switch gear 122 transmits the rotating force of the clutch rotating shaft 125 to the pulsator rotating shaft 45 and the rotating tub rotating shaft 35, and the brake belt 126 releases the rotating tub rotating shaft 35.

When the driving motor 110' is operated after the clutch unit 120' is switched to the spin-drying mode, the rotating tub 30 and the pulsator 40 are rotated.

Also, while the rotating tub 30 is rotated, the water stream is generated between the rotating tub 30 which is being rotated and the fixed water tub 20 in a space between the outer surface of the rotating tub 30 and the inner surface of the water tub 20, and the outer surface of the rotating tub 30 and the inner surface of the water tub 20 is cleaned by the water stream.

While the driving motor 110' is operated, the washing apparatus 1' determines whether a cleaning time is equal to or more than a third reference time (2340). When the cleaning time is equal to or more than the third reference time (YES in 2340), the washing apparatus 1' cuts the power supply to the driving motor 110'.

Then, the washing apparatus 1' performs the draining operation (2350). Specifically, the washing apparatus 1' operates the drain motor 73 to open the drain valve 72.

As described above, the washing apparatus 1' separately including the drain motor 73 and the mode switching motor 129 rotates the rotating tub 30 while the drain valve 72 is closed, and cleans the rotating tub 30 and the water tub 20.

According to one aspect of the present disclosure, in the washing apparatus including the uncontrolled motor, the rotating speed of the motor or the rotating tub is detected, and the on/off-time of the motor is controlled according to the detected rotating speed, and thus the washing apparatus which minimizes the resonance phenomenon in the dewatering process can be provided.

According to another aspect of the present disclosure, the residual water is remained in the dewatering process, and thus the washing apparatus which reduces the vibration of the water tub due to the rotation of the rotating tub can be provided.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing apparatus comprising:

an AC motor configured to generate a rotating force;

a clutch unit operated in a washing mode in which the rotating force is transmitted to a pulsator and a spin-drying mode in which the rotating force is transmitted to a rotating tub and the pulsator;

a mode switching motor configured to switch an operation mode of the clutch unit;

a drain valve configured to open and close a drain pipe which discharges water accommodated in a water tub;

a drain motor configured to drive the drain valve;

a water level detector to detect a water level of the water tub; and a controller configured to:

drive the drain motor to open the drain valve, and subsequently drive the drain motor to close the drain valve in response to the water level of the water tub being below a reference water level, and drive the mode switching motor to switch an operation mode of the clutch unit to the spin-drying mode in response to the water level of the water tub being below the reference water level, and subsequently operate the AC motor, wherein the reference water level is between a bottom surface of the rotating tub and a bottom surface of the water tub.

2. The washing apparatus according to claim 1, further comprising a speed detector configured to detect a rotating speed of at least one of the AC motor and the clutch unit, wherein subsequent to the operation mode of the clutch unit being in the spin-drying mode and the AC motor being operated, the controller is configured to drive the drain motor to open the drain valve when the rotating speed is above a reference speed.

3. The washing apparatus according to claim 2, wherein the reference speed is changed according to an amount of laundry accommodated in the rotating tub.

4. The washing apparatus according to claim 3, wherein the reference speed is the same as a resonance speed of the rotating tub.

5. The washing apparatus according to claim 3, wherein the controller stops the operation of the AC motor when the rotating speed is above an upper limit speed, and the reference speed is the same as the upper limit speed.

6. The washing apparatus according to claim 3, wherein the reference speed is less than a resonance speed of the rotating tub.

* * * * *